US006949333B2

(12) United States Patent
Mifune

(10) Patent No.: US 6,949,333 B2
(45) **Date of Patent: *Sep. 27, 2005**

(54) PHOTOSENSITIVE SILVER HALIDE PHOTOGRAPHIC EMULSION, AND HEAT-DEVELOPABLE PHOTOSENSITIVE MATERIAL

(75) Inventor: Hiroyuki Mifune, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 32 days.

This patent is subject to a terminal disclaimer.

(21) Appl. No.: 10/758,183

(22) Filed: Jan. 16, 2004

(65) Prior Publication Data

US 2004/0152026 A1 Aug. 5, 2004

Related U.S. Application Data

(63) Continuation-in-part of application No. 10/285,644, filed on Nov. 1, 2002.

(30) Foreign Application Priority Data

| | | |
|---|---|---|
| Nov. 5, 2001 | (JP) | 2001-339636 |
| Nov. 8, 2001 | (JP) | 2001-342983 |
| Nov. 9, 2001 | (JP) | 2001-344727 |
| Nov. 29, 2001 | (JP) | 2001-364512 |
| Mar. 29, 2002 | (JP) | 2002-96660 |
| Mar. 29, 2002 | (JP) | 2002-97920 |
| Jan. 21, 2003 | (JP) | 2003-011904 |
| Jan. 31, 2003 | (JP) | 2003-023311 |

(51) Int. Cl.[7] ..... G03C 1/035; G03C 1/015; G03C 1/09; G03C 1/498

(52) U.S. Cl. ..... 430/569; 430/567; 430/599; 430/603; 430/605; 430/617; 430/619

(58) Field of Search ..... 430/567, 569, 430/599, 603, 605, 617, 619

(56) References Cited

U.S. PATENT DOCUMENTS

| | | | | |
|---|---|---|---|---|
| 3,892,574 | A | * | 7/1975 | Claes et al. |
| 4,332,889 | A | * | 6/1982 | Siga et al. ..... 430/619 |
| 6,143,488 | A | * | 11/2000 | Uytterhoeven et al. ..... 430/619 |
| 6,165,705 | A | * | 12/2000 | Dankosh et al. ..... 430/619 |
| 2003/0091347 | A1 | * | 5/2003 | Goto et al. |
| 2003/0207216 | A1 | * | 11/2003 | Fukui et al. |
| 2003/0219684 | A1 | * | 11/2003 | Yabuki et al. ..... 430/617 |
| 2003/0224299 | A1 | * | 12/2003 | Nariyuki et al. |
| 2003/0232288 | A1 | * | 12/2003 | Oka et al. ..... 430/603 |
| 2004/0018457 | A1 | * | 1/2004 | Mifune ..... 430/603 |
| 2004/0023175 | A1 | * | 2/2004 | Yamamoto et al. ..... 430/619 |
| 2004/0081925 | A1 | * | 4/2004 | Oka et al. ..... 430/619 |
| 2004/0081926 | A1 | * | 4/2004 | Nariyuki et al. |
| 2004/0096785 | A1 | * | 5/2004 | Nariyuki et al. |

FOREIGN PATENT DOCUMENTS

| | | | |
|---|---|---|---|
| GB | 1422057 | * | 1/1976 |

* cited by examiner

*Primary Examiner*—Richard L. Schilling
(74) *Attorney, Agent, or Firm*—Taiyo, Nakajima & Kato

(57) ABSTRACT

The present invention provides a photosensitive silver halide photographic emulsion comprising a silver iodide content of 41 mol % or more and 100 mol % or less and including a silver halide to which reduction sensitization is applied in the course of particle formation, and silver halide photographic emulsion comprising 41 mol % to 100 mol % of silver iodide and subjected to at least one of chalcogen sensitization and gold sensitization to the insides of particles.

25 Claims, No Drawings

PHOTOSENSITIVE SILVER HALIDE PHOTOGRAPHIC EMULSION, AND HEAT-DEVELOPABLE PHOTOSENSITIVE MATERIAL

CROSS-REFERENCE TO RELATED APPLICATIONS

This application is a continuation-in-part of application Ser. No. 10/285,644, filed on Nov. 1, 2002, now published as US 2003/0232288A1. This application claims priority under 35 USC 119 from Japanese Patent Application Nos. 2003-011904 and 2003-023311, the disclosures of which are incorporated by reference herein.

BACKGROUND OF THE INVENTION

1. Field of the Invention

The present invention concerns a silver halide photographic emulsion with a high silver iodide content. It particularly relates to a silver halide photographic emulsion which has a high silver iodide content and whose sensitivity is improved by controlled chemical sensitization. Furthermore, it relates to a heat-developable photosensitive material which contains photosensitive silver halide with a high silver iodide content and whose performance is improved by a new chemical sensitization method.

2. Description of the Related Art

In recent years, improvements have been increasingly demanded of silver halide photographic materials in terms of high sensitivity, good storability, processability in developing, gradation, graininess and sharpness. Silver halide emulsions are usually subjected to chemical sensitization by using various types of chemical substances in order to obtain desired levels of sensitivity and gradation. Specific methods, adopted alone or in combination, include chalcogen sensitization such as sulfur sensitization, selenium sensitization or tellurium sensitization; noble metal sensitization, using a noble metal such as gold; and reduction sensitization, either using a reducing agent or taking advantage of an atmosphere conducive to reduction. In marked contrast to the many methods of chemical sensitization reported for silver iodobromide or silver chloride emulsions with a silver iodide content as low as 40%, instances of effective chemical sensitization for photographic emulsions with a high level of silver iodide, a silver iodide content of 41% to 100%, have so far been extremely rare.

For example, JP-A No. 48-87825 discloses a reduction reaction, that is, reduction sensitization applied until the formation of silver halide particles has been completed, and also discloses that a preferred silver halide for applying the sensitization is silver chloride, silver bromide or a mixture thereof, which optionally may also contain a small amount of silver iodide of up to 10 mol %. However, with regard to emulsions of high silver iodide with a content of 41 mol % or higher, there have so far been no findings at all on the advantages and disadvantages of timing for applying reduction sensitization or on securing a superior reduction capability sensitization.

Further, for example, the Journal of Photographic Science vol. 28, p 163 written by R. L. Jenkins and G. C. Farnell (published in 1980) discloses sulfur sensitization conducted with the use of sodium thiosulfate after the completion of the formation of silver iodide emulsion particles. Further, the Journal of Photographic Science vol. 22, p 174 written by D. H. Junker, E. Klein and E. Moisar (published in 1974) discloses gold sulfur sensitization applied on the insides of silver bromide emulsion particles to form latent images in the particles, so-called, internal latent type particles. However, in the case of emulsions of high silver iodide with a silver iodide content of 41 mol % to 100%, there has up to now no knowledge as to what advantages and disadvantages there would be when chalcogen sensitization or gold sensitization is applied to the insides of particles.

On the other hand, in the fields of medicine and printing production, from the viewpoints of environmental protection and space saving, there have been strong demands for dry photographic processing. In the fields described above, digitalization has made progress, and there has been a rapid popularization of systems for inputting image information into computers; storing and optionally processing the information, outputting it to photosensitive materials by means of communications at necessary sites with the use of laser image setters or laser imagers; and then developing the image information on the spot. Photosensitive materials are required to record by laser exposure at a high level of illuminance and to form clear black images having a high resolution and sharpness. As regards the digital imaging recording materials, various kinds of hard copy systems utilizing pigments and dyes, such as ink jet printers or electrophotography, have been distributed in markets as general image forming systems. However, these recording materials are not yet satisfactory in terms of the image qualities (sharpness, graininess, gradation and tone) that determine diagnostic performance, as in images in the medical field, nor are they satisfactory in terms of recording speed (sensitivity), and they have thus still not yet reached a level capable of substituting for existing medical silver salt films used in wet development.

As for dry image recording materials, thermal image forming systems are known (for example, in U.S. Pat. Nos. 3,152,904 and 3,457,075, and "Thermally Processed Silver Systems", written by D. H. Klosterboer (Imaging Processes and Materials) Neblette, 8th edition, edited by Sturge, V. Walworth, and A. Shepp, Chapter 9, page 279, 1989). Specifically, heat-developable photosensitive materials have a photosensitive layer containing a catalytically active amount of photocatalyst (for example, silver halide), a reducing agent, a reducible silver salt (for example, organic silver salt) and, optionally, a toning agent for controlling the tone of silver, all dispersed in a binder matrix. The heat-developable photosensitive material, when heated to a high temperature (for example, 80° C. or higher) after imagewise exposure, forms black silver images by an oxidation/reduction reaction between a silver halide, or a reducible silver salt (functioning as an oxidizer), and a reducing agent. The oxidation/reduction reaction is promoted by a catalytic effect of latent images of the silver halide formed by exposure. Accordingly, black silver images are formed in an exposed region (for example, refer to U.S. Pat. No. 2,910,377 and JP-B No. 43-4924. Moreover, the Fuji Medical Dry Imager FM-DPL has been put on the market as a medical image forming system using the heat-developable photosensitive material.

Since the image forming system utilizing an organic silver salt described above has no fixing step, a significant problem has been the storing of images after development process, and in particular a deterioration in the quality of print out, particularly after exposure to light. Methods of utilizing silver iodide formed by conversion of organic silver salts as a means for improving print out have been disclosed (for example, refer to U.S. Pat. No. 6,143,488, EP-No. 0922995).

However, sufficient sensitivity could not be obtained by means of the method of converting organic silver salts with iodine described therein, and it proved difficult to come up with a practical system. While photosensitive materials utilizing silver iodide are also described in several patent documents (for example, refer to WO 97-48014, WO97-48015, U.S. Pat. No. 6,165,705, JP-A No. 8-197345 and Japanese Patent No. 2785129), none of them has yet reached a sufficient standard in terms of sensitivity and prevention of fogging, or can stand up to practical application as laser exposure photosensitive materials.

As a means of improving sensitivity of silver iodide photographic emulsions, sensitization has been known in technical documents, sensitization, for example, by using halogen receptors such as sodium nitrite, pyrogarol or hydroquinone, by dipping into an aqueous solution of silver nitrate or by sulfur sensitization at pAg 7.5 (for example, refer to Photographic Science and Engineering, vol. 18(5), p 475, by P. B. Gilman, (published in 1974), Photographic Science and Engineering, vol. 18(5), p 475, by W. L. Gardner, (published in 1974), Photographic Science and Engineering, vol. 5, p 216, by T. H. James, (published in 1961). However, as shown in the examples the sensitizing effect of the halogen receptors is extremely low and conspicuously inadequate for the purpose of the heat-developable photosensitive materials of the type used by the present invention. Accordingly, there have been strong demands for the development of a technique capable of raising appreciably the level of sensitivity in heat-developable photosensitive materials with a high silver iodide content.

In the case of silver halide photosensitive materials for liquid development (for example, refer to U.S. Pat. Nos. 5,747,235, 5,747,236, 6,054,260 and 5,994,051), a method of sensitization is known involving the use of a compound forming two electrons with one photon.

However, in the silver halide photosensitive material for liquid development, silver halide is generally reduced by a developing chemical (reducing agent) contained in a processing solution to form silver images, or alternatively color images are formed by utilizing an oxidant by-product of a developer, and in either case a basic reaction is the reduction of the silver halide by a developer. In contrast, in the heat-developable photosensitive material, silver halide merely forms latent images by exposure, and silver halide itself is not reduced by the reducing agent but on the other hand what are reduced are silver ions supplied from a non-photosensitive organic silver salt. As regards reducing agents, while an ionic reducing agent such as hydroquinone or p-phenylenediamines is used in the case of liquid development, in the case of a heat-developable photosensitive material, a hindered phenol derivative known as a radical reaction agent is generally used.

As described above, for on the one hand the photosensitive material for liquid development and for on the other hand the heat-developable photosensitive material, the mechanisms of a developing reaction (reduction reaction) are quite different, and the compounds used also belong to entirely different categories. Accordingly, it cannot be always assumed that a compound which is effective in the case of liquid development will automatically also be effective in the case of a heat-developable photosensitive material. Also, in the case of the compounds described in the group of US patents mentioned above, when they are applied to the heat-developable photosensitive materials, there is no guarantee at all that identical effects would be obtained and equally it cannot be predicted that completely different effects would be obtained. Furthermore, it is inconceivable that they could be applied to heat-developable photosensitive materials that use emulsions of high silver iodide content and it has been impossible to foresee the effects of doing so.

Accordingly, photographic emulsions of a high silver iodide content with a high degree of sensitivity are required. Further, outstanding heat-developable photosensitive materials of high sensitivity with a low propensity for fogging are also necessary.

SUMMARY OF THE INVENTION

The present invention has been achieved by means of a silver halide photographic emulsion and a heat-developable photosensitive material to be described below.

The invention provides, as a first aspect, a photosensitive silver halide photographic emulsion comprising a silver iodide content of 41 mol % to 100 mol % and including a silver halide to which reduction sensitization is applied in the course of particle formation The invention provides, as a second aspect, a silver halide photographic emulsion comprising 41 mol % to 100 mol % of silver iodide and subjected to at least one of chalcogen sensitization and gold sensitization to the insides of particles.

DETAILED DESCRIPTION OF THE INVENTION

The present invention is described specifically below.

Photosensitive silver halide photographic emulsion

A photosensitive silver halide photographic emulsion used in the invention is an emulsion having a composition with a high silver iodide content of 41 mol % to 100 mol % (hereinafter referred to as "high silver iodide emulsion"). In the first aspect, reduction sensitization is applied during formation of particles of the high silver iodide emulsion. Further, reduction sensitization is preferably applied in the presence of at least one element selected from a bromide ion, a chloride ion, a chalcogen ion, a pseudo halide ion and an ion of a transition metal belonging to groups 3 to 12 in the Periodical Table. In the second aspect, at least one of chalcogen sensitization or gold sensitization is applied to the insides of particles of the high silver iodide emulsion.

1) Halogen Composition

It is important that the photosensitive silver halide used in the invention has a composition with a high silver iodide content of 41 mol % to 100 mol %. The residue may be selected from silver chloride, silver bromide or an organic silver salt such as silver thiocyanate or silver phosphate, and silver bromide or silver chloride is particularly preferred. By the use of the silver halide of a composition with a high silver iodide content, a favorable heat-developable photosensitive material having excellent image storability after development, particularly, remarkable prevention of fogging caused by photo-irradiation can be designed.

Further, the silver iodide content is preferably 80 mol % to 100 mol %, more preferably 85 mol % to 100 mol %, and still more preferably 90 mol % to 100 mol % from the viewpoint of the image storability to the irradiation of light after the processing.

The distribution of the halogen composition in each particle may be uniform, or the halogen composition may change stepwise or continuously. Further, silver halide particles having a core/shell structure can also be used preferably. Specifically, the silver halide particles having a core/shell structure preferably has a 2- to 5-layered structure and more preferably a 2- to 4-layered structure. Silver halide particles in which the silver iodide content is higher in cores than in shells, or vice versa can also be preferably used. Further, a technique of localizing silver chloride or silver bromide formed as an epitaxial portion on the surfaces of particles can also be used preferably.

2) Reduction Sensitization

The reduction sensitization in the first aspect of the invention is applied during particle formation of high silver iodide emulsion particles. Further, the reduction sensitization can also be applied to the high silver iodide particles of the second aspect of the invention. The reduction sensitization in the second aspect can be applied either during or after the formation of the high silver iodide emulsion particles. In the reduction sensitization, reducing compounds described, for example, in Chimie et Physique, written by P. Grafkids, Photographique (published from Paul Montel Co, in 1987 (fifth edition) and Journal of Research Disclosure, vol. 307, No. 307105 can be used. Specifically, compounds such as borane compounds (for example, dimethylamine borane), aminoiminomethanesulfinic acid, reductones (for example, ascorbic acid), stannous chloride, hydrazine compounds (for example, hydrazine or p-tolylhydrazine), silane compounds, polyamine compounds (for example, diethylene triamine, triethylene tetraamine), aldehyde compounds, sulfites, hydrogen gas or compounds described in Japanese Patent Application No. 7-78685. Further, reduction sensitization can be conducted by aging silver halide at high pH (8 or more, preferably, 9 or more) or aging in an atmosphere in which silver ions excessively exist (so-called silver aging, for example, at pAg of 4 or less).

The addition amount of the reduction sensitization agent may vary depending on various conditions and it is, generally, from $10^{-7}$ mol to $10^{-1}$ mol and, more preferably, $10^{-6}$ mol to $5\times10^{-2}$ mol per one mol of silver halide.

The reduction sensitization in the first aspect is preferably applied in the presence of a halide ion other than an iodide ion, for example, a bromide ion or a chloride ion, particularly, a bromide ion. Further, it is preferably applied in the presence of a different species of ion other than the halide ion, specifically, a chalcogen ion (a sulfide ion, a selenide ion or a telluride ion), a pseudo halide ion (a thiocyanate ion, a selenocyanate ion, a tellurocyanate ion, a cyanide ion) or a transition metal ion (in group 3 to 12 in the Periodical Table). The chalcogen ion (a sulfide ion, a selenide ion, and a telluride ion) is an ion of a compound used for chalcogen sensitization to be described later, and the transition metal ion is the ion of metal belonging to group 3 to group 12, particularly, group 6 to group 12 in the Periodical Table, including, for example, Cr, Mo, Re, Fe, Ru, Os, Co, Rh, Ir, Ni, Pd, Pt, Cu, Zn, Au, Cd and Hg. Further, the reduction sensitization in the invention is applied preferably at pAg of 7.5 or less, more preferably 6.5 or less and still more preferably 1.5 to 6.0.

The addition amount of bromide ion, chloride ion or pseudo ion can be selected optionally and it is 40 mol % or less, preferably 20 mol % or less, and particularly preferably 10 mol % or less. It preferably forms, as silver bromide, silver chloride or pseudo halogen silver salt, a mixed crystal with silver iodide.

The addition amount of the chalcogen ion or transition metal ion may also be selected optionally and it is from $10^{-7}$ to $10^{-1}$ mol, and preferably $10^{-6}$ to $10^{-2}$ mol per one mol of the silver halide.

Further, in the invention, a compound such as a thiosulfonate compound, a disulfide compound or an organic or inorganic halogen compound capable of oxidizing silver nuclei can be preferably used in order to control the formation of the reduction sensitization center.

3) Chemical Sensitization

The photosensitive silver halide used in the first aspect of the invention is preferably sensitized chemically by at least one of a chalcogen sensitizing method and a gold sensitizing method as well as the reduction sensitization described above. Further, the photosensitive silver halide used in the second aspect of the invention is subjected to at least one of the chalcogen sensitizing method and gold sensitizing method.

The chalcogen sensitization method includes a sulfur sensitization method, a selenium sensitization method, and a tellurium sensitization method.

In the sulfur sensitization, instable sulfur compounds, specifically those described, for example, in Chemie et Physique Photographique, written by P. Grafkides (published from Paul Montel Co. in 1987, 5th edition), and Journal of Research Disclosure, vol. 307, No. 307105, can be used.

Specifically, known sulfur compounds such as thiosulfates (for example, hypo), thioureas (for example, diphenyl thiourea, triethyl thiourea, N-ethyl-N'-(4-methyl-2-thiazolyl) thiourea, carboxymethyl trimethyl thiourea), thioamides (for example, thioacetoamide), rhodanines (for example, diethyl rhodanine and 5-benzylidene-N-ethylrhodanine), phosphine sulfides (for example, trimethyl phosphine sulfide), thiohydantoins, 4-oxo-oxazolyzine-2-thiones, disulfides or polysulfides (for example, dimorpholine disulfide, cystine, or lenthionine, polythionates and elemental sulfur, and active gelatin can also be used. Particularly, thiosulfates, thioureas and rhodanines are preferred.

In the selenium sensitization, instable selenium compounds, especially those described, for example, in JP-B Nos. 43-13489, and 44-15748, JP-A Nos. 4-25832, 4-109340, 4-271341, 5-40324, 5-11385, Japanese Patent Application Nos. 4-202415, 4-330495, 4-333030, 5-4203, 5-4204, 5-106977, 5-236538, 5-241642, and 5-286916, can be used.

Specifically, colloidal metallic selenium, selenoureas (for example, N,N-dimethylselenourea, trifluoromethylcarbonyl-trimethylselenourea and acetyltrimethylselenourea), selonoamides (for example, selenoamide, N,N-diethylphenylselenoamide), phosphine selenides (for example, triphenylphosphine selenide, pentafluorophenyl triphenylphospnine selenide), selenophosphates (for example, tri-p-tolylselenophosphate, and tri-n-butylselenophosphate), selenoketones (for example, seleno benzophenone), isoselenocyanates, selenocarboxylic acids, selenoesters and diacylselenides may be used. Further, stable selenium compounds as described, for example, in JP-B Nos. 46-4553 and 52-34492, such as selenious acid, selenocyanate, selenazoles and selenides can also be used. In particular, phosphine selenides, selenoureas and selenocyanates are preferred.

In the tellurium sensitization, instable tellurium compounds, especially those described, for example, in JP-A Nos. 4-224595, 4-271341, 4-333043, 5-303157, 6-27573, 6-175258, 6-180478, 6-208186, 6-208184, 6-317867, 7-140579, 7-301879 and 7-301880, may also be used.

Specifically, phosphine tellurides, for example, butyldiisopropylphosphine telluride, tributylphosphine telluride, tributoxyphosphine telluride, ethoxy-diphenylphosphine telluride), diacyl(di)tellurides (for example, bis(diphenylcarbamoyl)ditelluride, bis(N-phenyl-N-methylcarbamoyl)ditelluride, bis(N-phenyl-N-methylcarbamoyl)telluride, bis(N-phenyl-N-benzylcarbamoyl)telluride, bis(ethoxycarbonyl)telluride, telluroureas (for example, N,N'-dimethylethylene tellulourea, N,N'-diphenylethylene tellurourea), telluroamides, and telluroesters may be used. Particularly, diacyl(di)tellurides and phosphine tellurides are preferred and, particularly, compounds described in the literature cited in JP-A No. 11-65021, paragraph 0030 and compounds shown by the general formulae (II), (III), and (IV) in JP-A No. 5-313284 are more preferred.

Particularly, selenium sensitization and tellurium sensitization are preferred as the chalcogen sensitization in the invention, and tellurium sensitization is particularly preferred. Further, a combination of the two or more of them may be used.

In the gold sensitization, gold sensitizers described in Chemie et Physique Photographique, written by P. Grafkides (published from Paul Montel Co. in 1987, 5th edition), and Journal of Research Disclosure, vol. 307, No. 307105 can be used. Specifically, they are chloroauric acid, potassium chloroaurate, potassium aurithiocyanate, gold sulfide and gold selenide and, in addition, gold compounds described, for example, in U.S. Pat. Nos. 2,642,361, 5,049,484, 5,049,485, 5,169,751, 5,252,455, and Belgium Patent No. 691857 can also be used. Further, salts of noble metal other than gold such as platinum, palladium and iridium described in Chemie et Physique Photographique, written by P. Grafkides (published from Paul Momtel Co. in 1987, 5th edition), and Journal of Research Disclosure, vol. 307, No. 307105 can also be used.

While gold sensitization may be used alone, it is used preferably in combination with the chalcogen sensitization. Specifically, gold/sulfur sensitization, gold/selenium sensitization, gold/tellurium sensitization, gold/sulfur/selenium sensitization, gold/sulfur/tellurium sensitization, gold/selenium/tellurium sensitization, and gold/sulfur/selenium/tellurium sensitization can be used.

In the first aspect of the invention, chalcogen or gold/chalcogen sensitization can be conducted at any timing after forming particles and before coating, and it can be conducted after desalting and (1) before spectral sensitization, (2) simultaneously with spectral sensitization, (3) after spectral sensitization, or (4) just before coating. It is also preferred to apply chalcogen sensitization or gold/chalcogen sensitization at the same time with the reduction sensitization during formation of particles.

In the second aspect of the invention, chalcogen sensitization or gold sensitization is applied to the insides of silver halide particles. In the invention, in order to apply chalcogen sensitization or gold sensitization to the insides of particles, the step of adding the sensitizer may be conducted before completion of the particle formation. It may be added at any timing before completing particle formation. Such sensitizer may also be added before starting the particle formation. Further, after the completion of the formation of silver halide particles, chalcogen sensitizer or gold sensitizer may be applied additionally.

The amount of the chalcogen sensitizer used in the invention varies depending on silver halide particles used and the chemical aging conditions, and it is about $10^{-8}$ to $10^{-1}$ mol and preferably $10^{-7}$ to $10^{-2}$ mol per one mol of the silver halide.

In the same manner, the addition amount of the gold sensitizer used in the invention is different depending on various conditions and it is generally $10^{-7}$ to $10^{-2}$ mol, and preferably $10^{-6}$ to $5\times10^{-3}$ mol per mol of the silver halide. Any circumstantial condition may be selected for chemical sensitization of the emulsion. In the first aspect, the upper limit of pAg is 8 or less, preferably 7.0 or less, more preferably 6.5 or less, and particularly preferably 6.0 or less. The lower limit of pAg is 1.5 or more, preferably 2.0 or more and particularly preferably 2.5 or more. pH is 3 to 10, and preferably 4 to 9. The temperature is about 20 to 95° C., and preferably 25 to 80° C. Further, in the second aspect, the conditions may be those for particle formation, that is, pAg (for example, 2.5 to 12), pH (for example 2 to 11) and temperature (for example, 15 to 95° C.)

Also, the chalcogen sensitization or gold sensitization can be applied in the presence of a transition metal ion. The transition metal ion can include those described above.

4) Grain Size

The particle size is particularly important for the silver halide with a high silver iodide content. When the size of the silver halide grain is larger, the coating amount of silver halide necessary for attaining a required maximum density increases. In the silver halide having a composition with a high silver iodide content and used preferably in the invention, the present inventor has found the following. When the coating amount is large, development is suppressed remarkably, lowering sensitivity and degrading the stability of density to the developing time. Accordingly, the maximum density cannot be obtained within a predetermined developing time if the grain size is larger than a predetermined level. On the other hand, sufficient developability is provided for the silver iodide by restricting the addition amount thereof.

As described above, in the case of using silver halide with a high silver iodide content, it is necessary that the size of silver halide particles is sufficiently small for attaining a sufficient maximum optical density, in comparison with silver bromide or silver iodobromide with a low iodine content. The average grain size of the photosensitive silver halide in the invention is 0.005 μm to 0.5 μm, preferably 0.005 μm to 0.1 μm, and more preferably 0.005 μm to 0.05 μm. The fluctuation coefficient of the average grain size is 30% or less, preferably 25% or less and more preferably 20% or less.

A preferred grain size of the silver halide when used in the heat-developable photosensitive material is 5 nm to 70 nm, preferably 5 nm to 55 nm, and more preferably 10 nm to 45 nm. The grain size referred to herein means an average diameter of circular images having the same areas as the projected areas of particles obtained with an electron microscope.

Further, in the invention, tabular silver halide particles having a high silver iodide content and an aspect ratio of 2 or more can be used. In this case, the grain size, more specifically a sphere-equivalent diameter (diameter of sphere having the same volume as that of particle) can be 0.1 μm to 5.0 μm.

5) Coating Amount

The coating amount of the silver halide particles, based on one mol of silver of a non-photosensitive organic silver salt, is 0.5 mol % to 15 mol %, preferably 0.5 mol % to 12 mol %, more preferably 10 mol % or less, still more preferably 1 mol % to 9 mol %, and particularly preferably 1 mol % to 7 mol %. Selection of the addition amount is extremely important for preventing remarkable development interruption caused by the silver halide having a composition with a high silver iodide content and found by the present inventor.

6) Method of Forming Silver Halide Particles

Methods of forming the photosensitive silver halides are well known in the art, and, for example, methods in Research Disclosure 17029 (June 1978), and U.S. Pat. No. 3,700,458 are employable in the invention. Concretely, a silver source compound and a halogen source compound are added to gelatin or any other polymer solution to prepare a photosensitive silver halide, and the photosensitive silver halide is then mixed with an organic silver salt. This method is preferred for the invention. The method described in JP-A No. 11-119374, paragraphs [0217] to [0244]; and the methods described in JP-A Nos. 11-352627 and Japanese Patent Application No. 2000-42336 are also preferred.

7) Particle Shape

The shape of the silver halide particles usable in the invention can be, for example, cubic particle, octahedron, dodecahedron, tetradecahedron, a tabular particle, sphere, a rod-like particle or a potato-like particle. In the invention, dodecahedron and tetradecahedron are particularly preferred. The dodecahedral particle means herein a particle having (001), {1-(−1)0}, and {101} faces, and the tetradecahedral particle is a particle having (001), {100}, {101} faces. {100} represents a group of crystal faces having a face index equivalent to that of (100) face.

Silver iodide of the invention can have arbitrary β-phase and γ-phase contents. The β-phase means a high silver iodide structure having a hexagonal system wurtzite structure and the γ-phase means a high silver iodide structure having a cubic system zinc blend structure.

The average γ phase proportion is decided by using a method proposed by C. R. Berry. According to the method, the proportion is decided based on the peak ratio of silver iodide β-phases (100), (101), and (002), and γ-phase (111) by powder X-ray diffractiometry. Details can be referred, for example, to Physical Review, vol. 161, No. 3, pp 848–851, 1967.

The method described in JP-A Nos. 59-119350 and 59-119344 are preferably used as the method of forming tabular particles of silver iodide. Dodecahedron, tetradecahedron and octahedron can be prepared with reference to Japanese Patent Applications Nos. 2002-081020, 2002-87955 and 2002-91756.

Silver halide having a composition with a high silver iodide content in the invention can take complicate shapes and the preferred form can be, for example, joined particles as shown in the Journal of Phot. Sci. Vol. 28 (1980), p 164, FIG. 1 by R. L. Jenkins, et al. Tabular particles shown in FIG. 1 are also preferably used. Silver halide particles having rounded corners can also be preferably used. There is no particular restriction on the surface index (mirror index) of the outer surface of the photosensitive silver halide particles and it is preferred that the percentage of [100] face of high spectral sensitization efficiency in the case of adsorbing a spectral sensitizing dye is high. The percentage is preferably 50% or more, more preferably 65% or more and still more preferably 80% or more. The percentage of the mirror index [100] face can be determined by the method utilizing the adsorption dependence of [111] face and [100] face in the adsorption of the sensitizing dye, described in J. Imaging Sci., 29, 165 (1985) by T. Tani.

The photosensitive silver halide photographic emulsion of the invention may have a dislocation line or lattice defects.

8) Heavy Metal

The photosensitive silver halide grains for use in the invention may contain a metal or a metal complex of Groups 8 to 10 of the Periodic Table (including Groups 1 to 18). The metal, or the center metal of the metal complex, which belongs to Groups 8 to 10, is preferably rhodium, ruthenium or iridium. In the invention, one metal complex may be used alone, or two or more metal complexes of the same type of metal or different types of metals may also be used herein in combination. The metal or metal complex content of the grains preferably is $1\times10^{-9}$ mols to $1\times10^{-3}$ mols per mol of silver. Such heavy metals and metal complexes, and methods of adding them to silver halide grains are described in, for example, JP-A No. 7-225449; JP-A No. 11-65021, paragraphs [0018] to [0024]; and JP-A No. 11-119374, paragraphs [0227] to [0240].

Silver halide grains having a hexacyano-metal complex in their outermost surfaces are preferred for use in the invention. The hexacyano-metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. The hexacyano-Fe complexes are preferred for the grains for use in the invention.

As hexacyano-metal complexes exist in the form of ions in their aqueous solutions, their counter cations are of no importance. Preferably, however, the counter cations for the complexes are any of alkali metal ions such as sodium, potassium, rubidium, cesium and lithium ions; ammonium ions, and alkylammonium ions (e.g., tetramethylammonium, tetraethylammonium, tetrapropylammonium and tetra(n-butyl)ammonium ions), as they are well miscible with water and are favorable to the operation of precipitating silver halide emulsions.

The hexacyano-metal complex may be added to silver halide grains in the form of a solution thereof including water or a mixed solvent of water and an organic solvent miscible with water (for example, alcohols, ethers, glycols, ketones, esters, amides), or in the form of a mixture thereof with gelatin.

The amount of the hexacyano-metal complex to be added to the silver halide grains preferably is $1\times10^{-5}$ mols to $1\times10^{-2}$ mols per mol of silver of the grains and more preferably $1\times10^{-4}$ mols to $1\times10^{-3}$ mols.

In order to make the hexacyano-metal complex exist in the outermost surface of the silver halide grains, the complex is directly added to a reaction system after an aqueous silver nitrate solution for forming the silver halide grains is added to the reaction system but before the grains formed are subjected to chemical sensitization such as chalcogen sensitization with sulfur, selenium or tellurium or noble metal sensitization with gold or the like. More specifically, it is directly added to the system before completion of addition of raw materials, during a rinsing step, during a dispersing step, or before the chemical sensitization step. To prevent the silver halide grains formed from growing too much, it is preferable that the hexacyano-metal complex is added to the system immediately after grains are formed. Preferably, the complex is added thereto before completion of addition of raw materials.

Adding the hexacyano-metal complex to the system may be started after 96% by mass, preferably 98% by mass, and more preferably 99% by mass of the total of silver nitrate for forming the grains has been added to the reaction system.

The hexacyano-metal complex added to the system after an aqueous solution of silver nitrate to be added to the system just before completion of grain formation has been added to the reaction system is well adsorbed by the grains formed, and may well exist in the outermost surfaces of the grains. Most of the complex added in that manner forms a hardly-soluble salt with the silver ions existing in the surfaces of the grains. The silver salt of hexacyano-iron(II) is more hardly soluble than AgI, and the fine grains formed are prevented from re-dissolving. Accordingly, the intended fine silver halide grains having a small grain size can be formed.

The metal atoms (e.g., in $[Fe(CN)_6]^{4-}$) that may be contained in the silver halide grains for use in the invention, as well as the methods of desalting or chemical sensitization of the silver halide emulsions are described, for example, in JP-A No. 11-84574, paragraphs [0046] to [0050], JP-A No. 11-65021, paragraphs [0025] to [0031], and JP-A No. 11-119374, paragraphs [0242] to [0250].

9) Sensitizing Dye

Sensitizing dyes usable in the invention are those which, after adsorbed by silver halide grains, can spectrally sensitize the grains within a desired wavelength range. Depending on the spectral characteristics of the light source to be used for exposure, favorable sensitizing dyes having good spectral sensitivity are selected for use in the heat-developable photosensitive material of the invention. It is preferable that the heat-developable photosensitive material of the invention is spectrally sensitized in order to have a spectral sensitivity peak in a wavelength range of 600 to 900 nm or 300 to 500 nm. As for the details of sensitizing dyes usable herein and methods for adding them to the heat-developable photosensitive material of the invention, paragraphs [0103] to [0109] in JP-A No. 11-65021; compounds of formula (II) in JP-A No. 10-186572; dyes of formula (I) and paragraph [0106] in JP-A No. 11-119374; dyes described in U.S. Pat. Nos. 5,510,236, and 3,871,887 (Example 5); dyes described in JP-A Nos. 2-96131 and 59-48753; from page 19, line 38 to page 20, line 35 of EP-A No. 0803764A1; Japanese Patent Application Nos. 2000-86865, 2000-102560 and 2000-205399 are referred to. Specifically, the sensitizing dye can be a cyanine dye and a melocyanine dye. One or more such sensitizing dyes may be used herein either alone or in combination.

The amount of the sensitizing dye to be contained in the heat-developable photosensitive material of the invention depends on the sensitivity and the fogging preventive property of the material. In general, it is preferably $10^{-6}$ to 1 mol, and more preferably $10^{-4}$ to $10^{-1}$ mols, per mol of the silver halide in the photosensitive layer of the material.

In order to improve spectral sensitization efficiency, the heat-developable photosensitive material of the invention may contain a supersensitizer. Examples of the supersensitizer include compounds described in EP-A No. 587,338, U.S. Pat. Nos. 3,877,943 and 4,873,184, and JP-A Nos. 5-341432, 11-109547 and 10-111543.

10) Gelatin

Any gelatin may be used in preparing the photosensitive silver halide emulsions for use in the invention. For better dispersion of the photosensitive silver halide emulsion in an organic silver salt-containing coating liquid in producing the heat-developable photosensitive material of the invention, gelatin having a low molecular weight of from 500 to 60,000 is preferable. Such gelatin having a low molecular weight may be used in forming the silver halide grains or in dispersing the grains after the grains have been desalted. Preferably, it is used in dispersing the grains after the grains have been desalted.

2. Heat-Developable Photosensitive Material

The heat-developable photosensitive material of the invention has an image forming layer containing a photosensitive silver halide, a non-photosensitive organic silver salt, a reducing agent and a binder at least one surface of a support. The image forming layer may be a single layer or may include a plurality of layers. Further, the heat-developable photosensitive material may have an intermediate layer or a surface-protective layer on or over the image forming layer, or may have a back layer or a back protective layer on or over the surface of the support opposite to the image forming layer.

The configuration and preferred ingredients of each layer are described specifically.

Photosensitive Silver Halide

As the photosensitive silver halide in the invention, the silver halide emulsion described above is used.

In the invention, the silver halide emulsion preferably contains at least one of a compound generating two electrons with one photon and a compound having an adsorptive group and a reducing group.

1) Compound that Releases Two Electron with One Photon

Preferably, the heat-developable photosensitive material of the invention contains, as the compound generating two electrons with one photon, a compound whose one-electron oxidant formed through one-electron oxidation can release one or more electrons. The compound may be used alone or in combination with any other various chemical sensitizer such as those mentioned above, and it increases the sensitivity of silver halides.

The compound whose one-electron oxidant formed through one-electron oxidation can release one or more electrons and which may be contained in the heat-developable photosensitive material of the invention may be selected from those of the following type 1 to type 5.

Type 1

Compound whose one-electron oxidant formed through one-electron oxidation may release further 2 or more electrons through a subsequent bond cleavage reaction.

Type 2

Compound whose one-electron oxidant formed through one-electron oxidation may release still another electron through a subsequent bond cleavage reaction and which has in the same molecule at least two groups which the silver halide can adsorb.

Type 3

Compound whose one-electron oxidant formed through one-electron oxidation may release further one or more electrons after subsequent bond formation.

Type 4

Compound whose one-electron oxidant formed through one-electron oxidation may release further one or more electrons after a subsequent intramolecular ring cleavage reaction.

Type 5

Compound of X—Y in which X indicates a reducing group and Y indicates a leaving group. Its one-electron oxidant formed through one-electron oxidation at the reducing group of X thereof forms a radical X after releasing Y through a subsequent X—Y bond cleavage reaction, and releases still another electron from it.

Among the compounds of type 1 and types 3 to 5 mentioned above, "compounds having in the molecule a group which the silver halide can adsorb" or "compounds having a partial structure of spectral sensitizer in the molecule" are preferable. "Compounds having in the molecule a group which the silver halide can adsorb" is more preferable. Among the compounds of types 1 to 4, "compounds having, as the adsorptive group, a nitrogen-containing heterocyclic group substituted with at least 2 mercapto groups" are more preferable.

Compounds of types 1 to 5 are described in more detail.

In the explanations of the compounds of type 1, the "bond cleavage reaction" concretely means carbon-carbon, carbon-silicon, carbon-hydrogen, carbon-boron, carbon-tin or carbon-germanium bond cleavage, which may be accompanied by additional carbon-hydrogen bond cleavage. The compound of type 1 undergoes bond cleavage to release further 2 or more electrons (preferably 3 or more electrons)

only after it forms a one-electron oxidant through one-electron oxidation.

Preferred compounds of type 1 are represented by the following formula (A), (B), (1), (2) or (3):

Formula (A)

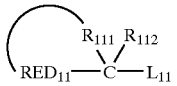

Formula (B)

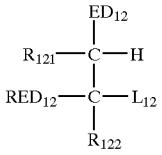

In formula (A), $RED_{11}$ represents a reducing group capable of undergoing one-electron oxidation, and $L_{11}$ represents a leaving group. $R_{112}$ represents a hydrogen atom or a substituent. $R_{111}$ represents a non-metallic atomic group capable of forming, along with the carbon atom (C) and $RED_{11}$, a cyclic structure that corresponds to a tetrahydro, hexahydro or octahydro form of a 5-membered or 6-membered aromatic ring (including aromatic heterocyclic ring).

In formula (B), $RED_{12}$ represents a reducing group capable of undergoing one-electron oxidation, and $L_{12}$ represents a leaving group. $R_{121}$ and $R_{122}$ each represent a hydrogen atom or a substituent. $ED_{12}$ represents an electron-donating group. In formula (B), $R_{121}$ and $RED_{12}$, $R_{121}$ and $R_{122}$, or $ED_{12}$ and $RED_{12}$ may bond to each other to form a cyclic structure.

After one-electron oxidation at the reducing group of $RED_{11}$ or $RED_{12}$ therein, the compound of formula (A) or (B) undergoes a bond cleavage reaction to spontaneously release $L_{11}$ or $L_{12}$. With that, the compound further releases at least 2, preferably at least 3 electrons.

Formula (1)

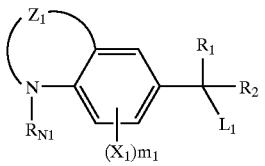

Formula (2)

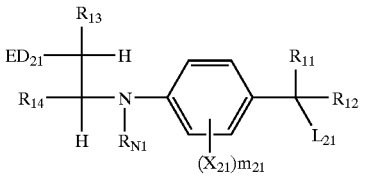

Formula (3)

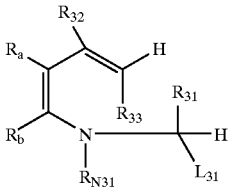

In formula (1), $Z_1$ represents an atomic group capable of forming a 6-membered ring along with the nitrogen atom and two carbon atoms of the benzene ring; $R_1$, $R_2$ and $R_{N1}$ each represent a hydrogen atom or a substituent; $X_1$ represents a substituent which can bond to the benzene ring; $m_1$ indicates an integer of from 0 to 3; and $L_1$ represents a leaving group. In formula (2), $ED_{21}$ represents an electron-donating group; $R_{11}$, $R_{12}$, $R_{N21}$, $R_{13}$ and $R_{14}$ each represent a hydrogen atom or a substituent; $X_{21}$ represents a substituent which can bond to the benzene ring; $m_{21}$ indicates an integer of from 0 to 3; and $L_{21}$ represents a leaving group. $R_{N21}$, $R_{13}$, $R_{14}$, $X_{21}$ and $ED_{21}$ may bond to each other to form a cyclic structure. In formula (3), $R_{32}$, $R_{33}$, $R_{N31}$, $R_a$ and $R_b$ each represent a hydrogen atom or a substituent; and $L_{31}$ represents a leaving group. However, when $R_{N31}$ is a group except an aryl group, $R_a$ and $R_b$ bond to each other to form an aromatic ring.

After undergoing one-electron oxidation, these compounds spontaneously release $L_1$, $L_{21}$ or $L_{31}$ through a bond cleavage reaction therein, and therefore further release at least 2, preferably at least 3 electrons.

The compounds of formula (A) are described in detail.

In formula (A), the reducing group $RED_{11}$ capable of undergoing one-electron oxidation is a group bonding to $R_{111}$ to form a specific ring. $R_{111}$ will be described hereinunder. Concretely, the reducing group may be a divalent group that is derived from any of the following monovalent groups by removing one hydrogen atom at a suitable position to form a cyclic structure. For example, the monovalent group includes an alkylamino group, an arylamino group (e.g., anilino, naphthylamino), a heterocyclic amino group (e.g., benzthiazolylamino, pyrrolylamino), an alkylthio group, an arylthio group (e.g., phenylthio), a heterocyclic-thio group, an alkoxy group, an aryloxy group (e.g., phenoxy), a heterocyclic-oxy group, an aryl group (e.g., phenyl, naphthyl, anthranyl), and an aromatic or non-aromatic heterocyclic group (5-membered to 7-membered, monocyclic or condensed-cyclic heterocyclic ring that contains at least one hetero atom of nitrogen, sulfur, oxygen and selenium atoms, and its specific examples are tetrahydroquinoline ring, tetrahydroisoquinoline ring, tetrahydroquinoxaline ring, tetrahydroquinazoline ring, indoline ring, indole ring, indazole ring, carbazole ring, phenoxazine ring, phenothiazine ring, benzothiazoline ring, pyrrole ring, imidazole ring, thiazoline ring, piperidine ring, pyrrolidine ring, morpholine ring, benzimidazole ring, benzimidazoline ring, benzoxazoline ring, methylenedioxyphenyl ring. For convenience' sake, $RED_{11}$ is hereinunder described by the name of the monovalent group that corresponds to it. $RED_{11}$, may be substituted.

Unless otherwise specifically indicated, the substituent referred to herein is selected from the groups mentioned below. They are a halogen atom, an alkyl group (including aralkyl group, cycloalkyl group, active methine group), an alkenyl group, an alkynyl group, an aryl group, a heterocyclic group (not specifically indicated in point of its substituting position), a quaternary nitrogen atom-containing heterocyclic group (e.g., pyridinio, imidazolio, quinolinio, isoquinolinio), an acyl group, an alkoxycarbonyl group, an aryloxycarbonyl group, a carbamoyl group, a carboxyl group and its salts, a sulfonylcarbamoyl group, an acylcarbamoyl group, a sulfamoylcarbamoyl group, a carbazoyl group, an oxalyl group, an oxamoyl group, a cyano group, a carbonimidoyl group, a thiocarbamoyl group, a hydroxyl group, an alkoxy group (including those that contain repetitive ethyleneoxy or propylene oxy units), an aryloxy group, a heterocyclicoxy group, an acyloxy group, an (alkoxy or aryloxy) cabonyloxy group, a carbamoyloxy group, a sulfonyloxy group, an amino group, an (alkyl, aryl or heterocyclic)amino group, an acylamino group, a sulfonamido group, an ureido group, a thioureido group, an imido group, an (alkoxy or aryloxy)carbonylamino group, a sulfamoylamino group, a semicarbazido group, a thiosemicarbazido group, a hydrazino group, an ammonio group, an oxamoylamino group, an (alkyl or aryl) sulfonylureido group, an acylureido group, an acylsulfamoylamino group, a nitro group, a mercapto group, an (alkyl, aryl or heterocyclic)thio group, an (alkyl or aryl)sulfonyl group, an (alkyl or aryl)sulfinyl group, a sulfo group and its salts, a sulfamoyl group, an acylsulfamoyl group, a sulfonylsulfamoyl group and its salts, and a phosphoramido or phosphate structure-containing group. These substituents may be further substituted.

$RED_{11}$, is preferably an alkylamino group, an arylamino group, a heterocyclic amino group, an aryl group, or an aromatic or non-aromatic heterocyclic group, and more preferably an arylamino group (especially anilino group) or an aryl group (especially phenyl group). When these groups are substituted, their substituents are preferably any of a halogen atom, an alkyl group, an alkoxy group, a carbamoyl group, a sulfamoyl group, an acylamino group, and a sulfonamido group.

When $RED_{11}$ is an aryl group, the aryl group preferably has at least one "electron-donating group". The "electron-donating group" as referred to herein includes a hydroxyl group, an alkoxy group, a mercapto group, a sulfonamido group, an acylamino group, an alkylamino group, an arylamino group, a heterocyclic amino group, an active methine group, a 5-membered, monocyclic or condensed cyclic, electron-rich aromatic heterocyclic group having at least one nitrogen atom in its ring (e.g., indolyl, pyrrolyl, imidazolyl, benzimidazolyl, thiazolyl, benzthiazolyl, or indazolyl), and a non-aromatic nitrogen-containing heterocyclic group that bonds to the aryl group via its nitrogen atom (that is referred to as a cyclic amino group such as pyrrolidinyl, indolinyl, piperidinyl, piperazinyl, or morpholino). The active methine group also as referred to herein means a methine group substituted with two "electron attractive groups", and the "electron attractive group" includes an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group, an a carbonimidoyl group. The two electron attractive groups may bond to each other to form a cyclic structure.

In formula (A), $L_{11}$ is concretely a carboxyl group or its salt, a silyl group, a hydrogen atom, a triarylborate anion, trialkylstannyl group, a trialkylgermyl group, or $—CR_{C1}R_{C2}R_{C3}$. The silyl group is concretely a trialkylsilyl group, an aryldialkylsilyl group or a triarylsilyl group, which may have any desired substituent.

When $L_{11}$ is a salt of carboxyl group, the counter ion of the salt includes an alkali metal ion, an alkaline earth metal ion, a heavy metal ion, an ammonium ion, and a phosphonium ion, and is preferably an alkali metal ion or an ammonium ion, and most preferably an alkali metal ion (especially $Li^+$, $Na^+$, $K^+$).

When $L_{11}$ is $—CR_{C1}R_{C2}R_{C3}$, $R_{C1}$, $R_{C2}$ and $R_{C3}$ each independently represent a hydrogen atom, an alkyl group, an aryl group, a heterocyclic group, an alkylthio group, an arylthio group, an alkylamino group, an arylamino group, a heterocyclic amino group, an alkoxy group, an aryloxy group, or a hydroxyl group. They may bond to each other to form a cyclic structure, and may have any desired substituent. However, when one of $R_{C1}$, $R_{C2}$ and $R_{C3}$ is a hydrogen atom or an alkyl group, the remaining two of them are neither hydrogen atoms nor alkyl groups. Preferably, $R_{C1}$, $R_{C2}$ and $R_{C3}$ each independently represent an alkyl group, an aryl group (especially phenyl group), an alkylthio group, an arylthio group, an alkylamino group, an arylamino group, a heterocyclic group, an alkoxy group, or a hydroxyl group. Their concrete examples are a phenyl group, a p-dimethylaminophenyl group, a p-methoxyphenyl group, a 2,4-dimethoxyphenyl group, a p-hydroxyphenyl group, a methylthio group, a phenylthio group, a phenoxy group, a methoxy group, an ethoxy group, a dimethylamino group, an N-methylanilino group, a diphenylamino group, a morpholino group, a thiomorpholino group, and a hydroxyl group. Examples of the groups that bond to each other to form a cyclic structure are a 1,3-dithiolan-2-yl group, a 1,3-dithian-2-yl group, an N-methyl-1,3-thiazolidin-2-yl group, and an N-benzyl-benzothiazolidin-2-yl group.

Also preferably, the group $—CR_{C1}R_{C2}R_{C3}$ in which $R_{C1}$, $R_{C2}$ and $R_{C3}$ are within the preferred range mentioned above may be the same as the residue that is derived from formula (A) by removing $L_{11}$ from it.

In formula (A), $L_{11}$ is preferably a carboxyl group or its salt, or a hydrogen atom, and more preferably a carboxyl group or its salt.

When $L_{11}$ is a hydrogen atom, the compound of formula (A) preferably has an inner base moiety. Owing to the action of the inner base moiety therein, the compound of formula (A) is, after oxidized, deprotonated at the hydrogen atom of $L_{11}$ to release an additional electron.

The base is concretely a conjugated base of an acid having a pKa of from about 1 to about 10. For example, it includes nitrogen-containing heterocyclic compounds (e.g., pyridines, imidazoles, benzimidazoles, and thiazoles), anilines, trialkylamines, amino groups, carbon acids (e.g., active methylene anion), thioacetate anion, carboxylate ($—COO^-$), sulfate ($—SO_3^-$), and amine oxide ($>N^+(O^-)—$). Preferably, it is a conjugated base of an acid having a pKa of from about 1 to about 8, more preferably a carboxylate, a sulfate, or an amine oxide, and even more preferably a carboxylate. When the base has an anion, it may have a counter cation. Examples of the counter cation are alkali metal ions, alkaline earth metal ions, heavy metal ions, ammonium ions, and phosphonium ions. The base may bond to the compound of formula (A) at any desired position. The base moiety bonding site may be any of $RED_{11}$, $R_{111}$ and $R_{112}$ of formula (A), or the moiety may bond to the substituent of these group.

In formula (A), $R_{112}$ represents a hydrogen atom or a substituent which can bond to the carbon atom. However, $R_{112}$ must not be the same as $L_{11}$.

$R_{112}$ is preferably a hydrogen atom, an alkyl group, an aryl group (e.g., phenyl group), an alkoxy group (e.g., methoxy group, ethoxy group, or benzyloxy group), a hydroxyl group, an alkylthio group (e.g., methylthio group, or butylthio group), an amino group, an alkylamino group, an arylamino group, or a heterocyclic amino group, and more preferably a hydrogen atom, an alkyl group, an alkoxy group, a hydroxyl group, a phenyl group, or an alkylamino group.

In formula (A), the cyclic structure which $R_{111}$ forms is a cyclic structure that corresponds to a tetrahydro form, a hexahydro form or an octahydro form of a 5-membered or 6-membered aromatic ring (including aromatic heterocyclic ring). The "hydro form" as referred to herein means a partly-hydrogenated cyclic structure of an aromatic ring (including aromatic heterocyclic ring) in which the carbon-carbon double bond (or carbon-nitrogen double bond) inside it is partly hydrogenated. Two, three or four carbon-carbon double bonds (or carbon-nitrogen double bonds) are hydrogenated to give the corresponding tetrahydro, hexahydro or octahydro form, respectively. The hydrogenated aromatic ring has a partly-hydrogenated non-aromatic cyclic structure.

Concretely, it includes pyrrolidine ring, imidazolidine ring, thiazolidine ring, pyrazolidine ring, oxazolidine ring, piperidine ring, tetrahydropyridine ring, tetrahydropyrimidine ring, piperazine ring, tetralin ring, tetrahydroquinoline ring, tetrahydroisoquinoline ring, tetrahydroquinazoline ring, tetrahydroquinoxaline ring, tetrahydrocarbazole ring, and octahydrophenanthridine ring. These cyclic structure may have any desired substituent.

The cyclic structure which $R_{111}$ forms is more preferably pyrrolidine ring, imidazolidine ring, piperidine ring, tetrahydropyridine ring, tetrahydropyrimidine ring, piperazine ring, tetrahydroquinoline ring, tetrahydroisoquinoline ring, tetrahydroquinazoline ring, tetrahydroquinoxaline ring, or tetrahydrocarbazole ring, even more preferably pyrrolidine ring, piperidine ring, piperazine ring, tetrahydropyridine ring, tetrahydroquinoline ring, tetrahydroisoquinoline ring, tetrahydroquinazoline ring, or tetrahydroquinoxaline ring, and most preferably pyrrolidine ring, piperidine ring, tetrahydropyridine ring, tetrahydroquinoline ring, or tetrahydroisoquinoline ring.

In formula (B), $RED_{12}$ and $L_{12}$ have the same meanings as $RED_{11}$ and $L_{11}$ in formula (A), respectively, and their preferred ranges may also be the same as those of the latter. However, $RED_{12}$ is a monovalent group except that it forms the cyclic structure mentioned below, concretely including the monovalent groups mentioned hereinabove for $RED_{11}$. $R_{121}$ and $R_{122}$ have the same meanings as $R_{112}$ in formula (A), and their preferred ranges may also be the same as those of the latter. $ED_{12}$ represents an electron-donating group. $R_{121}$ and $RED_{12}$, $R_{121}$ and $R_{122}$, or $ED_{12}$ and $RED_{12}$ may bond to each other to form a cyclic structure.

In formula (B), the electron-donating group represented by $ED_{12}$ may be the same as that mentioned hereinabove for the substituent of the aryl group represented by $RED_{11}$. $ED_{12}$ is preferably a hydroxyl group, an alkoxy group, a mercapto group, a sulfonamido group, an alkylamino group, an arylamino group, an active methine group, a 5-membered, monocyclic or condensed cyclic, electron-rich aromatic heterocyclic group having at least one nitrogen atom in its ring, a non-aromatic nitrogen-containing heterocyclic group that bonds to the compound via its nitrogen atom, or a phenyl group substituted with such an electron-donating group, and more preferably a hydroxyl group, a mercapto group, a sulfonamido group, an alkylamino group, an arylamino group, an active methine group, a non-aromatic nitrogen-containing heterocyclic group that bonds to the compound via its nitrogen atom, or a phenyl group substituted with such an electron-donating group (e.g., p-hydroxyphenyl, p-dialkylaminophenyl, or o,p-dialkoxyphenyl).

In formula (B), $R_{121}$ and $RED_{121}$, $R_{122}$ and $R_{121}$ or $ED_{12}$ and $RED_{12}$ may bond to each other to form a cyclic structure. The cyclic structure to be formed herein is a non-aromatic, carbocyclic or heterocyclic, 5-membered to 7-membered, monocyclic or condensed cyclic, substituted or unsubstituted ring structure. When $R_{121}$ and $RED_{12}$ form a cyclic structure, its specific examples include the above-mentioned examples of the cyclic structure which $R_{111}$ forms in formula (A) and, in addition to these, pyrroline ring, imidazoline ring, thiazoline ring, pyrazoline ring, oxazoline ring, indane ring, morpholine ring, indoline ring, tetrahydro-1,4-oxazine ring, 2,3-dihydrobenzo-1,4-oxazine ring, tetrahydro-1,4-thiazine ring, 2,3-dihydrobenzo-1,4-thiazine ring, 2,3-dihydrobenzofuran ring, and 2,3-dihydrobenzothiophene ring. When $ED_{12}$ and $RED_{12}$ form a cyclic structure, $ED_{12}$ is preferably an amino group, an alkylamino group, or an arylamino group, and the specific examples of the cyclic structure to be formed are tetrahydropyrazine ring, piperazine ring, tetrahydroquinoxaline ring, and tetrahydroisoquinoline ring. When $R_{122}$ and $R_{121}$ form a cyclic structure, its specific examples are cyclohexane ring and cyclopentane ring.

Next, formulae (1) to (3) are described.

In formulae (1) to (3), $R_1$, $R_2$, $R_{11}$, $R_{12}$ and $R_{31}$ have the same meanings as $R_{112}$ in formula (A), and their preferred range may also be the same as that of the latter. $L_1$ $L_{21}$ and $L_{31}$ indicate the same leaving group as that mentioned hereinabove for the specific examples of $L_{11}$ in formula (A), and their preferred range may also be the same as that of the latter. The substituents represented by $X_1$ and/or $X_{21}$ are the same as the examples of the substituent of the substituted $RED_{11}$ in formula (A), and their preferred range may also be the same as that of the latter. $m_1$ and $m_{21}$ are preferably an integer of from 0 to 2, and more preferably 0 or 1.

When $R_{N1}$, $R_{N21}$ and $R_{N31}$ are substituents, they are preferably any of an alkyl group, an aryl group and a heterocyclic group, and these may further have any desired substituent. Preferably, $R_{N1}$, $R_{N21}$ and $R_{N31}$ are any of a hydrogen atom, an alkyl group and an aryl group, and more preferably a hydrogen atom or an alkyl group.

When $R_{13}$, $R_{14}$, $R_{33}$, $R_a$ and $R_b$ are substituents, they are preferably any of an alkyl group, an aryl group, an acyl group, an alkoxycarbonyl group, a carbamoyl group, a cyano group, an alkoxy group, an acylamino group, a sulfonamido group, an ureido group, a thioureido group, an alkylthio group, an arylthio group, an alkylsulfonyl group, an arylsulfonyl group, and a sulfamoyl group.

In formula (1), the 6-membered ring which $Z_1$ forms is a non-aromatic heterocyclic ring condensed with the benzene ring in formula (1). The concrete ring structure in which Z1 is condensed with the benzene ring includes tetrahydroquinoline ring, tetrahydroquinoxaline ring and tetrahydroquinazoline ring. Preferably, it is tetrahydroquinoline ring or tetrahydroquinoxaline ring. The ring structure may have any substituent.

In formula (2), $ED_{21}$ has the same meaning as $ED_{12}$ in formula (B), and its preferred range may also be the same as that of the latter.

In formula (2), any two of $R_{N21}$, $R_{13}$, $R_{14}$, $X_{21}$ and $ED_{21}$ may bond to each other to form a cyclic structure. The cyclic structure which $R_{N21}$ and $X_{21}$ bonding to each other form is preferably a 5-membered to 7-membered, non-aromatic, carbocyclic or heterocyclic ring condensed with the benzene ring, and its specific examples are tetrahydroquinoline ring, tetrahydroquinoxaline ring, indoline ring, and 2,3-dihydro-5,6-benzo-1,4-thiazine ring. Preferably, it is tetrahydroquinoline ring, tetrahydroquinoxaline ring, or indoline ring.

In formula (3), when $R_{N31}$ is a group except an aryl group, $R_a$ and $R_b$ bond to each other to form an aromatic ring. The aromatic ring includes an aryl group (e.g., phenyl group, or naphthyl group), and an aromatic heterocyclic group (e.g., pyridine ring, pyrrole ring, quinoline ring, or indole ring), and is preferably an aryl group. The aromatic group may have any desired substituent.

Preferably in formula (3), $R_a$ and $R_b$ bond to each other to form an aromatic ring (especially phenyl group).

In formula (3), $R_{32}$ is preferably a hydrogen atom, an alkyl group, an aryl group, a hydroxyl group, an alkoxy group, a mercapto group, or an amino group. When $R_{32}$ is a hydroxyl group, $R_{33}$ is preferably an electron attractive group, and this is one preferred embodiment of the invention. The "electron attractive group" is the same as that mentioned hereinabove, and is preferably an acyl group, an alkoxycarbonyl group, a carbamoyl group or a cyano group.

Next, the compounds of type 2 are described.

In the compounds of type 2, the "bond cleavage resction" means interelemental cleavage of carbon-carbon bond, carbon-silicon bond, carbon-hydrogen bond, carbon-boron bond, carbon-tin bond or carbon-germanium bond, which may be accompanied by carbon-hydrogen bond cleavage.

The compound of type 2 has at least two (preferably from 2 to 6, and more preferably from 2 to 4) groups adsorptive to silver halide. More preferably, it has at least two, mercapto-substituted nitrogen-containing heterocyclic groups as such groups. The number of the groups adsorptive to silver halide is preferably from 2 to 6, and more preferably from 2 to 4. The groups adsorptive to silver halide will be described later.

Preferred compounds of type 2 are represented by the following formula (C):

Formula (C)

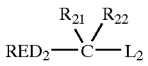

In the compounds of formula (C), the reducing group represented by $RED_2$ undergoes one-electron oxidation, and then spontaneously releases $L_2$ through a bond cleavage reaction and further releases another electron.

In formula (C), $RED_2$ has the same meaning as $RED_{12}$ in formula (B), and its preferred range may also be the same as that of the latter. $L_2$ has the same meaning as $L_{11}$ in formula (A), and its preferred range may also be the same as that of the latter. When $L_2$ is a silyl group, the compound has in its molecule at least two, mercapto-substituted nitrogen-containing heterocyclic groups as the groups adsorptive to silver halide. $R_{21}$ and $R_{22}$ each represent a hydrogen atom or a substituent, and they have the same meaning as $R_{112}$ in formula (A). Their preferred range may also be the same as that of the latter. $RED_2$ and $R_{21}$ may bond to each other to form a cyclic structure.

The cyclic structure to be formed herein is a 5-membered to 7-membered, monocyclic or condensed cyclic, non-aromatic carbocyclic or heterocyclic structure which may be optionally substituted. However, the cyclic structure does not correspond to a tetrahydro, hexahydro or octahydro form of an aromatic ring or an aromatic heterocyclic ring. Preferably, the cyclic structure corresponds to a dihydro form of an aromatic ring or an aromatic heterocyclic ring. Its specific examples are 2-pyrroline ring, 2-imidazoline ring, 2-thiazoline ring, 1,2-dihydropyridine ring, 1,4-dihydropyridine ring, indoline ring, benzimidazoline ring, benzothiazoline ring, benzoxazoline ring, 2,3-dihydrobenzothiophene ring, 2,3-dihydrobenzofuran ring, benzo-α-pyran ring, 1,2-dihydroquinoline ring, 1,2-dihydroquinazoline ring, and 1,2-dihydroquinoxaline ring. Preferred are 2-imidazoline ring, 2-thiazoline ring, indoline ring, benzimidazoline ring, benzothiazoline ring, benzoxazoline ring, 1,2-dihydropyridine ring, 1,2-dihydroquinoline ring, 1,2-dihydroquinazoline ring, and 1,2-dihydroquinoxaline ring; and more preferred are indoline ring, benzimidazoline ring, benzothiazoline ring, and 1,2-dihydroquinoline ring; and even more preferred is indoline ring.

Next, the compounds of type 3 are described.

In the compounds of type 3, the step of "bond formation" means interatomic bond formation of, for example, carbon-carbon bond, carbon-nitrogen bond, carbon-sulfur bond or carbon-oxygen bond.

Preferably, the compound of type 3 is as follows: Its one-electron oxidant formed through one-electron oxidation of the compound reacts with the reactive group site existing inside the same molecule (carbon-carbon double bond site, carbon-carbon triple bond site, aromatic group site, or benzo-condensed non-aromatic heterocyclic group site) to form a bond, and then the resultant further releases one or more electrons.

More precisely, the compound of type 3 is characterized in that its one-electron oxidant formed through one-electron oxidation of the compound (cationic radical species, or neutral radical species that is formed through proton release from the cationic radical species) reacts with the above-mentioned reactive group existing inside the same molecule to thereby form a bond, and a radical species having a cyclic structure is newly formed in the molecule. From this radical species, a second electron is released directly or along with proton release.

Some compounds of type 3 are as follows: The resulting two-electron oxidant may be hydrolyzed or may cause a tautomerization reaction that is accompanied by direct proton movement to thereby further release one or more, generally at least two electrons. Some other compounds of type 3 do not cause such tautomerization. Concretely, the two-electron oxidant of the type has the ability to directly release one or more, generally at least two electrons.

Preferably, the compounds of type 3 are represented by the following formula (D-1).

Formula (D-1)

$$RED_3\text{-}L_3\text{-}Y_3$$

In formula (D-1), $RED_3$ represents a one-electron oxidizable reducing group; and $Y_3$ represents a reactive group site that reacts with a reactant after one-electron oxidation of $RED_3$. Concretely, $Y_3$ is an organic group that contains a carbon-carbon double bond site, a carbon-carbon triple bond site, an aromatic group site, or a benzo-condensed non-aromatic heterocyclic group site. $L_3$ represents a linking group that links $RED_3$ and $Y_3$.

$RED_3$ has the same meaning as $RED_{12}$ in formula (B), and is preferably an arylamino group, a heterocyclic amino group, an aryloxy group, an arylthio group, an aryl group, or an aromatic or non-aromatic heterocyclic group (especially preferably nitrogen-containing heterocyclic group), and more preferably an arylamino group, a heterocyclic amino group, an aryl group, or an aromatic or non-aromatic heterocyclic group. The heterocyclic group is preferably a tetrahydroquinoline ring group, a tetrahydroquinoxaline ring group, a tetrahydroquinazoline ring group, an indoline ring group, an indole ring group, a carbazole ring group, a phenoxazine ring group, a phenothiazine ring group, a benzothiazoline ring group, a pyrrole ring group, an imidazole ring group, a thiazole ring group, a benzimidazole ring group, a benzimidazoline ring group, a benzothiazoline ring group, or a 3,4-methylenedioxyphenyl-1-yl group.

$RED_3$ is more preferably an arylamino group (especially anilino group), an aryl group (especially phenyl group), or an aromatic or non-aromatic heterocyclic group.

When $RED_3$ is an aryl group, the aryl group preferably has at least one "electron-donating group". The "electron-donating group" is the same as that mentioned hereinabove.

When $RED_3$ is an aryl group, the substituent of the aryl group is more preferably an alkylamino group, a hydroxyl group, an alkoxy group, a mercapto group, a sulfonamido group, an active methine group, or a non-aromatic nitrogen-containing heterocyclic group that bonds to the aryl group at the nitrogen atom thereof, more preferably an alkylamino group, a hydroxyl group, an active methine group, or a non-aromatic nitrogen-containing heterocyclic group that bonds to the aryl group at the nitrogen atom thereof, and most preferably an alkylamino group, or a non-aromatic nitrogen-containing heterocyclic group that bonds to the aryl group at the nitrogen atom thereof.

When the organic group represented by $Y_3$ that contains a carbon-carbon double bond site (e.g., vinyl group) is substituted, its substituent is preferably any of an alkyl group, a phenyl group, an acyl group, a cyano group, an alkoxycarbonyl group, a carbamoyl group, and an electron-donating group. The electron-donating group is preferably an alkoxy group, a hydroxyl group (optionally protected with a silyl group, for example, trimethylsilyloxy, t-butyldimethylsilyloxy, triphenylsilyloxy, triethylsilyloxy, phenyldimethylsilyloxy group), an amino group, an alkylamino group, an arylamino group, a sulfonamido group, an active methine group, a mercapto group, an alkylthio group, and a phenyl group substituted with any of these electron-donating groups.

When the organic group having a carbon-carbon double bond site has a hydroxyl group as the substituent thereof, $Y_3$ contains a partial structure of $>C_1{=}C_2(-OH)-$, and it may be tautomerized into a partial structure of $>C_1H-C_2(=O)-$. In this embodiment, it is also preferable that the substituent bonding to the $C_1$ carbon is an electron attractive group. In this case, $Y_3$ has a partial structure of "active methylene group" or "active methine group". The electron attractive group capable of giving the partial structure of active methylene group or active methine group may be the same as that mentioned hereinabove for the above "active methine group".

When the organic group having a carbon-carbon triple bond site (e.g., ethynyl group) represented by $Y_3$ is substituted, its substituent is preferably any of an alkyl group, a phenyl group, an alkoxycarbonyl group, a carbamoyl group and an electron-donating group.

When $Y_3$ is an organic group that contains an aromatic group site, the aromatic group is preferably an indole ring group or an aryl group (especially preferably phenyl group) substituted with an electron-donating group. The electron-donating group is preferably a hydroxyl group (optionally protected with a silyl group), an alkoxy group, an amino group, an alkylamino group, an active methine group, a sulfonamido group or a mercapto group.

When $Y_3$ is an organic group that contains a benzo-condensed non-aromatic heterocyclic group site, the benzo-condensed non-aromatic heterocyclic group preferably has an aniline structure as its inner partial structure. For example, it includes an indoline ring group, a 1,2,3,4-tetrahydroquinoline ring group, a 1,2,3,4-tetrahydroquinoxaline ring group, and a 4-quinolone ring group.

More preferably, the reactive group represented by $Y_3$ is an organic group that contains a carbon-carbon double bond site, an aromatic group site or a benzo-condensed non-aromatic heterocyclic group site. Even more preferably, the organic group contains a carbon-carbon double bond site, a phenyl group substituted with an electron-donating group, an indole ring group, or a benzo-condensed non-aromatic heterocyclic group having an aniline structure as the inner partial structure thereof. Still preferably, the carbon-carbon double bond site has at least one electron-donating substituent.

As a result that the reactive group represented by $Y_3$ is selected from the range described hereinabove, the case where $Y_3$ has the same partial structure as that of the reducing group represented by $RED_3$ is also one preferred embodiment of the compound of formula (D-1).

$L_3$ represents a linking group that links $RED_3$ and $Y_3$. Concretely, it may be a single bond, an alkylene group, an arylene group, a heterocyclic group, —O—, —S—, $-NR_N-$, —C(=O)—, $-SO_2-$, —SO— or —P(=O)— groups. $R_N$ represents a hydrogen atom, an alkyl group, an aryl group, or a heterocyclic group. The liking group represented by $L_3$ may have any desired substituent. The liking group represented by $L_3$ bonds to $RED_3$ and to $Y_3$ at any desired position thereof in such a manner that any desired one hydrogen atom of each of $RED_3$ and $Y_3$ is substituted with the linking group.

Preferably, for example, $L_3$ is a linking group of a single bond, an alkylene group (especially methylene, ethylene, or propylene), an arylene group (especially phenylene), —C(=O)—, —O—, —NH—, or —N(alkyl)-group alone, or a combination of any of these group.

Regarding the group $L_3$, it is preferable that, when the cation radical species ($X^+$–) formed through oxidation of $RED_3$, or the radical species (X–) formed through proton release from that cation radical species reacts with the reactive group of $Y_3$ to form a bond, the atomic group relating to the reaction may form a 3-membered to 7-membered cyclic structure including $L_3$. For this, it is preferable that the radical species ($X^+$– or X–), the reactive group of $Y_3$, and L are bonded to each other via from 3 to 7 atomic groups.

Next, the compounds of type 4 are described.

The compounds of type 4 have a cyclic structure substituted with a reducing group, in which the reducing group, after having undergone one-electron oxidation, releases another one or more electrons through subsequent ring cleavage. The ring cleavage as referred to herein means the following reaction.

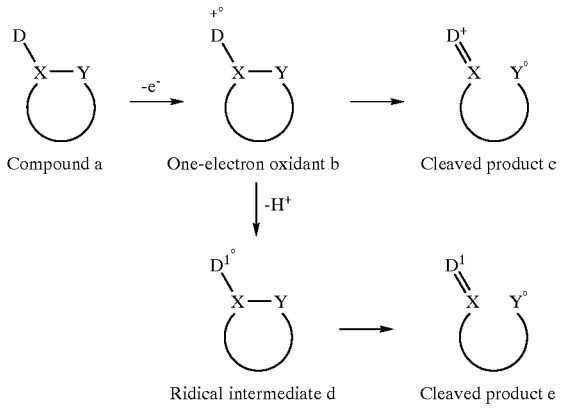

In the above formula, compound a is the compound of type 4. In compound a, D indicates a reducing group, and X and Y indicate the atoms of the cyclic structure that form a bond capable of being cleaved after one-electron oxidation of the compound. Compound a first undergoes one-electron oxidation to form one-electron oxidant b. Thereafter, the D—X single bond becomes a double bond and, at the same time, the bond X—Y is cleaved to form cleaved product c. Alternatively, one-electron oxidant b may form radical intermediate d through proton elimination, and then cleaved product e may form in the same manner as above. Thus formed, cleaved product c or e further releases at least one electron. The reaction route characterizes the compounds of type 4 for use in the invention.

The cyclic structure of the compound of type 4 is a 3- to 7-membered, carbocyclic or heterocyclic, monocyclic or condensed cyclic, saturated or unsaturated non-aromatic ring structure. Preferably, it is a saturated cyclic structure, and more preferably a 3- or 4-membered one. Preferred examples of the cyclic structure are cyclopropane ring, cyclobutane ring, oxirane ring, oxetane ring, aziridine ring, azetidine ring, episulfide ring, and thietane ring. More preferred are cyclopropane ring, cyclobutane ring, oxirane ring, oxetane ring, and azetidine ring; and even more preferred are cyclopropane ring, cyclobutane ring, and azetidine ring. The cyclic structure may have any desired substituent.

Preferably, the compounds of type 4 are represented by the following formula (E) or (F):

Formula (E)

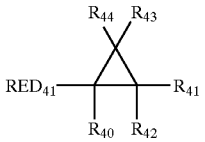

Formula (F)

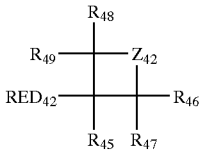

In formulae (E) and (F), $RED_{41}$ and $RED_{42}$ have the same meanings as $RED_{12}$ in formula (B), and their preferred range may also be the same as that of the latter. $R_{40}$ to $R_{44}$ and $R_{45}$ to $R_{49}$ each represent a hydrogen atom or a substituent. In formula (F), $Z_{42}$ represents —$CR_{420}R_{421}$—, —$NR_{423}$—, or —O—. $R_{420}$ and $R_{421}$ each represent a hydrogen atom or a substituent; and $R_{423}$ represents a hydrogen atom, an alkyl group, an aryl group or a heterocyclic group.

In formulae (E) and (F), $R_{40}$ and $R_{45}$ each are preferably a hydrogen atom, an alkyl group, an aryl group or a heterocyclic group, and more preferably a hydrogen atom, an alkyl group, or an aryl group. $R_{41}$ to $R_{44}$ and $R_{46}$ to $R_{49}$ each are preferably a hydrogen atom, an alkyl group, an alkenyl group, an aryl group, a heterocyclic group, an arylthio group, an alkylthio group, an acylamino group or a sulfonamido group, and more preferably a hydrogen atom, an alkyl group, an aryl group or a heterocyclic group.

Also preferably, at least one of $R_{41}$ to $R_{44}$ is a donor group, or $R_{41}$ and $R_{42}$, or $R_{43}$ and $R_{44}$ are both electron attractive groups. More preferably, at least one of $R_{41}$ to $R_{44}$ is a donor group. Even more preferably, at least one of $R_{41}$ to $R_{44}$ is a donor group, and the group or groups other than the donor group of $R_{41}$ to $R_{44}$ are a hydrogen atom or an alkyl group.

The donor group as referred to herein is an "electron-donating group", or an aryl group substituted with at least one "electron-donating group". The donor group is preferably an alkylamino group, an arylamino group, a heterocyclic amino group, a 5-membered, monocyclic or condensed cyclic, electron-rich aromatic heterocyclic group having at least one nitrogen atom in its ring, a non-aromatic nitrogen-containing heterocyclic group bonding to the compound via its nitrogen atom, or a phenyl group substituted with at least one electron-donating group. More preferably, it is an alkylamino group, an arylamino group, a 5-membered, monocyclic or condensed cyclic, electron-rich aromatic heterocyclic group having at least one nitrogen atom in its ring (e.g., indole ring, pyrrole ring, or carbazole ring), or a phenyl group substituted at least one electron-donating group (e.g., phenyl group substituted with at least three alkoxy groups, or phenyl group substituted with hydroxy group, alkylamino group or arylamino group). Even more preferred are an arylamino group, a 5-membered, monocyclic or condensed cyclic, electron-rich aromatic heterocyclic group having at least one nitrogen atom in its ring (especially 3-indolyl group), and a phenyl group substituted at least one electron-donating group (especially trialkoxyphenyl group, or phenyl group substituted with alkylamino group or arylamino group).

$Z_{42}$ is preferably —$CR_{420}R_{421}$ or —$NR_{423}$—, and more preferably —$NR_{423}$—, $R_{420}$ and $R_{421}$ each are preferably a hydrogen atom, an alkyl group, an aryl group, a heterocyclic group, an acylamino group or a sulfonamino group, and more preferably a hydrogen atom, an alkyl group, an aryl group or a heterocyclic group. $R_{423}$ is preferably a hydrogen atom, an alkyl group, an aryl group or an aromatic heterocyclic group, and more preferably a hydrogen atom, an alkyl group or an aryl group.

When each group of $R_{40}$ to $R_{49}$, $R_{420}$, $R_{421}$ and $R_{423}$ is a substituent, the substituent preferably has at most 40 carbon atoms, more preferably at most 30 carbon atoms, and even more preferably at most 15 carbon atoms in total. These substituents may bond to each other or may bond to any other site ($RED_{41}$, $RED_{42}$ or $Z_{42}$) of the molecule to form a ring.

In the compounds of types 1 to 4 for use in the invention, the group adsorptive to silver halide is a group that may be directly adsorbed by silver halide, or a group that promotes the adsorption of the compound to silver halide. Concretely, for example, it includes a mercapto group (or its salts), a thione group (—C(=S)—), a heterocyclic group that contains at lest one atom selected from nitrogen, sulfur, selenium and tellurium atoms, a sulfido group, a cationic group, and an ethynyl group. In the compounds of type 2, however, the group adsorptive to silver halide does not include a sulfido group.

The mercapto group (or its salt) as the group adsorptive to silver halide may be a mercapto group (or its salt) itself, but is more preferably a heterocyclic, aryl or alkyl group substituted with at least one mercapto group (or its salt). The heterocyclic group is a 5-membered to 7-membered, monocyclic or condensed cyclic, aromatic or non-aromatic heterocyclic group, including, for example, an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, and a triazine ring group. It may also be a quaternary nitrogen-containing heterocyclic group, in which the substituting mercapto group may dissociate to form a meso ion. Examples of the heterocyclic group of the type are an imidazolium ring group, a pyrazolium ring group, a thiazolium ring group, a triazolium ring group, a tetrazolium ring group, a thiadiazolium ring group, a pyridinium ring group, a pyrimidinium ring group, and a triazinium ring group. Among those, preferred is a triazolium ring group (e.g., 1,2,4-triazolium-3-thiolate ring group). The aryl group may be a phenyl group or a naphthyl group. The alkyl group may be a linear, branched or cyclic alkyl group having from 1 to 30 carbon atoms. When the mercapto group forms a salt, its counter ion may be a cation of alkali metals, alkaline earth metals or heavy metals (e.g., $Li^+$, $Na^+$, $K^+$, $Mg^{2+}$, $Ag^+$, $Zn^{2+}$), an ammonium ion, a quaternary nitrogen-containing heterocyclic group, or a phosphonium ion.

The mercapto group acting as the group adsorptive to silver halide may also be in the form of its tautomer, thione group. Concretely, it may be a thioamido group (—C(=S)—NH—) or a group that contains a partial structure of the thioamido group, more concretely a linear or cyclic thioamido group, or a thioureido group, a thiourethane group, or a dithiocarbamate group. Examples of the cyclic group are a thiazolidine-2-thione group, an oxazolidine-2-thione group, a 2-thiohydantoin group, a rhodanine group, an isorhodanine group, a thiobarbituric acid group, and a 2-thioxo-oxazolidin-4-one group.

In addition to the mercapto-tautomerized thione group as described above, the thione group acting as the group adsorptive to silver halide further includes any others that cannot be tautomerized into mercapto group (that do not have a hydrogen atom at the α-position of the thione group), such as a linear or cyclic thioamido group, a thioureido group, a thiourethane group, and a dithiocarbamate group.

The heterocyclic group that contains at least one atom selected from nitrogen, sulfur, selenium and tellurium atoms and that acts as the group adsorptive to silver halide is a nitrogen-containing heterocyclic group that has as the partial structure of the heterocyclic ring thereof a group of —NH— capable of forming imino silver (>NAg), or a heterocyclic group that has as the partial structure of the heterocyclic ring thereof a group of "—S—", "—Se—", "—Te—" or "=N—" capable of coordinating with a silver ion via a coordination bond. Examples of the former are a benzotriazole group, a triazole group, an indazole group, a pyrazole group, a tetrazole group, a benzimidazole group, an imidazole group, and a purine group; and examples of the latter are a thiophene group, a thiazole group, an oxazole group, a benzothiazole group, a benzoxazole group, a thiadiazole group, an oxadiazole group, a triazine group, a selenazole group, a benzoselenazole group, a tellurazole group, and a benzotellurazole group. Preferred are the former.

The sulfido group acting as the group adsorptive to silver halide is any group that has a partial structure of "—S—". Preferably, it has a partial structure of alkyl (or alkylene)-S-alkyl (or alkylene), aryl (or arylene)-S-alkyl (or alkylene), or aryl (or arylene)-S-aryl (or arylene). The sulfido group may form a cyclic structure, or may have a structure of —S—S—. Specific examples of the cyclic structure-forming group are those containing any of thiolane ring, 1,3-dithiolane ring, 1,2-dithiolane ring, thiane ring, dithiane ring, and tetrahydro-1,4-thiazine ring (thiomorpholine ring). More preferably, the sulfido group has a partial structure of alkyl (or alkylene)-S-alkyl (or alkylene).

The cationic group acting as the group adsorptive to silver halide means a group that contains a quaternary nitrogen atom, and is concretely an ammonio group or a quaternary nitrogen-containing heterocyclic group. However, the cationic group is not a part of a dye structure-forming atomic group (e.g., cyanine chromophore). The ammonio group is a trialkylammonio group, a dialkylarylammonio group, or an alkyldiarylammonio group, including, for example, a benzyldimethylammonio group, a trihexylammonio group, and a phenyldiethylammonio group. The quaternary nitrogen-containing heterocyclic group includes, for example, a pyridinio group, a quinolinio group, an isoquinolinio group, and an imidazolio group. Preferred are a pyridinio group and an imidazolio group; and more preferred is a pyridinio group. The quaternary nitrogen-containing heterocyclic group may have any desired substituent. The substituent of pyridinio group and imidazolio group is preferably any of an alkyl group, an aryl group, an acylamino group, a chlorine atom, an alkoxycarbonyl group, and a carbamoyl group. The substituent of pyridino group is more preferably a phenyl group.

The ethynyl group acting as the group adsorptive to silver halide means a group of —C≡CH, in which the hydrogen atom may be substituted.

The above-mentioned groups adsorptive to silver halide may have any desired substituent.

Other examples of the groups adsorptive to silver halide are described, for example, in JP-A No. 11-95355, pp. 4–7.

The group adsorptive to silver halide in the invention is preferably a mercapto-substituted nitrogen-containing heterocyclic group (e.g., 2-mercaptothiadiazole group, 3-mercapto-1,2,4-triazole group, 5-mercaptotetrazole group, 2-mercapto-1,3,4-oxadiazole group, 2-mercaptobenzoxazole group, 2-mercaptobenzothiazole group, or 1,5-dimethyl-1,2,4-triazolium-3-thiolate group), or a nitrogen-containing heterocyclic group that has, as the partial structure of the heterocyclic ring thereof, a group —NH— capable of forming imino silver (>NAg) (e.g., benzotriazole group, benzimidazole group, or imidazole group). Among them, 5-mercaptotetrazole group, 3-mercapto-1,2,4-triazole group, and benzotriazole group are more preferable, and 3-mercapto-1,2,4-triazole group, and 5-mercaptotetrazole group are most preferable.

Compounds that have at least two mercapto groups as the partial structure in the molecule thereof are also preferable for use in the invention. The mercapto group (—SH) may become a thione group when it is tautomerizable. Examples of the compounds of the type are those that have, in the molecule thereof, at least two groups adsorptive to silver halide each having the above-mentioned mercapto group or a thione group as the partial structure thereof (e.g., ring-forming thioamido group, alkylmercapto group, arylmercapto group, or heterocyclic-mercapto group), or those with at least one group adsorptive to silver halide that has at least two mercapto or thione groups as the partial structure thereof (e.g., dimercapto-substituted nitrogen-containing heterocyclic group).

Examples of the group adsorptive to silver halide that has at least two mercapto groups as the partial structure thereof (e.g., dimercapto-substituted nitrogen-containing heterocyclic group) are a 2,4-dimercaptopyrimidine group, a 2,4-dimercaptotriazine group, a 3,5-dimercapto-1,2,4-triazole group, a 2,5-dimercapto-1,3-thiazole group, a 2,5-dimercapto-1,3-oxazole group, a 2,7-dimercapto-5-methyl-s-triazolo(1,5-A)pyrimidine group, a 2,6,8-trimercaptopurine group, a 6,8-dimercaptopurine group, a 3,5,7-trimercapto-s-triazolotriazine group, a 4,6-dimercaptopyrazolopyrimidine group, and a 2,5-dimercaptoimidazole group. Especially preferred are a 2,4-dimercaptopyrimidine group, a 2,4-dimercaptotriazine group, and a 3,5-dimercapto-1,2,4-triazole group.

The group adsorptive to silver halide may bond to any site in formulae (A) to (F) and formulae (1) to (3). Preferably, however, the group bonds to $RED_{11}$, $RED_{12}$, $RED_2$ or $RED_3$ in formulae (A) to (D-1), to any of $RED_{41}$, $R_{41}$, $RED_{42}$ and $R_{46}$ to $R_{48}$ in formulae (E) and (F), and to any site other than $R_1$, $R_2$, $R_{11}$, $R_{12}$, $R_{31}$, $L_1$, $L_{21}$ and $L_{31}$ in formulae (1) to (3). More preferably, the group bonds to $RED_{11}$, to $RED_{42}$ in all of formulae (A) to (F).

The partial structure of spectral sensitizer dye is a group that contains the chromophore of the dye, and it is a residue derived from a spectral sensitizer dye compound by removing an arbitrary hydrogen atom or substituent from the compound. The partial structure of spectral sensitizer dye may be disposed in any site in formulae (A) to (F) and formulae (1) to (3). Preferably, however, it bonds to $RED_{11}$, $RED_{12}$, $RED_2$ or $RED_3$ in formulae (A) to (D-1), to any of $RED_{41}$, $R_{41}$, $RED_{42}$ and $R_{46}$ to $R_{48}$ in formulae (E) and (F), and to any site other than $R_1$, $R_2$, $R_{11}$, $R_{12}$, $R_{31}$, $L_1$, $L_{21}$ and $L_{31}$ in formulae (1) to (3). More preferably, it bonds to $RED_{11}$, to $RED_{41}$ in all of formulae (A) to (F). Preferred spectral sensitizer dyes for use in the invention are those typically used in the technique of color sensitization, including, for example, cyanine dyes, complex cyanine dyes, merocyanine dyes, complex merocyanine dyes, homopolar cyanine dyes, styryl dyes, and hemicyanine dyes. Typical spectral sensitizer dyes usable herein are disclosed in Research Disclosure, Item 36544, September 1994. Those skilled in the art can produce the dyes in accordance with the process described in the above Research Disclosure or in F. M. Hamer, *The Cyanine Dyes and Related Compounds* (Interscience Publishers, New York, 1964). In addition, all the dyes described in JP-A No. 11-95355 (U.S. Pat. No. 6,054,260), pp. 7–14 may apply to the invention.

Preferably, the compounds of types 1 to 4 for use in the invention each have from 10 to 60 carbon atoms, more preferably from 15 to 50 carbon atoms, even more preferably from 18 to 40 carbon atoms, and still more preferably from 18 to 30 carbon atoms in total.

In the silver halide heat-developable photosensitive material that contains any of the compounds of types 1 to 4 of the invention, the compound undergoes one-electron oxidation after the material has been exposed to light, and thereafter it undergoes a subsequent reaction to release one electron, or as the case may be, to release two or more electrons depending on the type of the compound, and the compound is after all oxidized. The oxidation potential in the first electron oxidation of the compound is preferably at most about 1.4 V, and more preferably at most 1.0 V. Also preferably, the oxidation potential is higher than 0 V, and more preferably higher than 0.3 V. Accordingly, the oxidation potential is preferably from about 0 to about 1.4 V, and more preferably from about 0.3 to about 1.0 V.

The oxidation potential may be measured by the method of cyclic voltammetry. Concretely, a sample is dissolved in a mixed solution of acetonitrile and water (containing 0.1 M of lithium perchlorate) at a volume ratio of 80%/20%, and nitrogen gas is introduced to the resultant for 10 minutes. A glassy carbon disc is used as a working electrode, and a platinum wire is used as a counter electrode, and a saturated calomel electrode (SCE) is used as a reference electrode. At 25° C. and at a potential scanning speed of 0.1 V/sec, the sample solution is analyzed. At the peak potential of the cyclic voltammetric wave, the oxidation potential to SCE is read.

When the compounds of types 1 to 4 for use in the invention are those that undergo one-electron oxidation and release one electron through a subsequent reaction, the oxidation potential in the latter reaction is preferably from −0.5 V to −2 V, more preferably from −0.7 V to −2 V, and even more preferably from −0.9 V to −1.6 V.

When the compounds of types 1 to 4 for use in the invention are those that undergo one-electron oxidation and release two or more electrons through a subsequent reaction, and are thereby oxidized, the oxidation potential in the latter reaction is not specifically limited. The oxidation potential in the second electron oxidation and the oxidation potential in the third and later electron oxidation cannot be clearly differentiated from each other in the reaction process, and in many cases, therefore, it is actually difficult to accurately measure the oxidation potential values to differentiate them from each other.

Next, the compounds of type 5 are described.

The compounds of type 5 are represented by X—Y, in which X indicates a reducing group and Y indicates a leaving group. One-electron oxidant of the compound, which is formed through one-electron oxidation at the reducing group X of the compound, releases the group Y through subsequent cleavage of the X—Y bond to give a radical X, and the radical releases another one electron. The oxidation reaction of the compound of type 5 is represented by the following chemical formula:

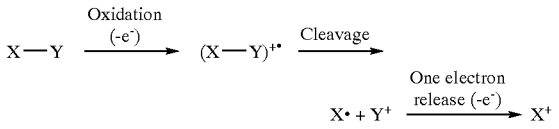

Preferably, the compound of type 5 has an oxidation potential of from 0 to 1.4 V, and more preferably from 0.3 V to 1.0 V. In the above reaction formula, the oxidation potential of the formed radical X— is preferably from −0.7 V to −2.0 V, and more preferably from −0.9 V to −1.6 V.

The compounds of type 5 are preferably represented by the following formula (G):

Formula (G)

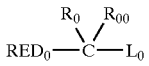

In formula (G), $RED_0$ represents a reducing group; $L_0$ represents a leaving group; and $R_0$ and $R_{00}$ each represent a hydrogen atom or a substituent. $RED_0$ and $R_0$, and $R_0$ and $R_{00}$ may bond to each other to form a cyclic structure. $RED_0$ has the same meaning as $RED_2$ in formula (C), and its preferred range may also be the same as that of the latter. $R_0$ and $R_{00}$ have the same meanings as $R_{21}$ and $R_{22}$ in formula (C), and their preferred range may also be the same as that of the latter. Except for a hydrogen atom, $R_0$ and $R_{00}$ are not the same as $L_0$. $RED_0$ and $R_0$ may bond to each other to form a cyclic structure. Examples of the cyclic structure include those mentioned hereinabove as the cyclic structure to be formed by $RED_2$ and $R_{21}$ bonding to each other in formula (C). Their preferred range may also be the same as that of the latter. Examples of the cyclic structure which $R_0$ and $R_{00}$ bonding to each other form are a cyclopentane ring and a tetrahydrofuran ring. In formula (G), $L_0$ has the same meaning as $L_2$ in formula (C), and its preferred range may also be the same as that of the latter.

Preferably, the compounds of formula (G) have, in the molecule thereof, a group adsorptive to silver halide or a partial structure of spectral sensitizer dye. However, when $L_0$ therein is any group other than a silyl group, the compound does not have two or more groups adsorptive to silver halide in the molecule thereof. Irrespective of $L_0$ therein, however, the compound may have two or more sulfide groups acting as the group adsorptive to silver halide.

Examples of the group adsorptive to silver halide which the compound of formula (G) may have include those mentioned hereinabove as the adsorptive group which the compounds of types 1 to 4 may have. In addition, all the "groups adsorptive to silver halide" mentioned in JP-A No. 11-95355, pp. 4–7 may apply to the compound of formula (G), and their preferred range mentioned therein may also apply to it.

The partial structure of spectral sensitizer dye which the compound of formula (G) may have may be the same as the partial structure of spectral sensitizer dye which the compounds of types 1 to 4 may have. In addition, all the "light-absorbing groups" mentioned in JP-A No. 11-95355, pp. 7–14 may apply to the compound of formula (G), and their preferred range mentioned therein may also apply to it.

Specific examples of the compounds of types 1 to 5 for use herein are mentioned below, however, the invention is not limited thereto.
1
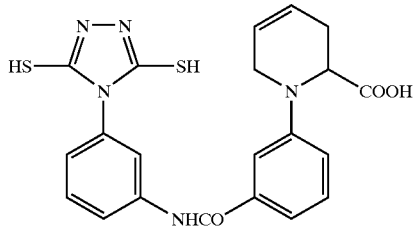
2
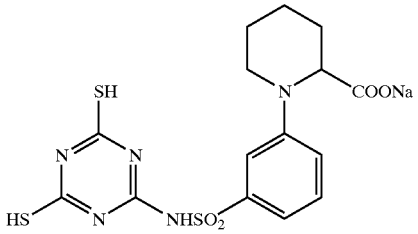
3
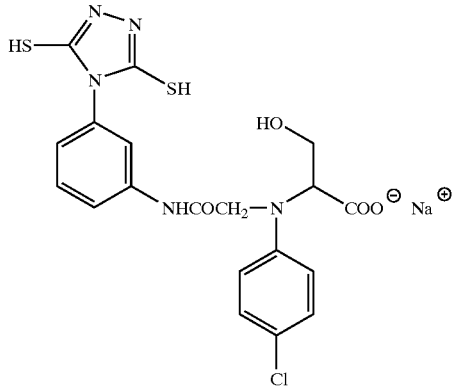
4
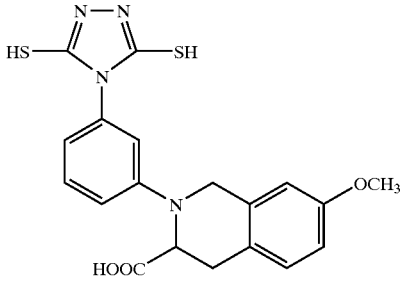
5
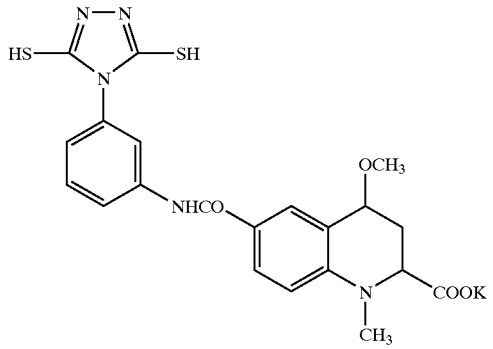
6
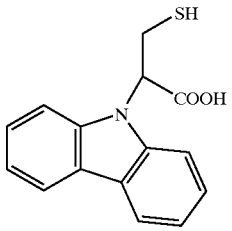
7
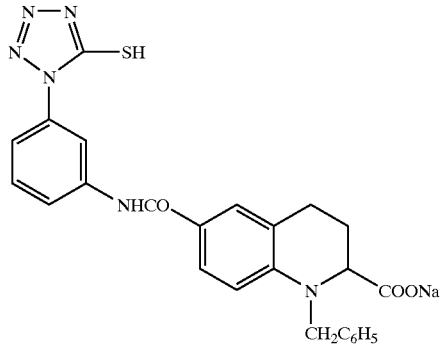
8
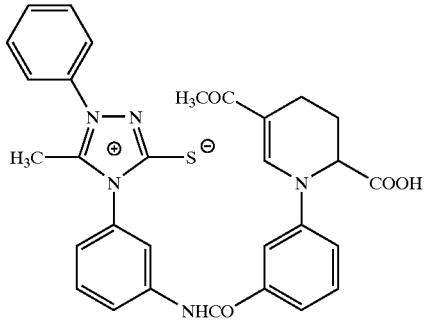

-continued
9
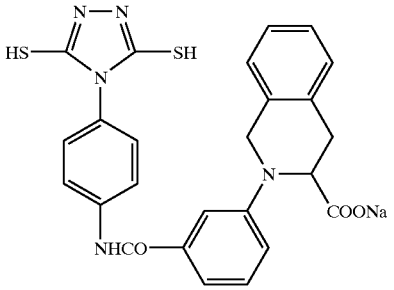
10
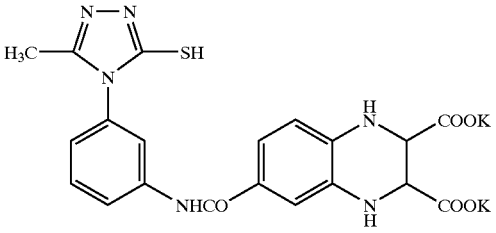
11
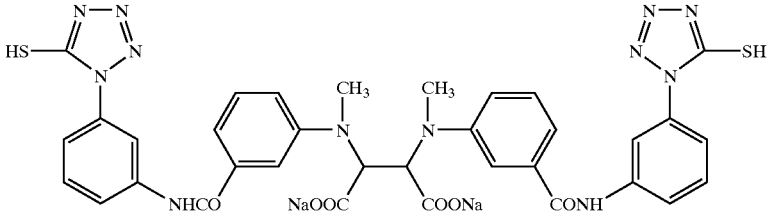
12
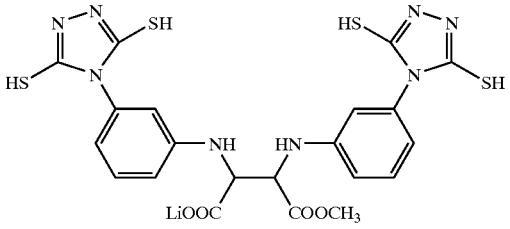
13
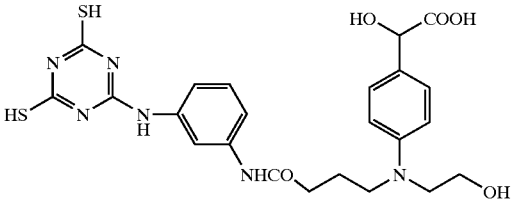
14
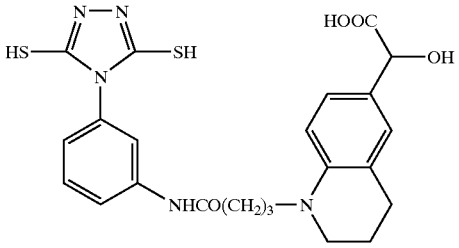
15
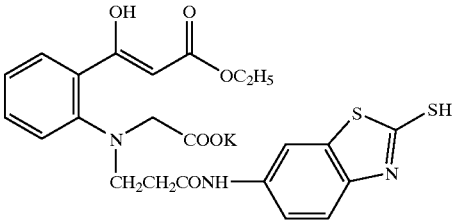
16
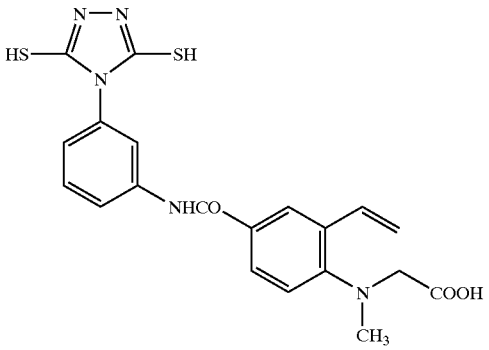
17
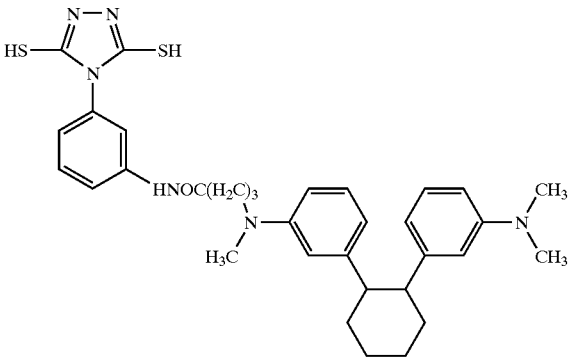

-continued
18
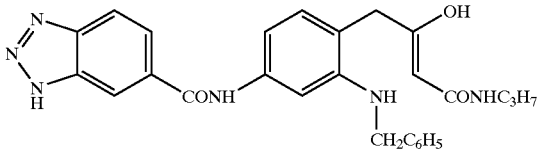
19
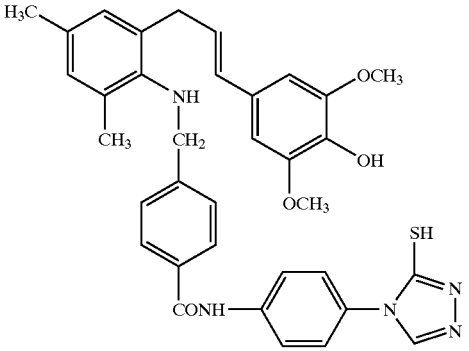
20
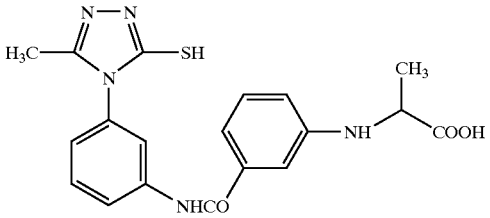
21
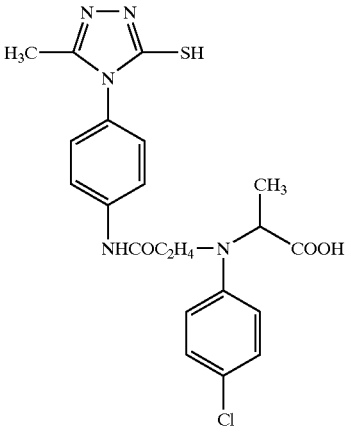
22
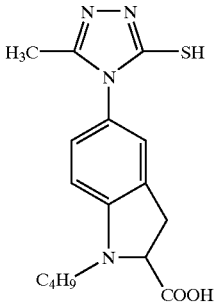
23
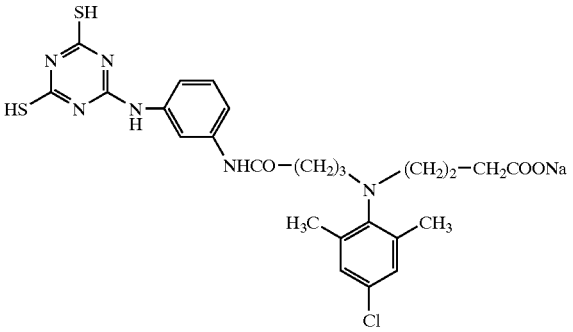
24
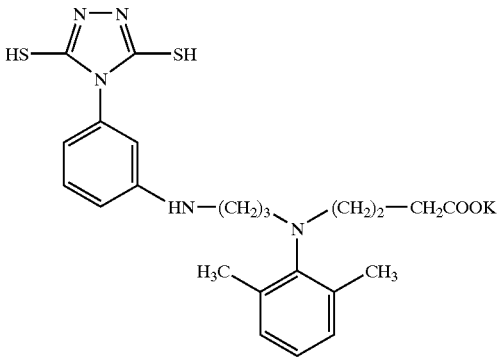
25
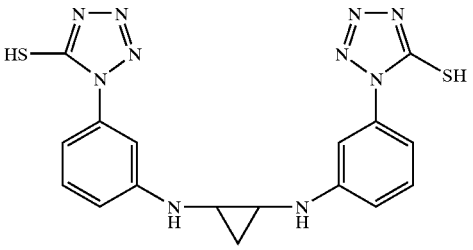

-continued
26
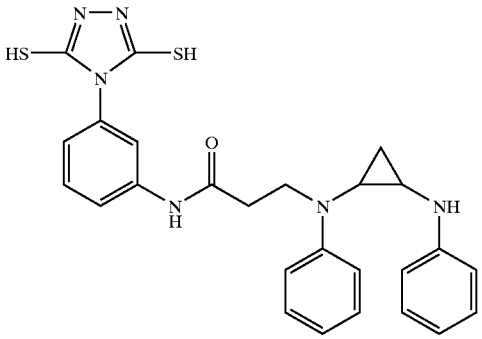
27
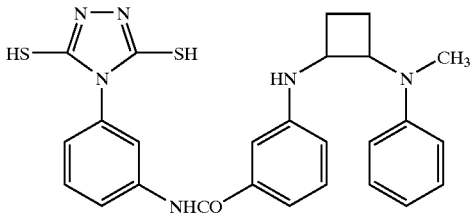
28
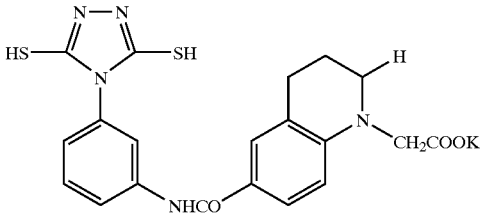
29
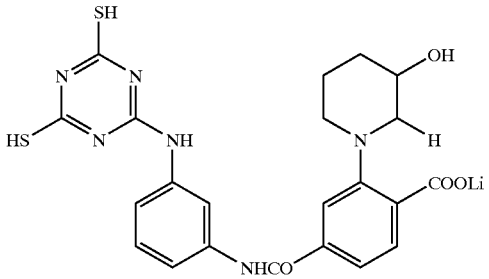
30
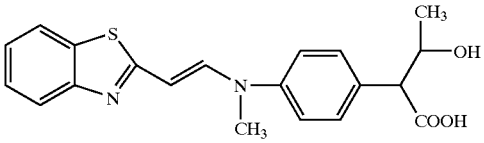
31
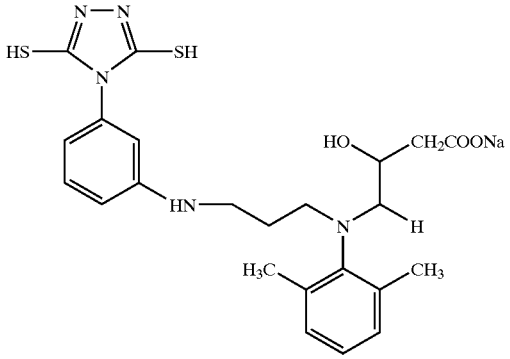
32
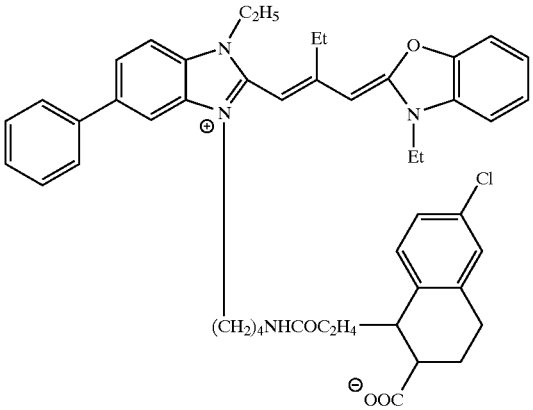
33
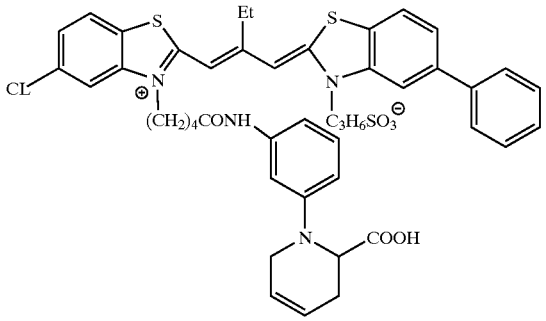
34
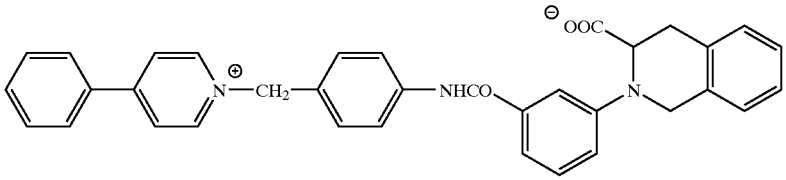

-continued

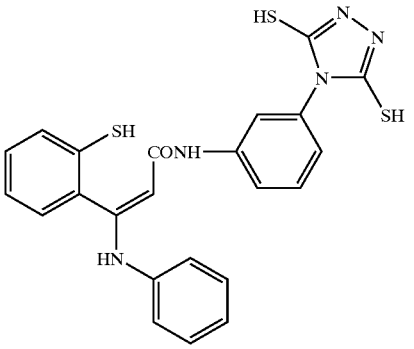

G-1

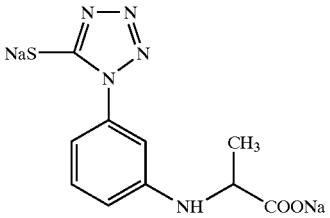

G-2

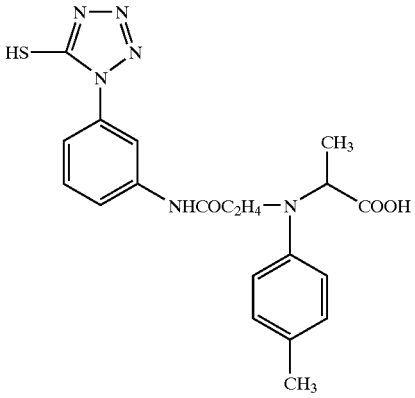

G-3

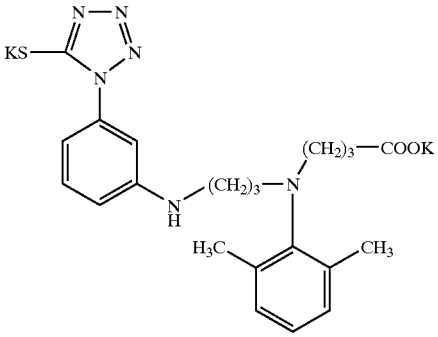

G-4

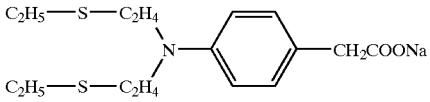

G-5

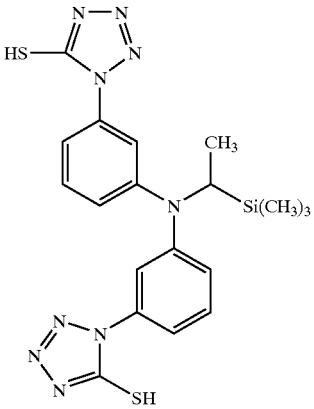

The compounds of types 1 to 4 for use in the invention are the same as those described in detail in Japanese Patent Application Nos. 2002-192373, 2002-188537, 2002-188536, 2001-272137 and 2002-192374. Specific examples of the compounds described in the specifications of these patent applications may also be used as the specific examples of the compounds of types 1 to 4. In addition, the descriptions of these patent references are referred to for production examples of the compounds of types 1 to 4 for the invention As additional specific examples of the compounds of type 5 for use in the invention, JP-A No. 9-211769 (compounds PMT-1 to S-37 described in Table E and Table F on pp. 28–32); JP-A No. 9-211774; JP-A No. 11-95355 (compounds INV1 to 36); JP-A No. 2001-500996 (compounds 1 to 74, 80 to 87, 92 to 122); U.S. Pat. Nos. 5,747,235 and 5,747,236; EP-A No. 786,692, A1 (compounds INV1 to 35); EP-A No. 893,732A1; U.S. Pat. Nos. 6,054,260 and 5,994,051 may also be used. The compounds that are referred to as "one-photon two-electron sensitizers" or "de-protonating electron-donating sensitizers" in these patent references may be used in the invention. Further, the compounds described in U.S. Pat. Nos. 5,413,905 and 5,482,825 can also be used.

The compounds of types 1 to 5 mentioned herein may be added to photosensitive silver halide emulsions in any stage of preparing the emulsions or producing heat-developable photosensitive materials. For example, the compound may be added to the emulsion while photosensitive silver halide grains are formed, or desalted or chemically sensitized, or just before the emulsion is applied to a support. If desired, the compound may be divided into some portions and they may be separately added to the emulsion in these steps. Regarding the time at which the compound is added to the emulsion, it is preferable that the compound is added thereto after photosensitive silver halide grains have been formed but before they are desalted, or while the grains are chemically sensitized (precisely, just before the start of chemical sensitization and just after the finish thereof), or just before the emulsion is applied to a support. More preferably, the compound is added to the emulsion while the grains are chemically sensitized and before they are mixed with a non-photosensitive organic silver salt.

Preferably, the compounds of types 1 to 5 are added to the emulsion after dissolved in water or a water-soluble solvent such as methanol or ethanol or in a mixed solvent of these. When the compound is dissolved in water, pH of the solution may be increased or decreased if the compound is more soluble therein at an increased or decreased pH.

Preferably, the compounds of types 1 to 5 are added to an emulsion layer that contains a photosensitive silver halide and a non-photosensitive organic silver salt. However, it may also be added to a protective layer or an interlayer that is adjacent to the emulsion layer containing a photosensitive silver halide and a non-photosensitive organic silver salt, so that the compound may diffuse into the emulsion layer. The time when the compound is added to the layer is not specifically limited and may be any time before or after the addition of sensitizer dye thereto. Preferably, the amount of the compound to be added to the silver halide emulsion layer is from $1\times10^{-9}$ to $5\times10^{-1}$ mols, and more preferably from $1\times10^{-8}$ to $5\times10^{-2}$ mols per mol of silver halide in the layer.

2) Compound Having Adsorptive Group and Reducing Group

Preferably, the heat-developable photosensitive material of the invention contains a compound having an adsorptive group and a reducing group and represented by formula (I). The compound may be used alone or in combination with any other chemical sensitizer, and it can increase the sensitivity of silver halide.

A-(W)*n*—B Formula (I)

wherein A represents a group adsorptive to silver halide (hereinafter this is referred to as "adsorptive group"); W represents a divalent linking group; n indicates 0 or 1; and B represents a reducing group.

Formula (I) is described in detail.

In formula (I), the adsorptive group represented by A is a group that may be directly adsorbed by silver halide, or a group that promotes the adsorption of the compound to silver halide. Specific examples thereof include a mercapto group (or its salts), a thione group (—C(═S)—), a heterocyclic group that contains at least one atom selected from nitrogen, sulfur, selenium and tellurium atoms, a sulfide group, a disulfide group, a cationic group, and an ethynyl group.

The mercapto group (or its salt) serving as the adsorptive group may be a mercapto group (or its salt) itself, but is more preferably a heterocyclic, aryl or alkyl group substituted with at least one mercapto group (or its salt). The heterocyclic group is a 5-membered to 7-membered, monocyclic or condensed cyclic, aromatic or non-aromatic heterocyclic group, including, for example, an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, and a triazine ring group. It may also be a quaternary nitrogen-containing heterocyclic group, in which the substituting mercapto group may dissociate to give a meso ion. Examples of the heterocyclic group of the type are an imidazolium ring group, a pyrazolium ring group, a thiazolium ring group, a triazolium ring group, a tetrazolium ring group, a thiadiazolium ring group, a pyridinium ring group, a pyrimidinium ring group, and a triazinium ring group. Among those, a triazolium ring group (e.g., 1,2,4-triazolium-3-thiolate ring group) is preferable. The aryl group may be a phenyl group or a naphthyl group. The alkyl group may be a linear, branched or cyclic alkyl group having from 1 to 30 carbon atoms. When the mercapto group forms a salt, its counter ion may be a cation of alkali metals, alkaline earth metals or heavy metals (e.g., $Li^+$, $Na^+$, $K^+$, $Mg^{2+}$, $Ag^+$, $Zn^{2+}$), an ammonium ion, a quaternary nitrogen-containing heterocyclic group, or a phosphonium ion.

The mercapto group acting as the adsorptive group may also be in the form of its tautomer, thione group. Concretely, it may be a thioamido group (—C(═S)—NH—) or a group that contains a partial structure of the thioamido group, more concretely a linear or cyclic thioamido group, or a thioureido group, a thiourethane group, or a dithiocarbamate group. Examples of the cyclic group are a thiazolidine-2-thione group, an oxazolidine-2-thione group, a 2-thiohydantoin group, a rhodanine group, an isorhodanine group, a thiobarbituric acid group, and a 2-thioxo-oxazolidin-4-one group.

In addition to the mercapto-tautomerized thione group as above, the thione group acting as the adsorptive group further includes any others that cannot be tautomerized into a mercapto group (that do not have a hydrogen atom at the a-position of the thione group), such as a linear or cyclic thioamido group, a thioureido group, a thiourethane group, and a dithiocarbamate group.

The heterocyclic group that contains at least one atom selected from nitrogen, sulfur, selenium and tellurium atoms and that acts as the adsorptive group is a nitrogen-containing heterocyclic group that has a group of —NH— capable of forming imino silver (>NAg) as the partial structure of the heterocyclic ring thereof, or a heterocyclic group that has as the partial structure of the heterocyclic ring thereof a group of "—S—", "—Se—", "—Te—" or "═N—" capable of coordinating with a silver ion via a coordination bond. Examples of the former are a benzotriazole group, a triazole group, an indazole group, a pyrazole group, a tetrazole group, a benzimidazole group, an imidazole group, and a purine group; and examples of the latter are a thiophene group, a thiazole group, an oxazole group, a benzothiophene group, a benzothiazole group, a benzoxazole group, a thiadiazole group, an oxadiazole group, a triazine group, a selenazole group, a benzoselenazole group, a tellurazole group, and a benzotellurazole group. The former is preferable.

The sulfido or disulfide group acting as the adsorptive group is any group that has a partial structure of "—S—" or "—S—S—". Preferably, it has a partial structure of alkyl (or alkylene)-X-alkyl (or alkylene), aryl (or arylene)-X-alkyl (or alkylene), or aryl (or arylene)-X-aryl (or arylene). X indicates —S— or —S—S— group. The sulfido or disulfido group may form a cyclic structure. Specific examples of the cyclic structure-forming group are those containing any of a thiolane ring, a 1,3-dithiolane ring, a 1,2-dithiolane ring, a thiane ring, a dithiane ring, and a thiomorpholine ring. More preferably, the sulfido group has a partial structure of alkyl (or alkylene)-S-alkyl (or alkylene). Also more preferably, the disulfido group is a 1,2-dithiolane ring group.

The cationic group acting as the adsorptive group means a group that contains a quaternary nitrogen atom, and is concretely an ammonio group or a quaternary nitrogen-containing heterocyclic group. The ammonio group is a trialkylammonio group, a dialkylarylammonio group, or an alkyldiarylammonio group, including, for example, a benzyldimethylammonio group, a trihexylammonio group, and a phenyldiethylammonio group. The quaternary nitrogen-containing heterocyclic group includes, for example, a pyridinio group, a quinolinio group, an isoquinolinio group, and an imidazolio group. A pyridinio group and an imidazolio group are preferable; and a pyridinio group is more preferable. The quaternary nitrogen-containing heterocyclic group may have any desired substituent. In the case of a pyridinio group and an imidazolio group, the substituent is preferably any of an alkyl group, an aryl group, an acylamino group, a chlorine atom, an alkoxycarbonyl group, and a carbamoyl group. In particular, in the case of a pyridino group, the substituent is more preferably a phenyl group.

The ethynyl group acting as the adsorptive group means a group of —C≡CH, in which the hydrogen atom may be substituted.

The above-mentioned adsorptive groups may have any desired substituent. Examples of the substituent include a halogen atom (a fluorine atom, a chlorine atom, a bromine atom, or an iodine atom), an alkyl group (a linear, branched or cyclic alkyl group including a bicycloalkyl group and an active methine group), an alkenyl group, an alkynyl group, an aryl group, a heterocyclic group (its substituting position is not defined), an acyl group, an alkoxycarbonyl group, an aryloxycarbonyl group, a heterocyclic-oxycarbonyl group, a carbamoyl group, an N-hydroxycarbamoyl group, an N-acylcarbamoyl group, an N-sulfonylcarbamoyl group, an N-carbamoylcarbamoyl group, a thiocarbamoyl group, an N-sulfamoylcarbamoyl group, a carbazoyl group, a carboxy group and its salts, an oxalyl group, an oxamoyl group, a cyano group, a carbonimidoyl group, a formyl group, a hydroxyl group, an alkoxy group (including one that contains repetitive units of ethyleneoxy or propyleneoxy group), an aryloxy group, a heterocyclic-oxy group, an acyloxy group, an (alkoxy or aryloxy)carbonyloxy group, a carbamoyloxy group, a sulfonyloxy group, an amino group, an (alkyl, aryl or heterocyclic)amino group, an acylamino group, a sulfonamido group, an ureido group, a thioureido group, an N-hydroxyureido group, an imido group, an (alkoxy or aryloxy)carbonylamino group, a sulfamoylamino group, a semicarbazido group, a thiosemicarbazido group, a hydrazino group, an ammonio group, an oxamoylamino group, an N-(alkyl or aryl)sulfonylureido group, an N-acylureido group, an N-acylsulfamoylamino group, a hydroxyamino group, a nitro group, a quaternary nitrogen atom-containing heterocyclic group (e.g., pyridinio, imidazolio, quinolinio, and isoquinolinio groups), an isocyano group, an imino group, a mercapto group, an (alkyl, aryl or heterocyclic) thio group, an (alkyl, aryl or heterocyclic) dithio group, an (alkyl or aryl)sulfonyl group, an (alkyl or aryl)sulfinyl group, a sulfo group and its salts, a sulfamoyl group, an N-acylsulfamoyl group, an N-sulfonylsulfamoyl group and its salts, a phosphino group, a phosphinyl group, a phosphinyloxy group, a phosphinylamino group, and a silyl group. The active methine group means a methine group substituted with two electron attractive groups, in which examples of the electron attractive group include an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group and a carbonimidoyl group, and in which the two electron attractive groups may bond to each other to form a cyclic structure. The salt includes those with a cation of alkali metals, alkaline earth metals or heavy metals, and those with an organic cation such as ammonium or phosphonium ion.

Other examples of the adsorptive groups are described, for example, in JP-A No. 11-95355, pp. 4–7.

The adsorptive group represented by A in formula (I) is preferably a mercapto-substituted heterocyclic group (e.g., a 2-mercaptothiadiazole group, a 3-mercapto-1,2,4-triazole group, a 5-mercaptotetrazole group, a 2-mercapto-1,3,4-oxadiazole group, a 2-mercaptobenzothiazole group, a 2-mercaptobenzimidazole group, or a 1,5-dimethyl-1,2,4-triazolium-3-thiolate group), a dimercapto-substituted heterocyclic group (e.g., a 2,4-dimercaptopyrimidine group, a 2,4-dimercaptotriazine group, a 3,5-dimercapto-1,2,4-triazole group, or a 2,5-dimercapto-1,3-thiazole group), and a nitrogen-containing heterocyclic group that has, as the partial structure of the heterocyclic ring thereof, a group —NH— capable of forming imino silver (>NAg) (e.g., a benzotriazole group, a benzimidazole group, or an imidazole group). A dimercapto-substituted heterocyclic group is more preferable.

In formula (I), W represents a divalent linking group. The linking group may be any one not having any negative influence on the photographic properties of the heat-developable photosensitive material. For example, it may be a divalent linking group that comprises a carbon atom, a hydrogen atom, an oxygen atom, a nitrogen atom and/or a sulfur atom. Specific examples thereof include an alkylene group having from 1 to 20 carbon atoms (e.g., methylene, ethylene, trimethylene, tetramethylene, or hexamethylene), an arylene group having from 6 to 20 carbon atoms (e.g., phenylene, or naphthylene), $—CONR_1—$, $—SO_2NR_2—$, —O—, —S—, $—NR_3—$, $—NR_4CO—$, $—NR_5SO_2—$, $—NR_6CONR_7—$, COO—, —OCO— and combinations of such connection groups. $R_1$, $R_2$, $R_3$, $R_4$, $R_5$, $R_6$ and $R_7$ each represent a hydrogen atom, an aliphatic group or an aryl group. The aliphatic group represented by $R_1$, $R_2$, $R_3$, $R_4$, $R_5$, $R_6$ and $R_7$ preferably has 1 to 30 carbon atoms and is preferably a linear, branched or cyclic alkyl group having 1 to 20 carbon atoms, alkenyl group, alkynyl group or aralkyl group. Examples of such an aliphatic group include a methyl group, an ethyl group, an isopropyl group, a t-butyl group, a n-octyl group, a n-decyl group, a n-hexadecyl group, a cyclopropyl group, a cyclopentyl group, a cyclohexyl group, an allyl group, a 2-butenyl group, a 3-pentenyl group, a propargyl group, a 3-pentynyl group, and a benzyl group. In the formula (I), the aryl group represented by $R_1$, $R_2$, $R_3$, $R_4$, $R_5$, $R_6$ and/or $R_7$ is preferably a monocyclic or condensed cyclic aryl group having 6 to 30 carbon atoms, or more preferably 6 to 20 carbon atoms, and, for example, a phenyl group or a naphthyl group. The substituent represented by $R_1$, $R_2$, $R_3$, $R_4$, $R_5$, $R_6$ and/or $R_7$ may further have any desired substituent. The substituent has the same meaning as those mentioned hereinabove as the substituent of the adsorptive group.

In formula (I), the reducing group represented by B is a group that can reduce silver ions. Examples thereof include a formyl group, an amino group, a triple bond group such as an acetylene group or propargyl group, an alkylmercapto group or an arylmercapto group, hydroxylamines, hydroxamic acids, hydroxyureas, hydroxyurethanes, hydroxysemicarbazides, reductones (including reductone derivatives), anilines, phenols (including chroman-6-ols, 2,3-dihydrobenzofuran-5-ols, aminophenols, sulfonamide phenols, and polyphenols such as hydroquinones, catechols, resorcinols, benzene triols and bisphenols), hydrazines, hydrazides, and phenidones Hydroxylamines are represented by formula ($B_1$), hydroxamic acids are represented by formula ($B_2$), hydroxylureas are represented by formula ($B_3$), hydroxyurethanes are represented by formula ($B_4$), hydroxysemicarbazides are represented by formula ($B_5$), reductones are represented by formula ($B_6$), anilines are represented by formula ($B_7$), phenols are represented by formula ($B_8$), ($B_9$) or ($B_{10}$), hydrazines are represented by formula ($B_{11}$), hydrazides are represented by formula ($B_{12}$), and phenidones are represented by formula ($B_{13}$).

($B_1$)

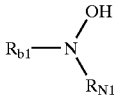

($B_2$)

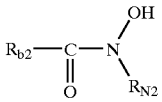

($B_3$)

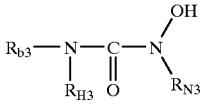

($B_4$)

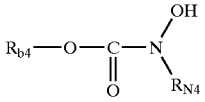

($B_5$)

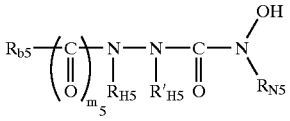

($B_6$)

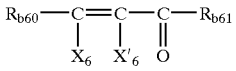

($B_7$)

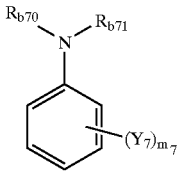

($B_8$)

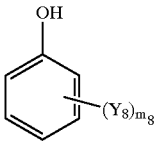

($B_9$)

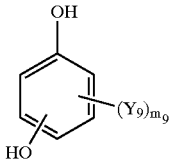

-continued ($B_{10}$)

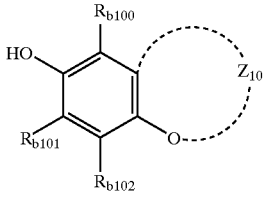

($B_{11}$)

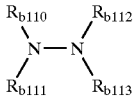

($B_{12}$)

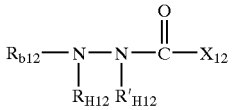

($B_{13}$)

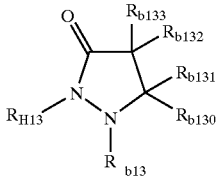

In formulae ($B_1$) to ($B_{13}$), $R_{b1}$, $R_{b2}$, $R_{b3}$, $R_{b4}$, $R_{b5}$, $R_{b70}$ $R_{b71}$, $R_{b110}$, $R_{b111}$, $R_{b112}$, $R_{b113}$, $R_{b12}$, $R_{b13}$, $R_{N1}$, $R_{N2}$, $R_{N3}$, $R_{N4}$ and $R_{N5}$ each represent a hydrogen atom, an alkyl group, an aryl group or a heterocyclic group; $R_{H3}$, $R_{H5}$, $R'_{H5}$, $R_{H12}$, $R'_{H12}$ and $R_{H13}$ each represent a hydrogen atom, an alkyl group, an aryl group, an acyl group, an alkylsulfonyl group or an arylsulfonyl group. $R_{H3}$ may also be a hydroxyl group. $R_{b100}$, $R_{b101}$, $R_{b102}$, $R_{b130}$ to $R_{b133}$ each represent a hydrogen atom or a substituent. $Y_7$ and $Y_8$ each represent a substituent except hydroxyl group. $Y_9$ represents a substituent, $m_5$ indicates 0 or 1, $m_7$ indicates an integer of from 0 to 5, $m_8$ indicates an integer of from 1 to 5, and $m_9$ indicates an integer of from 0 to 4. $Y_7$, $Y_8$ and $Y_9$ may also be an aryl group condensed with the benzene ring (e.g., benzene-condensed ring), which may be further substituted. $Z_{10}$ represents a non-metallic atomic group capable of forming a ring; $X_{12}$ represents a hydrogen atom, an alkyl group, an aryl group, a heterocyclic group, an alkoxy group, an amino group (including an alkylamino group, an arylamino group, a heterocyclic amino group and a cyclic amino group), or a carbamoyl group.

In formula ($B_6$), $X_6$ and $X'_6$ each represent a hydroxyl group, an alkoxy group, a mercapto group, an alkylthio group, an amino group (including an alkylamino group, an arylamino group, a heterocyclic amino group and a cyclic amino group), an acylamino group, a sulfonamido group, an alkoxycarbonylamino group, an ureido group, an acyloxy group, an acylthio group, an alkylaminocabonyloxy group, or an arylaminocarbonyloxy group. $R_{b60}$ and $R_{b61}$ each represent an alkyl group, an aryl group, an amino group, an alkoxy group, or an aryloxy group, and $R_{b60}$ and $R_{b61}$ may bond to each other to form a cyclic structure.

In the descriptions of the groups in formulae ($B_1$) to ($B_{13}$), the alkyl group means a linear, branched or cyclic, substituted or unsubstituted alkyl group having from 1 to 30 carbon atoms; the aryl group means a monocyclic or condensed cyclic, substituted or unsubstituted aromatic hydrocarbon ring such as a phenyl group or a naphthyl group; and the heterocyclic group means an aromatic or non-aromatic, monocyclic or condensed cyclic, substituted or unsubstituted heterocyclic group that has at least one hetero atom.

The substituent that is referred to in the descriptions of the groups in formulae ($B_1$) to ($B_{13}$) may have the same meaning as that of the substituent of the above-mentioned adsorptive group. The substituents may be further substituted with any other substituent.

In formulae ($B_1$) to ($B_5$), $R_{N1}$, $R_{N2}$, $R_{N3}$, $R_{N4}$ and $R_{N5}$ each are preferably a hydrogen atom or an alkyl group. The alkyl group is preferably a linear, branched or cyclic, substituted or unsubstituted alkyl group having from 1 to 12 carbon atoms, more preferably a linear or branched, substituted or unsubstituted alkyl group having from 1 to 6 carbon atoms, such as a methyl group, an ethyl group, a propyl group or a benzyl group.

In formula ($B_1$), $R_{b1}$ is preferably an alkyl group or a heterocyclic group. The alkyl group is a linear, branched or cyclic, substituted or unsubstituted alkyl group preferably having from 1 to 30 carbon atoms, and more preferably from 1 to 18 carbon atoms. The heterocyclic group is a 5-membered or 6-membered, monocyclic or condensed cyclic, aromatic or non-aromatic heterocyclic group, which may be substituted. The heterocyclic group is preferably an aromatic heterocyclic group, including, for example, a pyridine ring group, a pyrimidine ring group, a triazine ring group, a thiazole ring group, a benzothiazole ring group, an oxazole ring group, a benzoxazole ring group, an imidazole ring group, a benzimidazole ring group, a pyrazole ring group, an indazole ring group, an indole ring group, a purine ring group, a quinoline ring group, an isoquinoline ring group, and a quinazoline ring group. A triazine ring group and a benzothiazole ring group are particularly preferable. Compounds of formula ($B_1$) in which the alkyl or heterocyclic group represented by $R_{b1}$ has one or more substituents —N($R_{N1}$)OH are also preferable.

In formula ($B_2$), $R_{b2}$ is preferably an alkyl group, an aryl group or a heterocyclic group, and more preferably an alkyl group or an aryl group. The preferred range of the alkyl group may be the same as that mentioned hereinabove for $R_{b1}$. The aryl group is preferably a phenyl group or a naphthyl group, and more preferably a phenyl group, which may be substituted. Compounds of formula ($B_2$) in which the group represented by $R_{b2}$ has one or more substituents —CON($R_{N2}$) OH are also preferable.

In formula ($B_3$), $R_{b3}$ is preferably an alkyl group or an aryl group. Their preferred range may be the same as that mentioned hereinabove for $R_{b1}$ and $R_{b2}$. $R_{H3}$ is preferably a hydrogen atom, an alkyl group or a hydroxyl group, and more preferably a hydrogen atom. Compounds of formula ($B_3$) in which the group represented by $R_{b3}$ has one or more substituents —N($R_{H3}$)CON($R_{H3}$)OH are also preferable. $R_{b3}$ and $R_{N3}$ may bond to each other to form a cyclic structure (preferably a 5-membered or 6-membered saturated heterocyclic ring).

In formula ($B_4$), $R_{b4}$ is preferably an alkyl group, and its preferred range may be the same as that mentioned hereinabove for $R_{b1}$. Compounds of formula ($B_4$) in which the group represented by $R_{b4}$ has one or more substituents —OCON($R_{N4}$)OH are also preferable.

In formula ($B_5$), $R_{b5}$ is preferably an alkyl group or an aryl group, and more preferably an aryl group. Their preferred range may be the same as that mentioned hereinabove for $R_{b1}$ and $R_{b2}$. $R_{H5}$ and $R'_{H5}$ each are preferably a hydrogen atom or an alkyl group, and more preferably a hydrogen atom.

In formula ($B_6$), $R_{b60}$ preferably bonds to $R_{b61}$ to form a cyclic structure. The cyclic structure may be a 5-membered to 7-membered, non-aromatic carbocyclic or heterocyclic, monocyclic or condensed cyclic ring. Preferred examples of the cyclic structure are a 2-cyclopenten-1-one ring, a 2,5-dihydrofuran-2-one ring, a 3-pyrrolin-2-one ring, a 4-pyrazolin-3-one ring, a 2-cyclohexen-1-one ring, a 5,6-dihydro-2H-pyran-2-one ring, a 5,6-dihydro-2-pyridone ring, a 1,2-dihydronaphthalen-2-one ring, a coumarin ring (a benzo-α-pyran-2-one ring), a 2-quinolone ring, a 1,4-dihydronaphthalen-1-one ring, a chromone ring (a benzo-γ-pyran-4-one ring), a 4-quinolone ring, an inden-1-one ring, a 3-pyrroline-2,4-dione ring, an uracil ring, a thiouracil ring, and a dithiouracil ring. A 2-cyclopenten-1-one ring, a 2,5-dihydrofuran-2-one ring, a 3-pyrrolin-2-one ring, a 4-pyrazolin-3-one ring, a 1,2-dihydronaphthalen-2-one ring, a coumarin ring (a benzo-α-pyran-2-one ring), a 2-quinolone ring, a 1,4-dihydronaphthalen-1-one ring, a chromone ring (a benzo-γ-pyran-4-one ring), a 4-quinolone ring, an inden-1-one ring, and a dithiouracil ring are more preferable, and a 2-cyclopenten-1-one ring, a 2,5-dihydrofuran-2-one ring, a 3-pyrrolin-2-one ring, an inden-1-one ring, and a 4-pyrazolin-3-one ring is still more preferable.

When $X_6$ and $X'_6$ each are a cyclic amino group, the cyclic amino group is a non-aromatic nitrogen-containing heterocyclic group that bonds to the compound via its nitrogen atom. Examples thereof include a pyrrolidino group, a piperidino group, a piperazino group, a morpholino group, a 1,4-thiazin-4-yl group, a 2,3,5,6-tetrahydro-1,4-thiazin-4-yl group, and an indolyl group.

$X_6$ and $X'_6$ each are preferably a hydroxyl group, a mercapto group, an amino group (including an alkylamino group, an arylamino group and a cyclic amino group), an acylamino group, a sulfonamido group, an acyloxy group or an acylthio group, more preferably a hydroxyl group, a mercapto group, an amino group, an alkylamino group, a cyclic amino group, a sulfonamido group, an acylamino group or an acyloxy group, and even more preferably a hydroxyl group, an amino group, an alkylamino group, or a cyclic amino group. Still preferably, at least one of $X_6$ and $X'_6$ is a hydroxyl group.

In formula ($B_7$), $R_{b70}$ and $R_{b71}$ each are preferably a hydrogen atom, an alkyl group or an aryl group, and more preferably an alkyl group. The preferred range of the alkyl group may be the same as that mentioned hereinabove for $R_{b1}$. $R_{b70}$ and $R_{b71}$ may bond to each other to form a cyclic structure (e.g., a pyrrolidine ring, a piperidine ring, a morpholine ring, or a thiomorpholine ring). The substituent represented by $Y_7$ is preferably an alkyl group (its preferred range may be the same as that mentioned hereinabove for $R_{b1}$), an alkoxy group, an amino group, an acylamino group, a sulfonamido group, an ureido group, an acyl group, an alkoxycarbonyl group, a carbamoyl group, a sulfamoyl group, a chlorine atom, a sulfo group or its salt, or a carboxyl group or its salt; and $m_7$ is preferably from 0 to 2.

In formula ($B_8$), $m_8$ is preferably from 1 to 4, and $Y_8$s may be the same or different. $Y_8$ when $m_8$ is 1, or at least one of $Y_8$s when $m_8$ is 2 or more is preferably an amino group (including an alkylamino group and an arylamino group), a sulfonamido group or an acylamino group. When $m_8$ is 2 or more, the remaining $Y_8$s are preferably any of a sulfonamido group, an acylamino group, an ureido group, an alkyl group, an alkylthio group, an acyl group, an alkoxycarbonyl group, a carbamoyl group, a sulfo group or its salt, a carboxyl group or its salt, or a chlorine atom. When the substituent represented by $Y_8$ is further substituted at the ortho or para-position of the hydroxyl group, with an o'- (or p'-) hydroxyphenylmethyl group (that may be optionally substituted), the compounds are bisphenols and they are preferred examples of formula ($B_8$). It is also preferable that $Y_8$ is a benzene-condensed ring and therefore the formula ($B_8$) represents naphthols.

In formula ($B_9$), the hydroxy substituents may be ortho-positioned (catechols) or meta-positioned (resorcinols) or para-positioned (hydroquinones) relative to each other. $m_9$ is preferably 1 or 2, and $Y_9$s may be the same or different. The substituent represented by $Y_9$ is preferably a chlorine atom, an acylamino group, an ureido group, a sulfonamido group, an alkyl group, an alkylthio group, an alkoxy group, an acyl group, an alkoxycarbonyl group, a carbamoyl group, a sulfo group or its salt, a carboxyl group or its salt, a hydroxyl group, an alkylsulfonyl group, or an arylsulfonyl group. It is also preferable that $Y_9$ is a benzene-condensed ring and therefore formula ($B_9$) represents 1,4-naphthohydroquinones. When formula ($B_9$) represents catechols, $Y_9$ is especially preferably a sulfo group or its salt, or a hydroxyl group.

When $R_{b100}$, $R_{b101}$ and $R_{b102}$ in formula ($B_{10}$) each are a substituent, preferred examples of the substituent may be the same as those mentioned hereinabove for $Y_9$. The substituent is specially preferably is an alkyl group (more preferably, a methyl group). The cyclic structure which $Z_{10}$ forms is preferably a chroman ring or a 2,3-dihydrobenzofuran ring, which may be substituted. In addition, the cyclic structure may form a spiro ring.

In formula ($B_{11}$), $R_{b110}$, $R_{b111}$, $R_{b112}$ and $R_{b113}$ each are preferably an alkyl group, an aryl group or a heterocyclic group, and their preferred range may be the same as that mentioned hereinabove for $R_{b1}$ and $R_{b2}$. An alkyl group is especially preferable. Two alkyl groups of $R_{b110}$ to $R_{b113}$ may bond to each other to form a cyclic structure. The cyclic structure may be a 5-membered or 6-membered non-aromatic heterocyclic ring, including, for example, a pyrrolidine ring, a piperidine ring, a morpholine ring, a thiomorpholine ring, and a hexahydropyridazine ring.

In formula ($B_{12}$), $R_{b12}$ is preferably an alkyl group, an aryl group or a heterocyclic group, and its preferred range may be the same as that mentioned hereinabove for $R_{b1}$ and $R_{b2}$. $X_{12}$ is preferably an alkyl group, aryl group (especially a phenyl group), a heterocyclic group, an alkoxy group, an amino group (including an alkylamino group, an arylamino group, a heterocyclic amino group and a cyclic amino group), or a carbamoyl group, and more preferably an alkyl group (even more preferably those having from 1 to 8 carbon atoms, an aryl group (even more preferably a phenyl group), or an amino group (including an alkylamino group, an arylamino group and a cyclic amino group). $R_{H12}$ and $R'_{H12}$ each are preferably a hydrogen atom or an alkyl group, and more preferably a hydrogen atom.

In formula ($B_{13}$), $R_{b13}$ is preferably an alkyl group or an aryl group, and its preferred range may be the same as that mentioned hereinabove for $R_{b1}$ and $R_{b2}$. $R_{b130}$, $R_{b131}$, $R_{b132}$ and $R_{b133}$ each are preferably a hydrogen atom, an alkyl group (more preferably those having from 1 to 8 carbon atoms), or an aryl group (more preferably a phenyl group). $R_{H13}$ is preferably a hydrogen atom or an acyl group, an d more preferably a hydrogen atom.

In formula (I), the reducing group represented by B is preferably hydroxylamines, hydroxamic acids, hydroxyureas, hydroxysemicarbazides, phenols, hydrazines, hydrazides or phenidones, and more preferably hydroxyureas, hydroxysemicarbazides, phenols, hydrazides or phenidones.

In formula (I), the oxidation potential of the reducing group represented by B may be measured according to the process described in Akira Fujishima, *Electrochemically Measuring Method*, pp. 150–208 (by Gihodo Publishing) or in Lecture of *Experimental Chemistry,* 4th Ed., Vol. 9, pp. 282–344 by the Chemical Society of Japan (by Maruzen). For example, it may be measured through rotary disc voltammetry. Concretely, a sample is dissolved in a mixed solution of methanol and a Britton-Robinson buffer having a pH of 6.5 at a volume ratio of 10%/90%, and nitrogen gas is introduced to the resultant for 10 minutes. A rotary disc electrode of glassy carbon is used as a working electrode, and a platinum wire is used as a counter electrode, and a saturated calomel electrode is used as a reference electrode. At 25° C., at a revolution of 1000 rpm and at a sweeping rate of 20 mV/sec, the sample solution is analyzed. From the voltamograph thus obtained, the half-wave potential (E1/2) of the sample is obtained.

When measured according to the method mentioned above, the oxidation potential of the reducing group B in the invention is preferably from about −0.3 V to about 1.0 V, more preferably from about −0.1 V to about 0.8 V, and even more preferably from about 0 to about 0.7 V.

Most compounds having the reducing group B are known in the art of photography. Their examples are described in many patent references, for example, JP-A No. 2001-42466 (compounds represented by the formula ([0208])—(*) and examples of the compounds), JP-A Nos. 8-114884, 8-314051, 8-333325, 9-133983, 11-282117, 10-246931, 10-90819, 9-54384, 10-171060, 7-77783. Further, examples of the phenols also include compounds described in U.S. Pat. No. 6,054,260 (a formula and examples of compounds thereof described in columns 60 to 63).

The compounds of formula (I) for use in the invention may have a ballast group or a polymer chain that is generally used in immobile photographic additives such as couplers. The polymer may be, for example, those mentioned in JP-A No. 1-100530.

The compounds of formula (I) may be in any form of bis compounds or tris compounds. Preferably, the compounds of formula (I) have a molecular weight of from 100 to 10000, more preferably from 120 to 1000, and even more preferably from 150 to 500.

Examples of the compounds of formula (I) are mentioned below, however, the invention is not limited thereto.

(1)

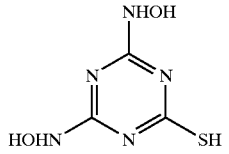

(2)

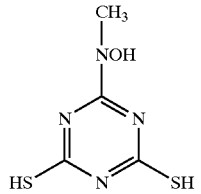

-continued
(3)
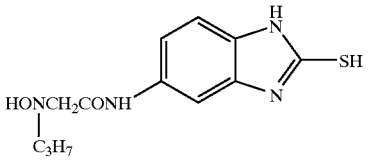
(4)
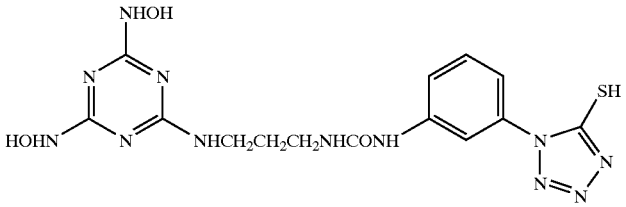
(5)
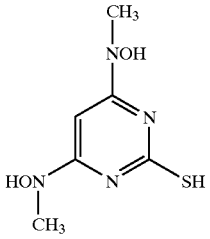
(6)
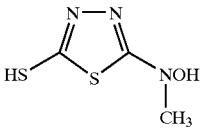
(7)
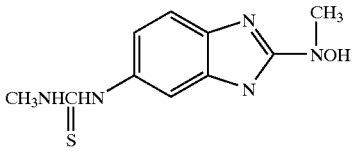
(8)
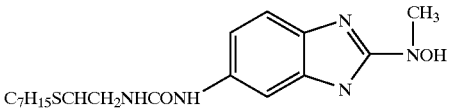
(9)
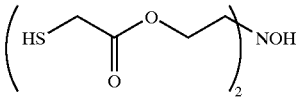
(10)
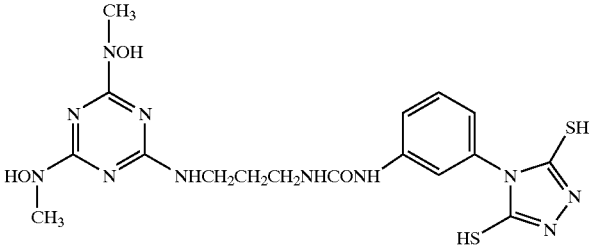
(11)
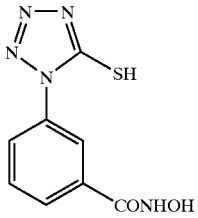
(12)
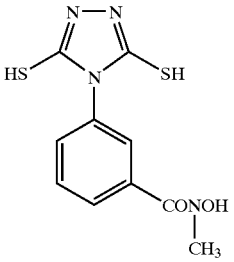
(13)
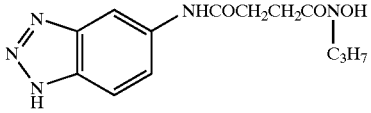
(14)
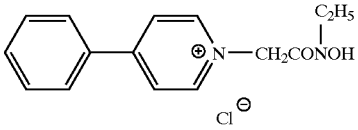

-continued
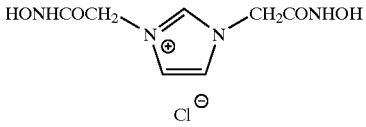
(15)
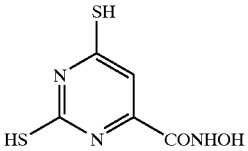
(16)
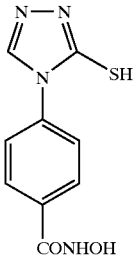
(17)
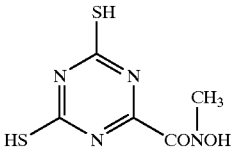
(18)
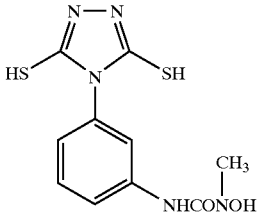
(19)
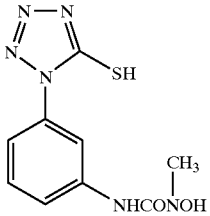
(20)
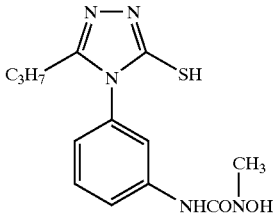
(21)
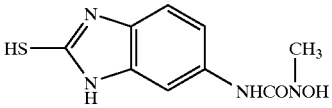
(22)
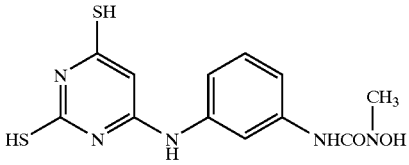
(23)
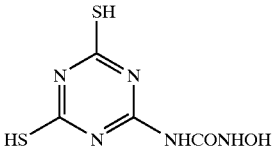
(24)
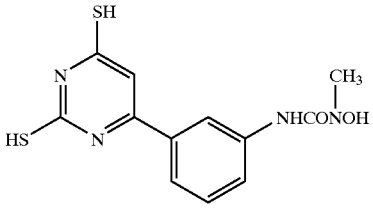
(25)
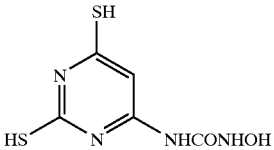
(26)
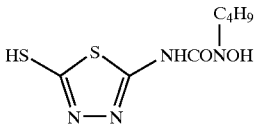
(27)
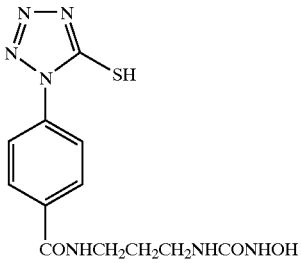
(28)

-continued
(29)
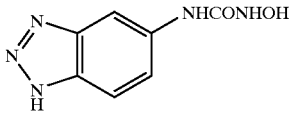
(30)
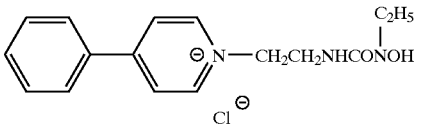
(31)
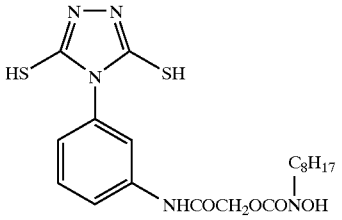
(32)
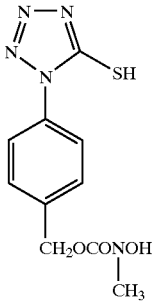
(33)
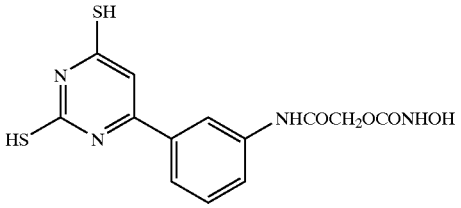
(34)
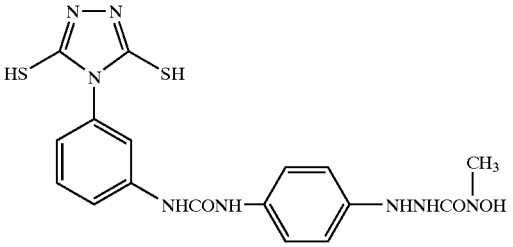
(35)
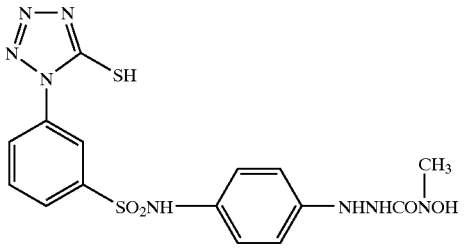
(36)
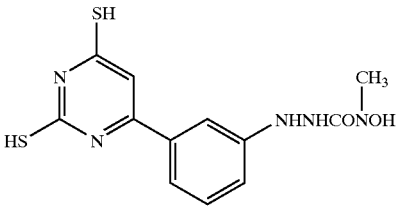
(37)
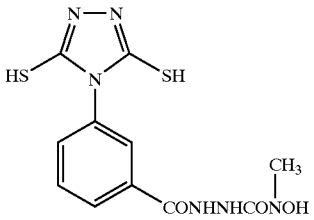
(38)
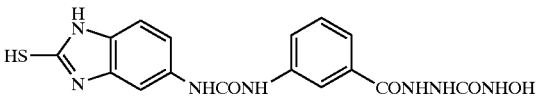
(39)
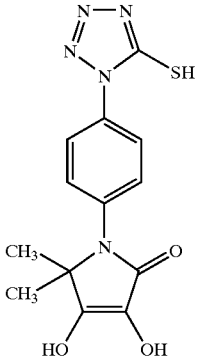
(40)
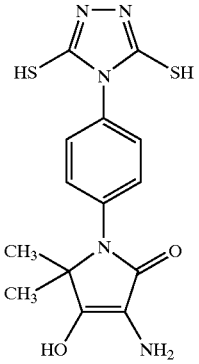

-continued
(41)
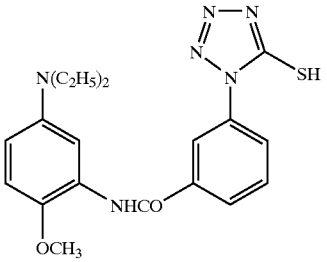
(42)
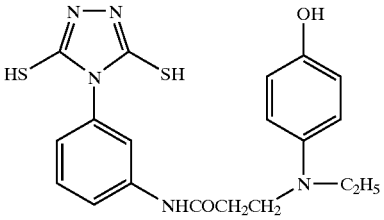
(43)
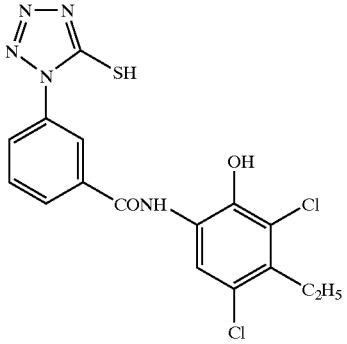
(44)
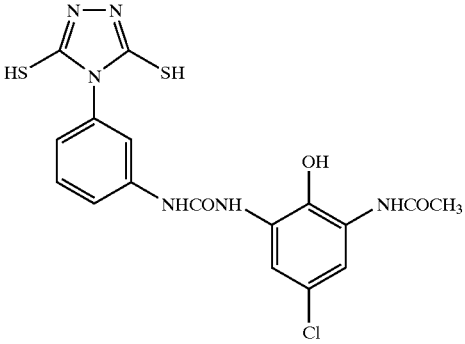
(45)
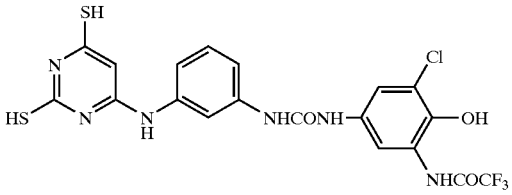
(46)
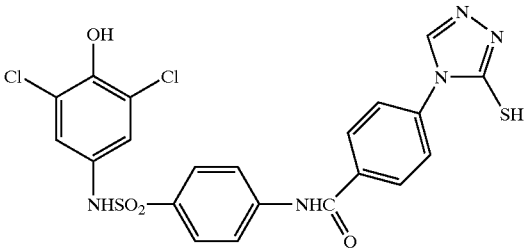
(47)
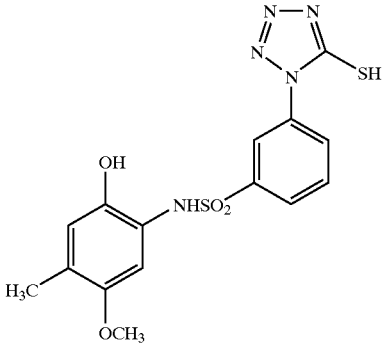
(48)
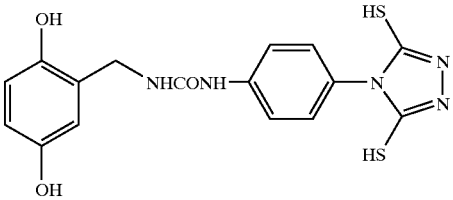
(49)
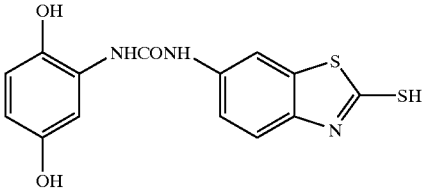
(50)
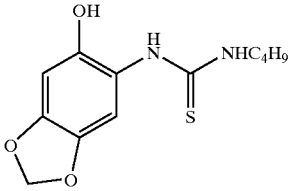
(51)
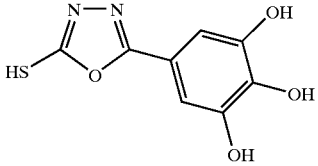
(52)
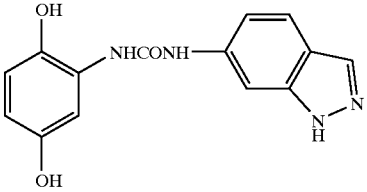

-continued
(53)
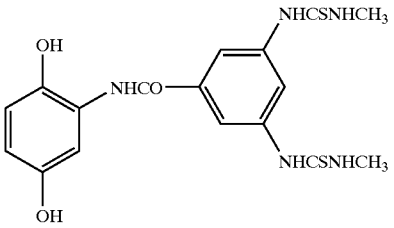
(54)
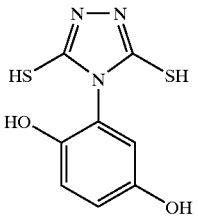
(55)
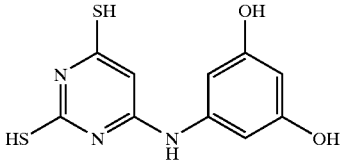
(56)
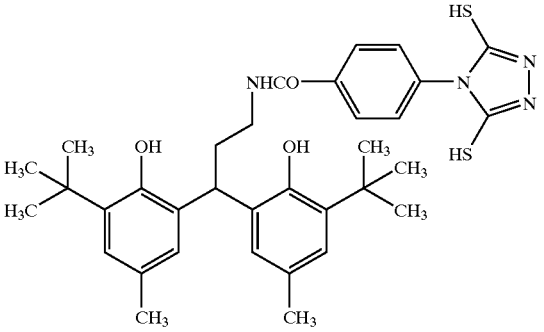
(57)
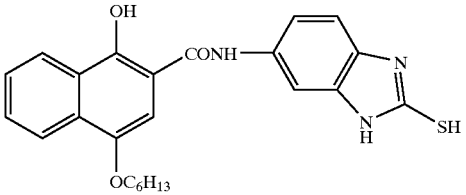
(58)
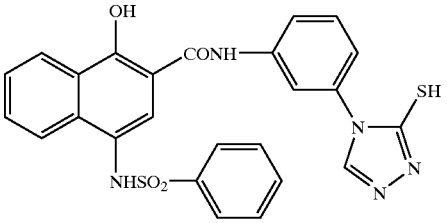
(59)
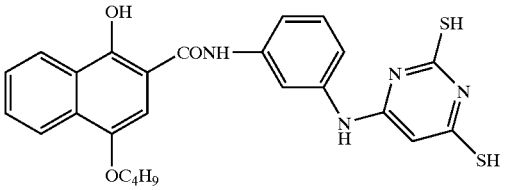
(60)
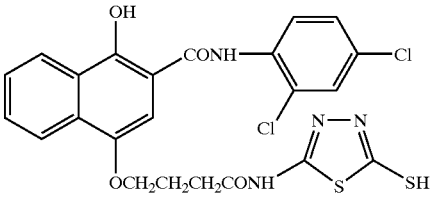
(61)
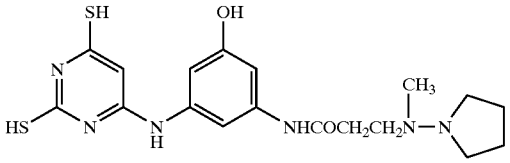
(62)
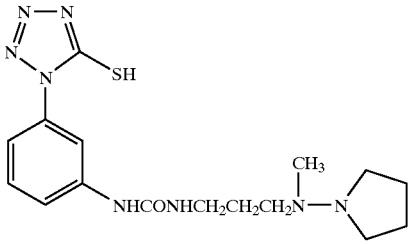
(63)
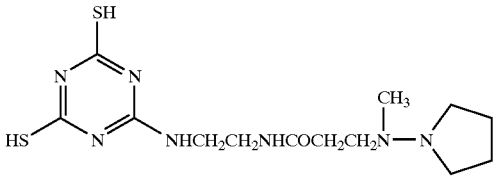
(64)
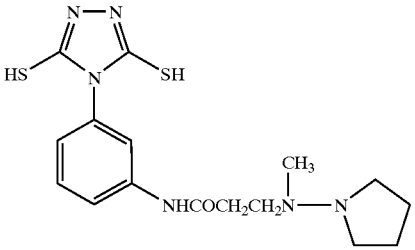

-continued
(65)
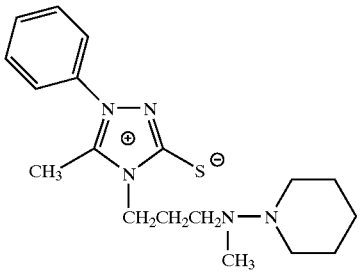
(66)
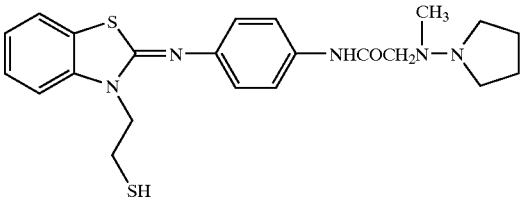
(67)
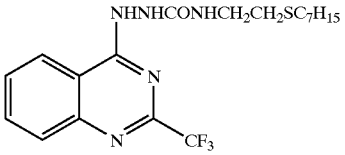
(68)
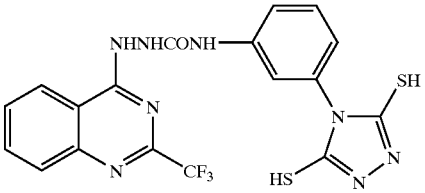
(69)
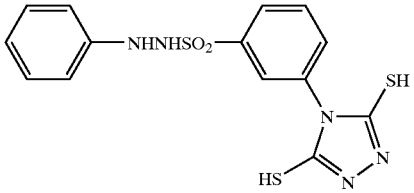
(70)
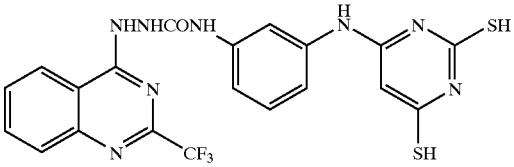
(71)
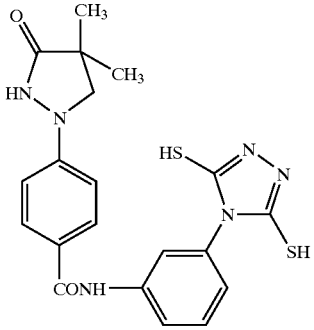
(72)
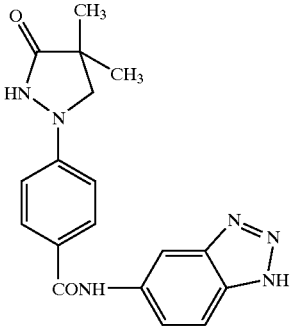
(73)
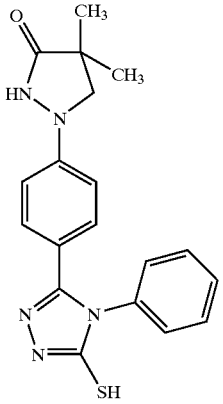
(74)
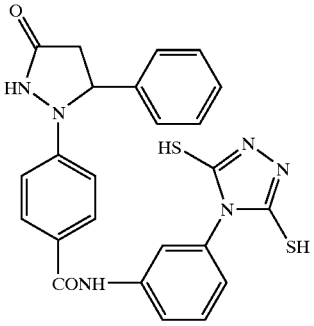

-continued
(75)
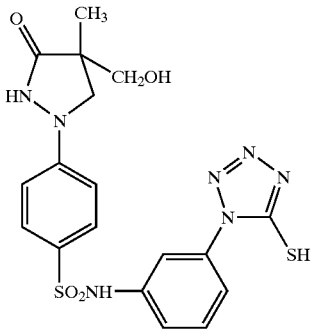
(76)
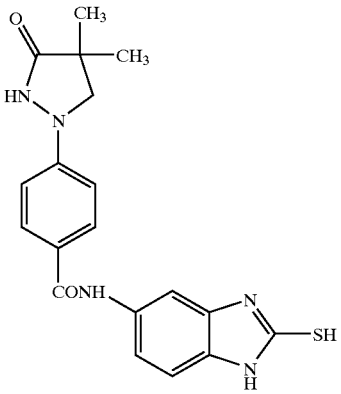
(77)
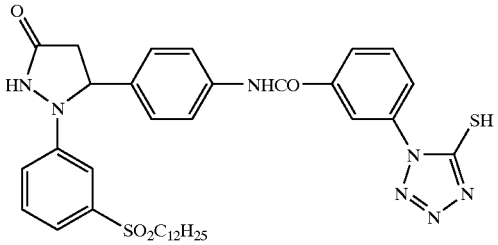
(78)
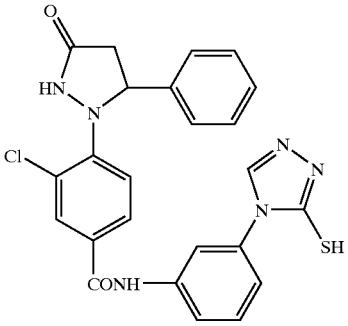
(79)
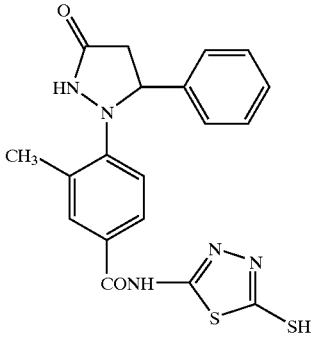
(80)
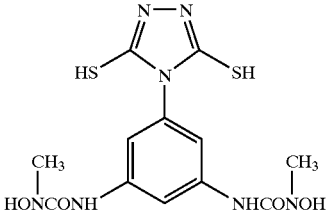
(81)
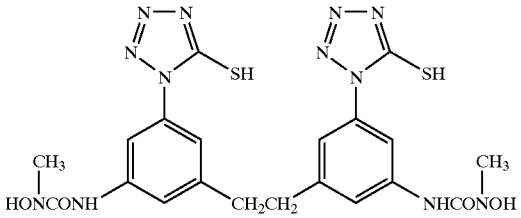
(82)
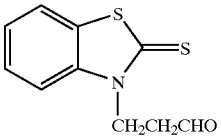
(83)
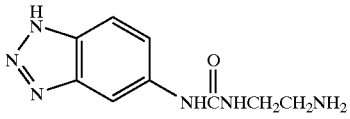
(84)
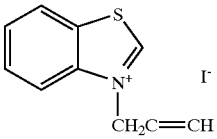
(85)
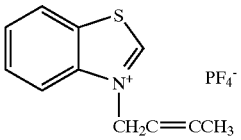
(86)
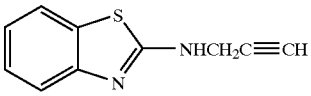

-continued (87)

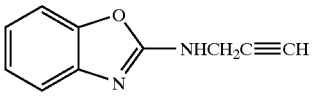

(88)

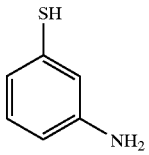

(89)

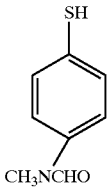

(90)

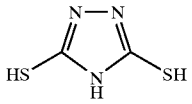

(91)

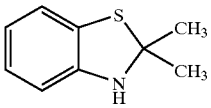

(92)

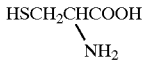

(93)

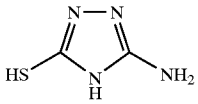

(94)

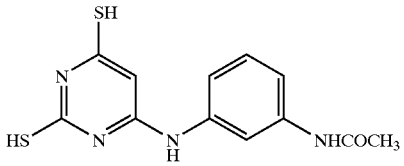

(95)

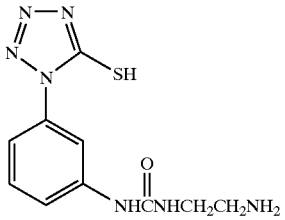

(96)

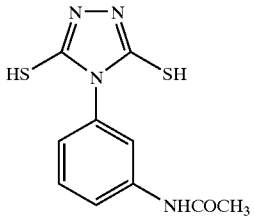

The compounds for use in the invention may be readily produced in any known manner.

One of the compounds of formula (I) may be used alone in the invention or at least two of the compounds of formula (I) may be used in combination. When two or more compounds are used together, they may be added to the same layer or may be separately added to different layers. They may be added in the same manner or in different methods.

Preferably, the compound of formula (I) is added to a silver halide emulsion layer, more preferably to such a layer during preparation of the emulsion. When the compound is added to the emulsion during preparation of the emulsion, it may be added thereto in any stage of emulsion production. For example, the compound may be added to the emulsion during preparation of silver halide grains, or may be added thereto before the start of desalting, during desalting, before the start of chemical ripening, during chemical ripening, or before formulation of the finished emulsion. The compound may be divided into some portions and they may be separately added to the emulsion in these steps. Preferably, the compound is added to an emulsion layer, but it may also be added to a protective layer or an interlayer that is adjacent to the emulsion layer so that it may diffuse into the adjacent emulsion layer.

The preferred addition amount of the compound of formula (I) greatly depends on the addition method described above or species of the compounds to be added. It is generally $1\times10^{-6}$ to 1 mol, preferably $1\times10^{-5}$ to $5\times10^{-1}$ mol and more preferably $1\times10^{-4}$ to $1\times10^{-1}$ mol per mol of the photosensitive silver halide.

The compound of formula (I) to be added may be dissolved in water or in a water-soluble solvent such as methanol or ethanol, or in a mixed solvent of these. In this stage, the pH of the solution may be suitably controlled by an acid or a base, or a surfactant may be added to the solution. The compound to be added may also be dispersed in a high-boiling-point organic solvent to for man emulsified dispersion. The compound may also be added in the form of a solid dispersion thereof.

11) Combined Use of Silver Halides:

The heat-developable photosensitive material of the invention may contain only one type or two or more different types of photosensitive silver halide grains (these may differ in their mean grain size, halogen composition or crystal habit, or in conditions of their chemical sensitization). Combining two or more types of photosensitive silver halide grains differing in their sensitivity enables control of the gradation of the images to be formed in the heat-developable photosensitive material. Such technique is disclosed in, for example, JP-A Nos. 57-119341, 53-106125, 47-3929, 48-55730, 46-5187, 50-73627 and 57-150841. Combining silver halide grains is preferably conducted such that the diference between sensitivities of the respective emulsions is at least 0.2 log E.

4) Mixing of Photosensitive Silver Halide and Organic Silver Salt

The photosensitive silver halide grains in the invention are particularly preferably formed and sensitized chemically in the absence of a non-photosensitive organic silver salt.

This is because in some cases a sufficient sensitivity cannot be attained in a method of forming silver halide by adding a halogenating agent to an organic silver salt.

Examples of a method of mixing the silver halide and the organic silver salt include a method of mixing the photosensitive silver halide and the organic silver salt prepared separately with a high speed stirrer, a ball mill, a sand mill, a colloid mill, a vibration mill or a homogenizer, and a method of adding the photosensitive silver halide already prepared to a system for forming an organic silver salt during preparation of the organic silver salt and then completing the preparation. Both methods can provide preferably the effect of the invention.

5) Adding of Silver Halide to Coating Liquid

The preferred time at which the silver halide grains are added to the coating liquid for forming an image-forming layer of the heat-developable photosensitive material of the invention may be from 180 minutes before coating the liquid to a time just before the coating, preferably from 60 minutes before the coating to 10 seconds before it. However, there is no specific limitation on mixing methods and mixing conditions, so far as the method and the conditions employed to add the grains to the coating liquid ensure the advantages of the invention. Specific examples of mixing methods include a method of adding the grains to the coating liquid in a tank in such a controlled manner that the mean residence time in the tank, which is calculated from the addition amount of the grains and the flow rate of the coating liquid to a coater, can be a predetermined period of time; and a method of mixing them with a static mixer disclosed in *Liquid Mixing Technology*, Chapter 8 (written by N. Harnby, M. F. Edwards & A. W. Nienow, translated by Koji Takahasi, and published by Nikkan Kogyo Shinbun in 1989).

Organic Silver Salt

1) Composition

The organic silver salt for use in the invention is relatively stable to light, but, when heated at 80° C. or higher in the presence of an exposed photosensitive silver halide and a reducing agent, it serves as a silver ion donor and forms a silver image. The organic silver salt may be any organic substance capable of donating a silver ion that may be reduced by a reducing agent. Some non-photosensitive organic silver salts of that type are described, for example, in JP-A No. 10-62899, paragraphs [0048] to [0049]; EP-A No. 0803764A1, from page 18, line 24 to page 19, line 37; EP-A No. 0962812A1; JP-A Nos. 2000-7683 and 2000-72711. Silver salts of organic acids, especially silver salts of long-chain (chain having 10 to 30 carbon atoms, preferably having 15 to 28 carbon atoms) aliphatic carboxylic acids, are preferable. Preferred examples of silver salts of fatty acids are silver lignocerate, silver behenate, silver arachidate, silver stearate, silver oleate, silver laurate, silver caproate, silver myristate, silver palmitate, silver erucate, and their mixtures. In the first aspect of the invention, silver salts of fatty acids having a silver behenate content of from 50 mol % to 100 mol %, preferably from 85 mol % to 100 mol %, more preferably from 95 mol % to 100 mol %, are prefearble. In the second aspect of the invention, silver salts of fatty acids having a silver behenate content of from 50 mol % to 100 mol %, more preferably from 75 mol % to 98 mol %, are preferable. The silver salts of fatty acids preferably have a silver erucate content of at most 2 mol %, more preferably at most 1 mol %, and even more preferably at most 0.1 mol %.

Also, the silver stearate content of the organic silver salts is preferably at most 1 mol %. The silver salts of organic acids of the type having a silver stearate content of at most 1 mol % enable the heat-developable photosensitive material of the invention to have low Dmin, high sensitivity and good image storability. The silver stearate content is more preferably at most 0.5 mol %, and even more preferably substantially zero.

When the silver salts of organic acids contains silver arachidate, it is preferable that the silver arachidate content thereof is at most 6 mol %, and more preferably at most 3 mol % in order that the heat-developable photosensitive material may have lower Dmin and excellent image storability.

2) Shape

The shape of organic silver salt grains for use in the invention is not specifically limited, and the grains may be in any of acicular, rod-like, tabular or scaly grains.

Scaly organic silver salt grains are preferred for use in the invention. Also, those having the ratio of major axis/minor axis of 5 or less, including short acicular, rectangular-parallelepiped or cubic grains, and irregular grains such as potato-like grains, are preferable. These organic silver salt grains are characterized in that they are more effective for preventing fog in heat development of heat-developable photosensitive materials than long acicular grains having the ratio of major axis/minor axis of 5 or more. In particular, the grains having the ratio of major axis/minor axis of at most 3 are preferred since the mechanical stability of the coated films is good. The scaly organic silver salt is defined as follows: A sample of an organic acid silver salt to be analyzed is observed with an electronic microscope, and the grains of the salt seen in the field are approximated to rectangular parallelopipedons. The three different edges of the rectangular parallelopiped one thus-approximated are represented by a, b and c. a is the shortest, c is the longest, and b and c may be the same. From the shorter edges a and b, x is obtained according to the following equation:

$$x=b/a$$

About 200 grains seen in the field are analyzed to obtain the value x, and the data of x are averaged. Samples that satisfy the requirement of x (average)≧1.5 are scaly. The requirement is preferably 30≧x (average)≧1.5, and more preferably 15≧x (average)≧1.5. In this connection, the grains satisfying a range of 1≦x (average)<1.5 are regarded as acicular.

In the scaly grains, a can be regarded as the thickness of tabular grains whose main plane is represented by b×c. In the scaly organic silver salt grains for use herein, a (average) is preferably 0.01 μm to 0.3 μm, and more preferably 0.1 μm to 0.23 μm; and c/b (average) is preferably 1 to 9, more preferably 1 to 6, even more preferably 1 to 4, still more preferably 1 to 3, and most preferably 1 to 2.

When the sphere-corresponding diameter of the organic silver salt grain for use in the invention (diameter of a sphere having the same volume as the grain) is from 0.05 μm to 1 μm, then the grains hardly aggregate in the heat-developable photosensitive material and the image storability of the material is therefore good. The sphere-corresponding diameter is more preferably from 0.1 μm to 1 μm. The sphere-corresponding diameter of the grains may be determined as follows: Using an electronic microscope, a sample of an organic silver salt to be analyzed is directly photographed, and the resulting negative picture is processed and analyzed.

The ratio of sphere-corresponding diameter/a of the scaly grains is defined as an aspect ratio. The aspect ratio of the scaly grains is preferably 1.1 to 30, and more preferably 1.1 to 15, since the grains of the type hardly aggregate in the heat-developable photosensitive material and the image storability of the material is therefore good.

Regarding its grain size distribution, the organic silver salt is preferably a mono-dispersed one. Mono-dispersion of grains referred to herein is such that the percentage of a value obtained by dividing the standard deviations of the minor axis and the major axis of each grain by the minor axis and the major axis thereof, respectively, is preferably at most 100%, more preferably at most 80%, and even more preferably at most 50%. To determine the shape of the organic silver salt grain, image of an organic silver salt dispersion taken by the use of a transmission electronic microscope may be analyzed. Another method for analyzing the mono-dispersing properties of the organic silver salt comprises determining the standard deviation of the volume weighted mean diameter of the salt grains. In the method, the percentage of a value obtained by dividing the standard deviation by the volume weighted mean diameter of the salt grain (coefficient of variation) is preferably at most 100%, more preferably at most 80%, and even more preferably at most 50%. For the measurement, any commercially-available laser scattering grain size analyzer can be used. Concretely, for example, a sample of the organic silver salt is dispersed in a liquid, the resulting dispersion is exposed to a laser ray, and the self-correlation function of the fluctuation of the scattered ray relative to time is obtained. Based on this, the grain size (volume weighted mean diameter) of the salt grains is obtained.

3) Preparation

In preparing and dispersing the organic acid silver salts for use in the invention, any known method can be used. Specifically, methods disclosed in, for example, JP-A No. 10-62899; EP-A Nos. 0803763A1 and 0962812A1; JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870, and 2002-107868 and Japanese Patent Application No. 2000-214155 can be used.

It is preferable that the organic silver salt is dispersed substantially in the absence of a photosensitive silver salt, since the photosensitive silver salt, if any, in the dispersing system, is fogged and its sensitivity is significantly lowered. In the heat-developable photosensitive material of the invention, the amount of the photosensitive silver salt that may be contained in the aqueous dispersion of the organic silver salt is preferably at most 1 mol %, and more preferably at most 0.1 mol % relative to one mol of the organic acid silver salt therein. It is even more preferable that no photosensitive silver salt is positively added to the aqueous dispersion.

An aqueous organic silver salt dispersion may be mixed with an aqueous photosensitive silver salt dispersion to prepare a coating liquid for the heat-developable photosensitive material of the invention. The blend ratio of the organic silver salt to the photosensitive silver salt in the mixture may be suitably determined depending on the object of the invention. Preferably, the blend ratio of the photosensitive silver salt to the organic silver salt in the mixture is 1 to 30 mol %, more preferably 2 to 20 mol %, and even more preferably 3 to 15 mol %. Mixing two or more different types of aqueous organic silver salt dispersions with two or more different types of aqueous photosensitive silver salt dispersions is preferred for controlling the photographic properties of the resulting heat-developable photosensitive material.

4) Addition Amount

The organic silver salt used in the invention can be used in a desired amount. In the first aspect, the total coating amount of silver, including silver halide, is preferably from 0.1 to 5.0 g/m$^2$, more preferably from 0.3 to 3.0 g/m$^2$ and still more preferably from 0.5 to 2.0 g/m$^2$ as. In particular, in order to improve the image storability, the total coating amount of silver is preferably 1.8 g/m$^2$ or less and more preferably 1.6 g/m$^2$ or less. When the preferred reducing agent in the invention is used, sufficient image density can be obtained even at such a low silver content. Further, in the second aspect, the amount of silver is preferably 0.1 to 5 g/m$^2$, more preferably 1 to 3 g/m$^2$ and particularly preferably 1.2 to 2.5 glm$^2$.

Explanation of Reducing Agent

The heat-developable photosensitive material of the invention preferably contains a reducing agent that acts as a heat-developing agent for the organic silver salt. The reducing agent for the organic silver salt may be any substance capable of reducing silver ions into metal silver, but is preferably an organic substance. Some examples of the reducing agent are described in JP-A No. 11-65021, paragraphs [0043] to [0045] and in EP-A No. 0803764A1, from page 7, line 34 to page 18, line 12.

Hindered phenols having an ortho-substituent relative to the phenolic hydroxyl group therein, or bisphenols are preferable for the reducing agent for use in the invention; and compounds of the following formula (R) are more preferable.

Formula (R)

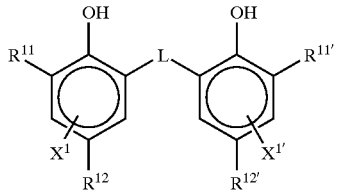

In formula (R), $R^{11}$ and $R^{11'}$ each independently represent an alkyl group having from 1 to 20 carbon atoms; $R^{12}$ and $R^{12'}$ each independently represent a hydrogen atom, or a substituent which can bond to the benzene ring; L represents a group of —S— or —CHR$^{13}$—; $R^{13}$ represents a hydrogen atom or an alkyl group having from 1 to 20 carbon atoms; $X^1$ and $X^{1'}$ each independently represent a hydrogen atom, or a substituent which can bond to the benzene ring.

Compounds of formula (R) are described in detail.

1) $R^{11}$ and $R^{11'}$ $R^{11}$ and $R^{11'}$ each independently represent a substituted or unsubstituted alkyl group having from 1 to 20 carbon atoms. The substituent of the substituted alkyl group is not specifically limited, but is preferably, for example, an aryl group, a hydroxyl group, an alkoxy group, an aryloxy group, an alkylthio group, an arylthio group, an acylamino group, a sulfonamido group, a sulfonyl group, a phosphoryl group, an acyl group, a carbamoyl group, an ester group, an ureido group, an urethane group, or a halogen atom.

2) $R^{12}$ and $R^{12'}$, $X^1$ and $X^{1'}$ $R^{12}$ and $R^{12'}$ each independently represent a hydrogen atom, or a substituent which can bond to the benzene ring; and $X^1$ and $X^{1'}$ each independently represent a hydrogen atom, or a substituent which can bond to the benzene ring. Preferred examples of the substituent which can bond to the benzene ring are an alkyl group, an aryl group, a halogen atom, an alkoxy group, and an acylamino group.

3) L

L represents a group of —S— or —CHR$^{13}$—. $R^{13}$ represents a hydrogen atom or an alkyl group having from 1 to 20 carbon atoms. The alkyl group may be substituted.

Examples of the unsubstituted alkyl group for $R^{13}$ are methyl, ethyl, propyl, butyl, heptyl, undecyl, isopropyl, 1-ethylpentyl and 2,4,4-trimethylpentyl groups. Examples of the substituent of the substituted alkyl group may be the same as those for $R^{11}$, including, for example, a halogen atom, an alkoxy group, an alkylthio group, an aryloxy group, an arylthio group, an acylamino group, a sulfonamido group, a sulfonyl group, a phosphoryl group, an oxycarbonyl group, a carbamoyl group, and a sulfamoyl group.

4) Preferred Substituents $R^{11}$ and $R_{11}'$ are preferably a secondary or tertiary alkyl group having from 3 to 15 carbon atoms. Specific examples include isopropyl, isobutyl, t-butyl, t-amyl, t-octyl, cyclohexyl, cyclopentyl, 1-methylcyclohexyl and 1-methylcyclopropyl groups. $R^{11}$ and $R^{11'}$ is more preferably a tertiary alkyl group having from 4 to 12 carbon atoms, and even more preferably-butyl, t-amyl and 1-methyl cyclohexyl groups. A t-butyl group is the most preferable.

$R^{12}$ and $R^{12'}$ are preferably an alkyl group having from 1 to 20 carbon atoms, and specific examples include methyl, ethyl, propyl, butyl, isopropyl, t-butyl, t-amyl, cyclohexyl, 1-methylcyclohexyl, benzyl, methoxymethyl and methoxyethyl groups. Methyl, ethyl, propyl, isopropyl and t-butyl groups are more preferable.

$X^1$ and $X^{1'}$ are preferably a hydrogen atom, a halogen atom and an alkyl group, and more preferably a hydrogen atom.

L is preferably —$CHR^{13}$—.

$R^3$ is preferably a hydrogen atom or an alkyl group having from 1 to 15 carbon atoms. Preferred examples of the alkyl group include methyl, ethyl, propyl, isopropyl and 2,4,4-trimethylpentyl groups. More preferably, $R^{13}$ is a hydrogen atom, a methyl group, an ethyl group, a propyl group or an isopropyl group.

When $R^{13}$ is a hydrogen atom, $R^{12}$ and $R^{12'}$ each are preferably an alkyl group having from 2 to 5 carbon atoms, more preferably an ethyl or propyl group, and most preferably an ethyl group. When $R^{13}$ is a primary or secondary alkyl group having from 1 to 8 carbon atoms, $R^{12}$ and $R^{12'}$ are preferably both methyl groups. The primary or secondary alkyl group having from 1 to 8 carbon atoms for $R^{13}$ are preferably methyl, ethyl, propyl and isopropyl groups, and more preferably methyl, ethyl and propyl groups.

When $R^{11}$, $R^{11'}$, $R^{12}$ and $R^{12'}$ are all methyl groups, $R^{13}$ is preferably a secondary alkyl group. The secondary alkyl group for $R^{13}$ is preferably any of isopropyl, isobutyl and 1-ethylpentyl group, and more preferably an isopropyl group.

Depending on the combination of the groups $R^{11}$, $R^{11'}$, $R^{12}$, $R^{12'}$ and $R^{13}$, the reducing agents exhibit different heat-developability and produce different silver tone. Combining two or more different types of the reducing agents makes it possible to control the heat-developability and to produce a controlled silver tone. Therefore, combining two or more different types of the reducing agents in the heat-developable photosensitive material is preferred, depending on the object of the material.

Specific examples of the reducing agents including the compounds represented by the general formula (R) in the invention are shown below but the invention is not restricted to them.

(R-1)

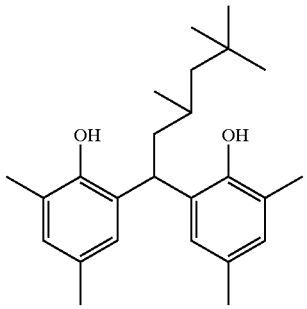

(R-2)

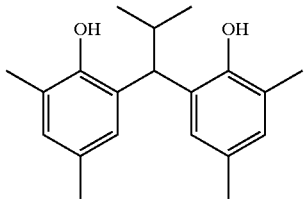

(R-3)

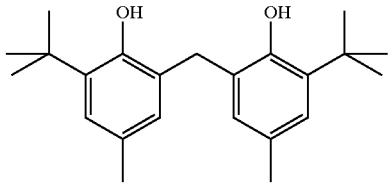

(R-4)

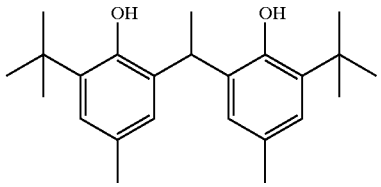

(R-5)

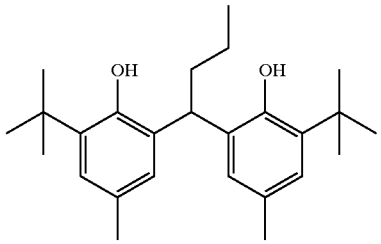

(R-6)

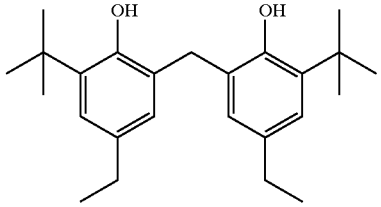

(R-7)

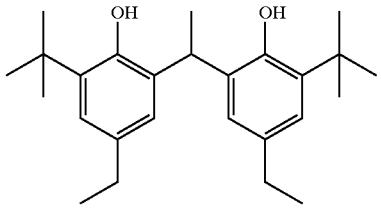

-continued
(R-8)
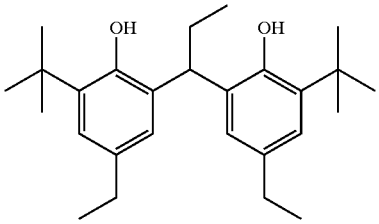
(R-9)
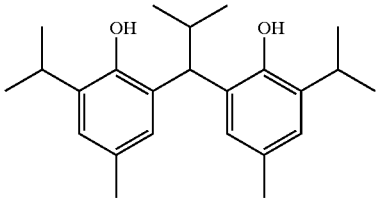
(R-10)
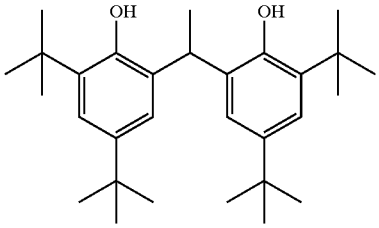
(R-11)
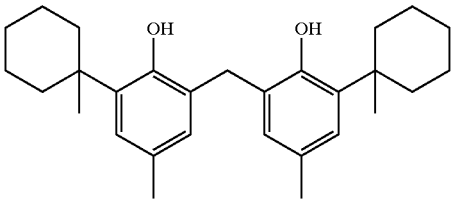
(R-12)
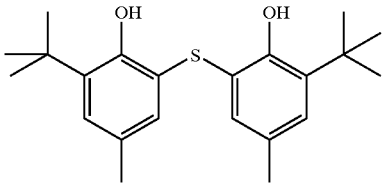
(R-13)
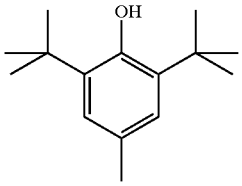
(R-14)
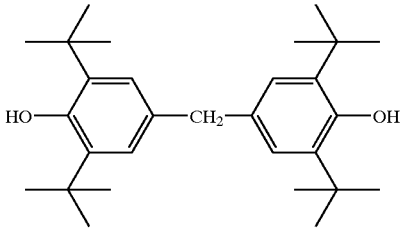
-continued
(R-15)
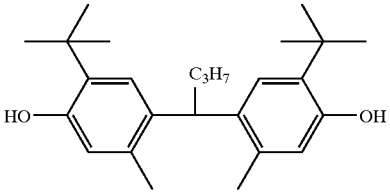
(R-16)
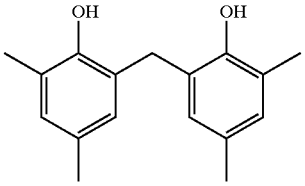
(R-17)
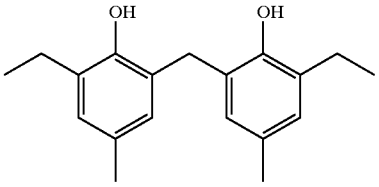
(R-18)
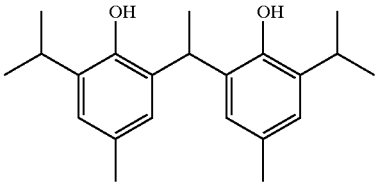
(R-19)
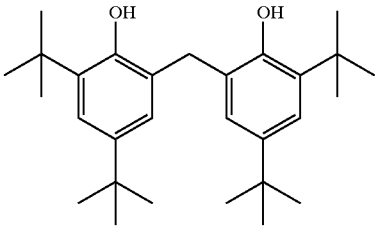
(R-20)
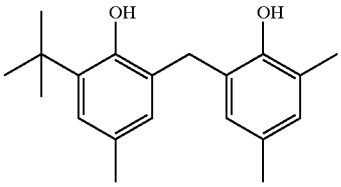
(R-21)
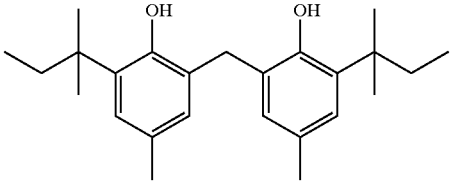
(R-22)
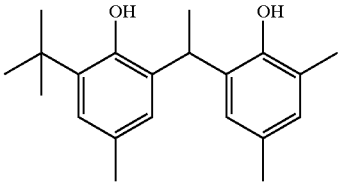

-continued
(R-23)
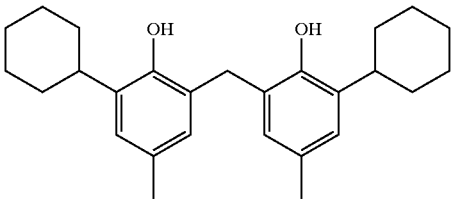
(R-24)
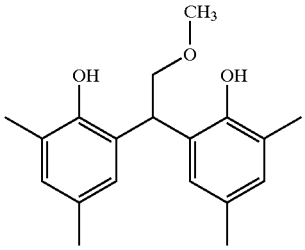
(R-25)
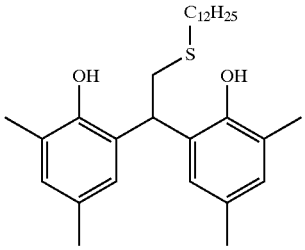
(R-26)
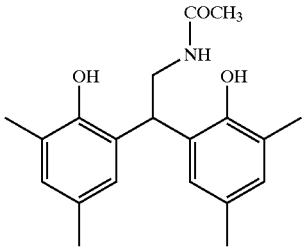
(R-27)
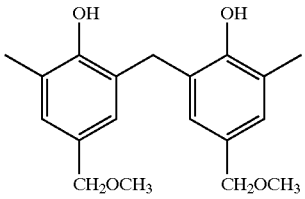
(R-28)
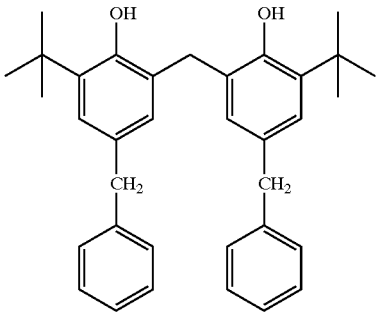
-continued
(R-29)
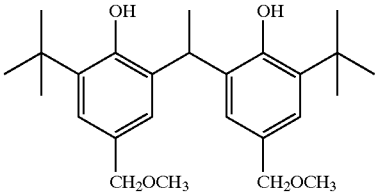
(R-30)
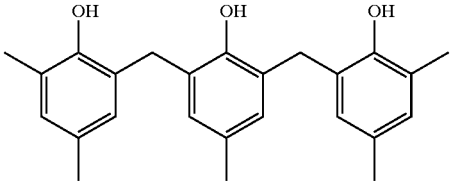
(R-31)
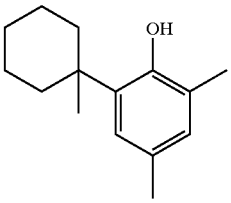
(R-32)
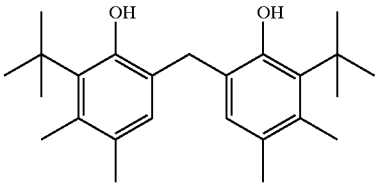
(R-33)
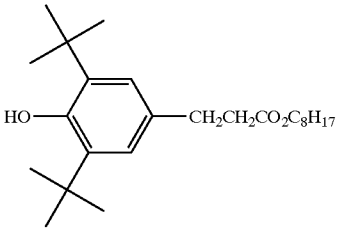
(R-34)
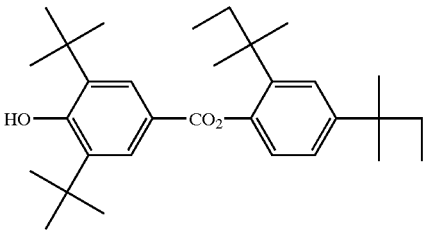
(R-35)
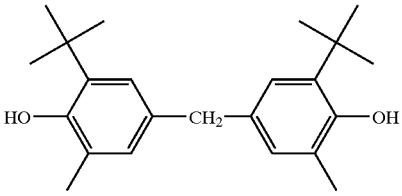

-continued (R-36)

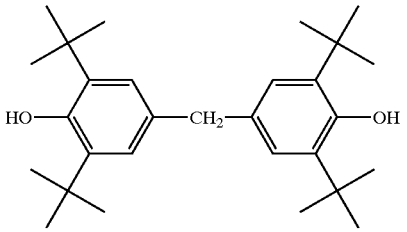

(R-37)

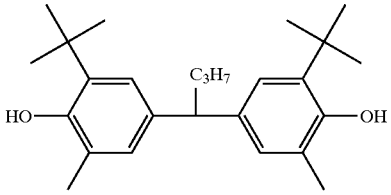

(R-38)

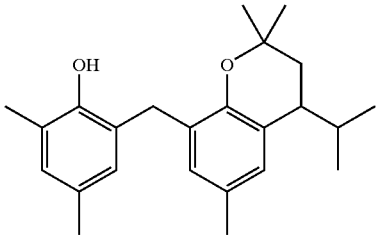

In particular, compounds as shown in (R-1) to (R-6), (R-8), (R-10) to (R-11), and (R-16) to (R-26) are preferred.

Preferred examples of the reducing agents in the invention other than those described above are compounds described in JP-A Nos. 2001-188314, 2001-209145, 2001-350235, and 2002-156727.

The addition amount of the reducing agent in the invention is preferably from 0.01 to 5.0 g/m$^2$, more preferably, from 0.1 to 3.0 g/m$^2$, still more preferably from 0.2 to 1.5 g/m$^2$ and most preferably from 0.3 to 1.0 g/m$^2$. In the first aspect, the reducing agent is contained preferably in an amount of 5 to 50 mol %, more preferably 8 to 30 mol % and still more preferably from 10 to 20 mol % based on 1 mol of silver in the surface having the image forming layer. In the second aspect, it is contained preferably in an amount of 5 to 50 mol %, and more preferably from 10 to 40 mol % based on 1 mol of silver in the surface having the image forming layer.

The reducing agent in the invention can be contained in the image forming layer including the organic silver salt and the photosensitive silver halide, and/or a layer adjacent thereto, and is more preferably contained in the image forming layer.

The reducing agent may be in any form of a solution, an emulsified dispersion and a fine solid particle dispersion, and may be added to the coating liquid in any known method so as to be incorporated into the heat-developable photosensitive material of the invention.

One well known method of emulsifying the reducing agent to prepare its dispersion comprises dissolving the reducing agent in an oily solvent such as dibutyl phthalate, tricresyl phosphate, glyceryl triacetate, or diethyl phthalate, or in an auxiliary solvent such as ethyl acetate or cyclohexanone, and then mechanically emulsifying the resultant into a dispersion.

In order to prepare a fine solid particle dispersion of the reducing agent, methods that comprise dispersing a powder of the reducing agent in water or in any other suitable solvent by the use of a ball mill, a colloid mill, a vibration ball mill, a sand mill, a jet mill or a roller mill, or ultrasonic wave to thereby prepare the intended solid dispersion of the reducing agent can be used. Among them, a method using a sand mill is preferable. In this method, a protective colloid (e.g., polyvinyl alcohol), and a surfactant (e.g., an anionic surfactant such as sodium triisopropylnaphthalenesulfonate, a mixture of isomers that differ in point of the substituting positions of the three isopropyl groups) is optionally used. In these mills, beads of zirconia or the like that serve as a dispersion medium are generally used. Zr or the like may dissolve out of the beads and often contaminates the dispersion formed. Depending on dispersion conditions, the contaminant content of the dispersion formed is generally 1 ppm to 1000 ppm. So far as the Zr content of the heat-developable photosensitive material is not larger than 0.5 mg per gram of silver in the material, the contaminant causes no practical problem.

Preferably, the aqueous dispersion contains a preservative (e.g., sodium benzoisothiazolinone).

Preparing a solid particle dispersion of the reducing agent is particularly preferable, and, in the preparation, the mean particle size of the reducing agent particles is preferably from 0.01 $\mu$m to 10 $\mu$m, more preferably from 0.05 $\mu$m to 5 $\mu$m, and even more preferably from 0.1 $\mu$m to 2 $\mu$m. In the invention, it is preferable that the particle sizes of the other solid dispersions is also within the range.

Description of Development Promoter

Preferably, the heat-developable photosensitive material of the invention contains a development promoter. Preferred examples of the development promoter are sulfonamidophenol compounds in JP-A Nos. 2000-267222 and 2000-330234 (formula (A)); hindered phenol compounds of formula (II) in JP-A No. 2001-92075; hydrazine compounds in JP-A Nos. 10-62895 and 11-15116 (compounds of formula (I)), JP-A No. 2002-156727 (formula (D)) and Japanese Patent Application No. 2001-074278 (formula (I)); and phenol or naphthol compounds of formula (2) in JP-A NO. 2001-264929. The amount of the development promoter to be contained in the material may be 0.1 to 20 mol %, preferably 0.5 to 10 mol %, and more preferably 1 to 5 mol % relative to the reducing agent therein. The development promoter may be introduced into the material in the same manner as the method used for introducing the reducing agent thereinto. Preferably, however, it is added to the material in the form of its solid dispersion or emulsified dispersion. When it is added to the material in the form of its emulsified dispersion, the emulsified dispersion thereof is preferably prepared by emulsifying and dispersing the development promoter in a mixed solvent of a high-boiling point solvent that is solid at room temperature and an auxiliary solvent having a low boiling point, or the emulsified dispersion is preferably an oilless dispersion with no high-boiling-point solvent therein.

The development promoter for use in the invention is especially preferably hydrazine compounds of formula (D) in JP-A No. 2002-156727, hydrazine compounds of formula (1) in Japanese Patent Application No. 2001-074278 or phenol or naphthol compounds of formula (2) in JP-A No. 2001-264929.

Preferred examples of the development promoter for use in the invention are compounds of the following formulae (A-1) and (A-2):

$$Q_1\text{-NHNH-}Q_2 \qquad \text{Formula (A-1)}$$

wherein $Q_1$ represents an aromatic or heterocyclic group bonding to NHNH-$Q_2$ via its carbon atom; $Q_2$ represents a carbamoyl group, an acyl group, an alkoxycarbonyl group, an aryloxycarbonyl group, a sulfonyl group, or a sulfamoyl group.

In formula (A-1), the aromatic or heterocyclic group represented by $Q_1$ is preferably a 5- to 7-membered unsaturated cyclic group. Preferred examples thereof are a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isoxazole ring, and a thiophene ring, and condensed rings of any of those rings are also preferable.

These rings may be substituted, and when they have 2 or more substituents, the substituents may be the same or different. Examples of the substituent are a halogen atom, an alkyl group, an aryl group, a carbonamido group, an alkylsulfonamido group, an arylsulfonamido group, an alkoxy group, an aryloxy group, an alkylthio group, an arylthio group, a carbamoyl group, a sulfamoyl group, a cyano group, an alkylsulfonyl group, an arylsulfonyl group, an alkoxycarbonyl group, an aryloxycarbonyl group, and an acyl group. When these substituents are substitutable ones, they may have a further substituent. Preferred examples of the substituent are a halogen atom, an alkyl group, an aryl group, a carbonamido group, an alkylsulfonamido group, an arylsulfonamido group, an alkoxy group, an aryloxy group, an alkylthio group, an arylthio group, an acyl group, an alkoxycarbonyl group, an aryloxycarbonyl group, a carbamoyl group, a cyano group, a sulfamoyl group, an alkylsulfonyl group, an arylsulfonyl group, and an acyloxy group.

The carbamoyl group represented by $Q_2$ preferably has from 1 to 50 carbon atoms, and more preferably from 6 to 40 carbon atoms. Examples thereof include unsubstituted carbamoyl, methylcarbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl}carbamoyl, N-(2-hexyldecyl)carbamoyl, N-phenylcarbamoyl, N-(4-dodecyloxyphenyl)carbamoyl, N-(2-chloro-5-dodecyloxycarbonylphenyl)carbamoyl, N-naphthylcarbamoyl, N-3-pyridylcarbamoyl, and N-benzylcarbamoyl.

The acyl group represented by $Q_2$ preferably has from 1 to 50 carbon atoms, and more preferably from 6 to 40 carbon atoms. Examples thereof include formyl, acetyl, 2-methylpropanoyl, cyclohexylcarbonyl, octanoyl, 2-hexyldacanoyl, dodecanoyl, chloroacetyl, trifluoroacetyl, benzoyl, 4-dodecyloxybenzoyl, and 2-hydroxymethylbenzoyl. The alkoxycarbonyl group represented by $Q_2$ preferably has from 2 to 50 carbon atoms, and more preferably from 6 to 40 carbon atoms. Examples thereof include methoxycarbonyl, ethoxycarbonyl, isobutyloxycarbonyl, cyclohexyloxycarbonyl, dodecyloxycarbonyl, and benzyloxycarbonyl.

The aryloxycarbonyl group represented by $Q_2$ preferably has from 7 to 50 carbon atoms, and more preferably from 7 to 40 carbon atoms. Examples thereof include phenoxycarbonyl, 4-octyloxyphenoxycarbonyl, 2-hydroxymethylphenoxycarbonyl, and 4-dodecyloxyphenoxycarbonyl.

The sulfonyl group represented by $Q_2$ preferably has from 1 to 50 carbon atoms, and more preferably from 6 to 40 carbon atoms. Examples thereof include methylsulfonyl, butylsulfonyl, octylsulfonyl, 2-hexadecylsulfonyl, 3-dodecyloxypropylsulfonyl, 2-octyloxy-5-tert-octylphenylsulfonyl, and 4-dodecyloxyphenylsulfonyl.

The sulfamoyl group represented by $Q_2$ preferably has from 0 to 50 carbon atoms, and more preferably from 6 to 40 carbon atoms. Examples thereof include unsubstituted sulfamoyl, N-ethylsulfamoyl, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl.

The groups represented by $Q_2$ may be optionally substituted at their substitutable position with any of those mentioned hereinabove for the substituents of the 5- to 7-membered unsaturated rings represented by $Q_1$. When they have 2 or more such substituents, the substituents may be the same or different.

Preferred embodiments of the compounds of formula (A-1) are mentioned below. $Q_1$ is preferably a 5- or 6-membered unsaturated cyclic group, and preferred examples thereof include a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thiazole ring, an oxazole ring, an isothiazole ring, an isoxazole ring, and condensed rings of any of those rings with a benzene ring or an unsaturated heterocyclic ring. Also, $Q^2$ is preferably a carbamoyl group, and more preferably a carbamoyl group having a hydrogen atom on the nitrogen atom.

Formula (A-2)

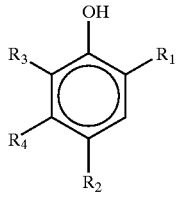

In formula (A-2), $R_1$ represents an alkyl group, an acyl group, an acylamino group, a sulfonamido group, an alkoxycarbonyl group, or a carbamoyl group. $R_2$ represents a hydrogen atom, a halogen atom, an alkyl group, an alkoxy group, an aryloxy group, an alkylthio group, an arylthio group, an acyloxy group, or a carbonate group. $R_3$ and $R_4$ each represent a group which can bond to the benzene ring such as those mentioned hereinabove for the substituents in formula (A-1) $R_3$ and $R_4$ may bond to each other to form a condensed ring.

$R_1$ is preferably an alkyl group having from 1 to 20 carbon atoms (e.g., methyl, ethyl, isopropyl, butyl, tert-octyl, or cyclohexyl), an acylamino group (e.g., acetylamino, benzoylamino, methylureido, or 4-cyanophenylureido), or a carbamoyl group (e.g., n-butylcarbamoyl, N,N-diethylcarbamoyl, phenylcarbamoyl, 2-chlorophenylcarbamoyl, or 2,4-dichlorophenylcarbamoyl), and is more preferably an acylamino group (including an ureido group and/or an urethane group). $R_2$ is preferably a halogen atom (more preferably, a chlorine atom, or a bromine atom), an alkoxy group (e.g., methoxy, butoxy, n-hexyloxy, n-decyloxy, cyclohexyloxy, or benzyloxy), or an aryloxy group (e.g., phenoxy, or naphthoxy).

$R_3$ is preferably a hydrogen atom, a halogen atom, an alkyl group having from 1 to 20 carbon atoms, and is most preferably a halogen atom. $R_4$ is preferably a hydrogen atom, an alkyl group, or an acylamino group, and more preferably an alkyl group or an acylamino group. Examples of these preferred substituents may be the same as those for $R_1$. When $R_4$ is an acylamino group, it is also preferable that $R_4$ bonds to $R_3$ to form a carbostyryl ring.

In formula (A-2), when $R_3$ and $R_4$ bond to each other to form a condensed ring, the condensed ring is especially preferably a naphthalene ring. The naphthalene ring may be substituted with any substituent of those mentioned hereinabove for formula (A-1). When the compound of formula (A-2) is a naphthol compound, $R_1$ is preferably a carbamoyl group, and more preferably a benzoyl group. $R_2$ is preferably an alkoxy group, or an aryloxy group, and more preferably an alkoxy group.

Preferred specific examples of the development promotor of the invention are shown below. However, the invention is not restricted to them.

(A-1)

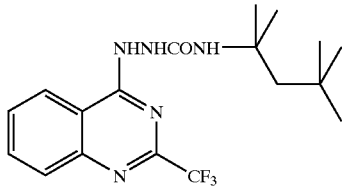

(A-2)

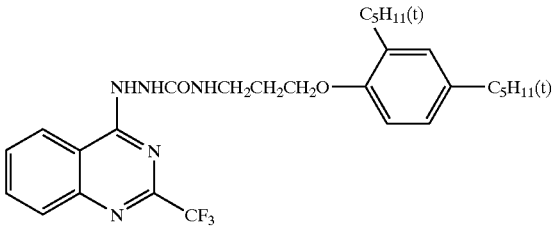

(A-3)

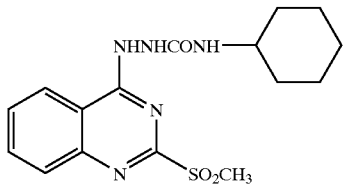

(A-4)

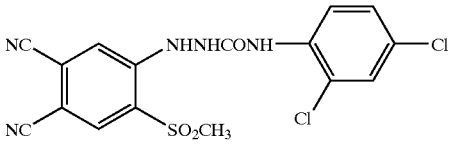

(A-5)

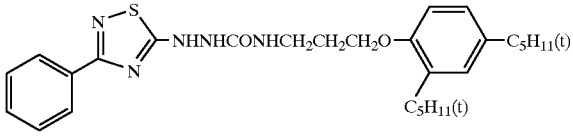

(A-6)

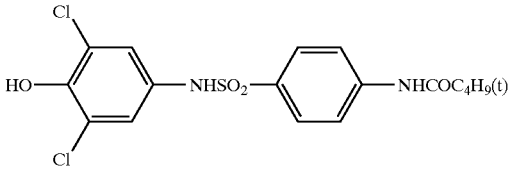

-continued (A-7)

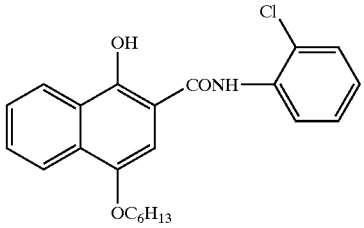

(A-8)

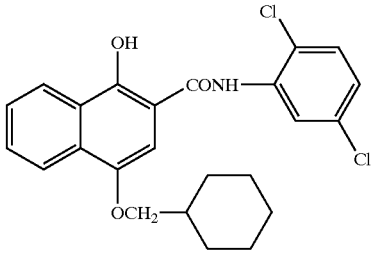

(A-9)

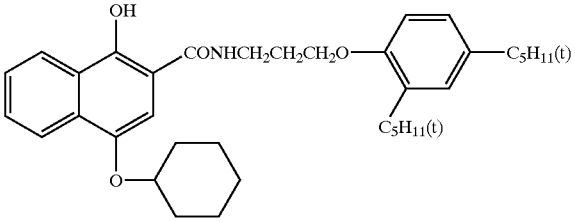

(A-10)

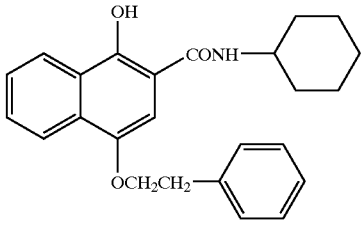

(A-11)

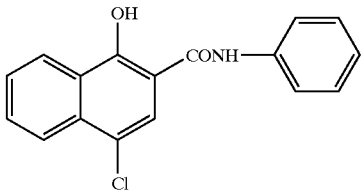

(A-12)

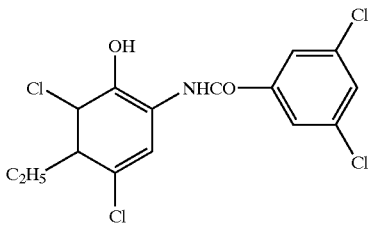

Description of Hydrogen Bonding Compound

When the reducing agent for use in the invention has an aromatic hydroxyl group (—OH) or an amino group, especially when it is any of the above-mentioned bisphenols, the reducing agent is preferably combined with a non-reducing compound that has a group capable of forming a hydrogen bond with the group in the reducing agent. Examples of the group capable of forming a hydrogen bond with the hydroxyl group or the amino group in the reducing agent include a phosphoryl group, a sulfoxide group, a sulfonyl group, a carbonyl group, an amido group, an ester group, an urethane group, an ureido group, a tertiary amino group, and a nitrogen-containing aromatic group. Among those, a phosphoryl group, a sulfoxide group, an amido group (not having a group of >N—H but is blocked to form >N—Ra, in which Ra is a substituent except hydrogen), an urethane group (not having a group of >N—H but is blocked to form >N—Ra, in which Ra is a substituent except hydrogen), and an ureido group (not having a group of >N—H but is blocked to form >N—Ra, in which Ra is a substituent except hydrogen) are preferable.

Especially preferred examples of the hydrogen bonding compound for use in the invention are those of the following formula (D).

Formula (D)

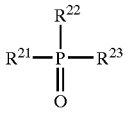

In formula (D), $R^{21}$ to $R^{23}$ each independently represent an alkyl group, an aryl group, an alkoxy group, an aryloxy group, an amino group or a heterocyclic group, and these may be unsubstituted or substituted. When the groups represented by $R^{21}$ to $R^{23}$has a substituent, examples of the substituent include a halogen atom, an alkyl group, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group and a phosphoryl group. Among the substituents, an alkyl group and an aryl group, including, for example, methyl, ethyl, isopropyl, t-butyl, t-octyl, phenyl, 4-alkoxyphenyl and 4-acyloxyphenyl groups, are preferable.

Examples of the alkyl group represented by $R^{21}$ to $R^{23}$ include methyl, ethyl, butyl, octyl, dodecyl, isopropyl, t-butyl, t-amyl, t-octyl, cyclohexyl, 1-methylcyclohexyl, benzyl, phenethyl and 2-phenoxypropyl groups. Examples of the aryl group include phenyl, cresyl, xylyl, naphthyl, 4-t-butylphenyl, 4-t-octylphenyl, 4-anisidyl and 3,5-dichlorophenyl groups. Examples of the alkoxy group include methoxy, ethoxy, butoxy, octyloxy, 2-ethylhexyloxy, 3,5,5-trimethylhexyloxy, dodecyloxy, cyclohexyloxy, 4-methylcyclohexyloxy and benzyloxy groups. Examples of the aryloxy group include phenoxy, cresyloxy, isopropylphenoxy, 4-t-butylphenoxy, naphthoxy and biphenyloxy groups. Examples of the amino group include dimethylamino, diethylamino, dibutylamino, dioctylamino, N-methyl-N-hexylamino, dicyclohexylamino, diphenylamino and N-methyl-N-phenylamino groups.

$R^{21}$ to $R^{23}$ are preferably an alkyl group, an aryl group, an alkoxy group or an aryloxy group. From the viewpoint of the effect of the invention, it is preferable that at least one of $R^{21}$ to $R^{23}$ is an alkyl group or an aryl group. It is more desirable that at least two of them are any of an alkyl group and an aryl group. Even more preferably, $R^{21}$ to $R^{23}$ are the same group, since such a compound is inexpensive.

Specific examples of the compounds of formula (D) and other hydrogen bonding compounds usable in the invention are shown below, however, the invention is not limited thereto.

(D-1)

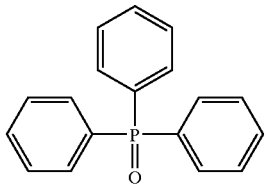

(D-2)

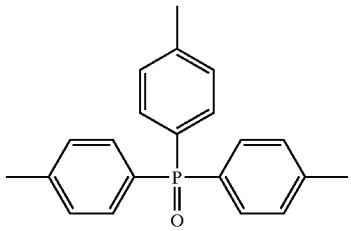

(D-3)

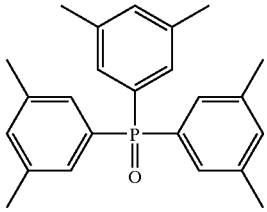

(D-4)

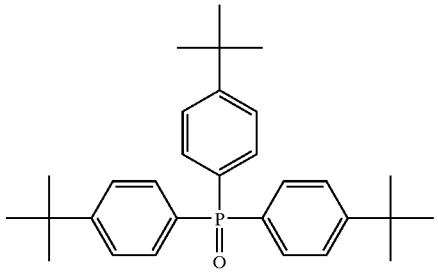

(D-5)

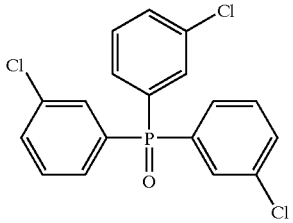

(D-6)

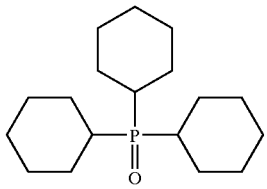

(D-7)

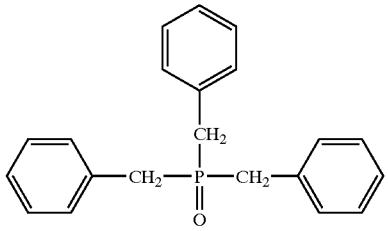

-continued (D-8)

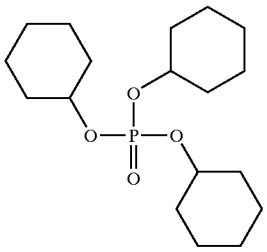

(D-9)

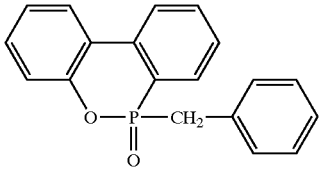

(D-10)

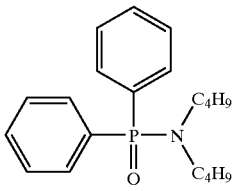

(D-11)

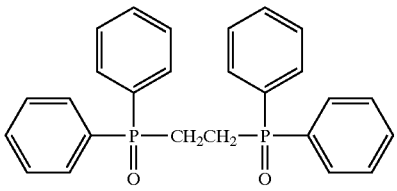

(D-12)

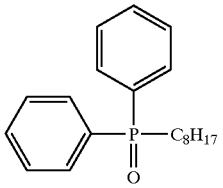

(D-13)

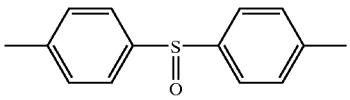

(D-14)

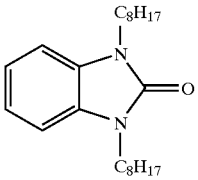

(D-15)

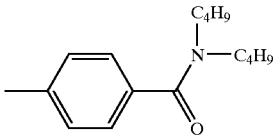

-continued (D-16)

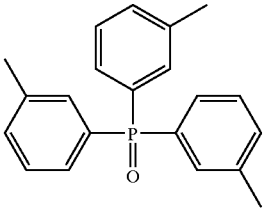

(D-17)

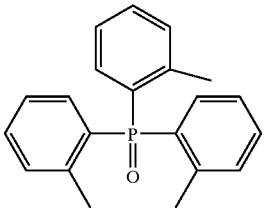

(D-18)

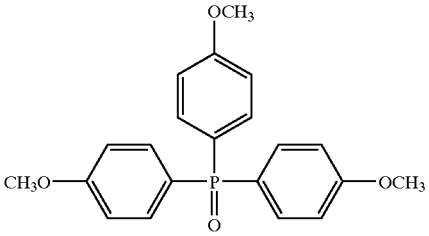

(D-19)

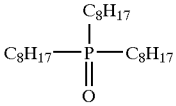

(D-20)

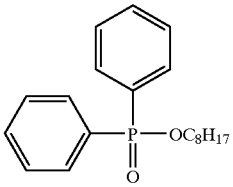

(D-21)

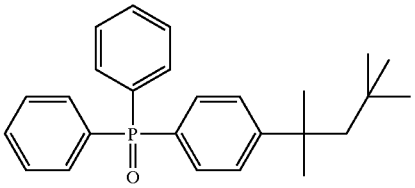

(D-22)

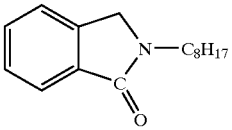

Apart from the above, other hydrogen bonding compounds such as those described in EP No. 1,096,310, JP-A No. 2002-156727 and Japanese Patent Application Nos. 2001-124796, 2000-192191 and 2000-194811 are also usable herein.

Like the reducing agent mentioned above, the compound of formula (D) may be added to the coating liquid for the heat-developable photosensitive material of the invention, for example, in the form of a solution, an emulsified dispersion or a solid particle dispersion, but is preferably used in the form of a solid particle dispersion. In its solution, the compound of formula (D) forms a hydrogen-bonding complex with a compound having a phenolic hydroxyl group or an amino group. Depending on the combination of the reducing agent and the compound of formula (D) for use herein, the crystal of the complex may be isolated. The isolated crystal powder may be formed into its solid particle dispersion, and the dispersion is especially preferred for use in the invention for stabilizing the heat-developable photosensitive material of the invention. Also, powders of the reducing agent and the compound of formula (D) may be mixed optionally along with a suitable dispersant in a sand grinder mill or the like to thereby form the intended complex at the time of dispersion. The method is also preferred in the invention.

In the first aspect, the amount of the hydrogen bonding compound is preferably 1 to 200 mol %, more preferably 10 to 150 mol % and still more preferably 20 to 100 mol % based on the reducing agent. In the second aspect, the amount of the hydrogen bonding compound is preferably 1 to 200 mol %, more preferably 10 to 150 mol % and still more preferably 30 to 100 mol % based on the reducing agent.

Description of Binder

The binder to be included in the layer containing the organic silver salt in the invention may be polymer of any type, but is preferably transparent or semitransparent and is generally colorless. The binder is preferably a natural resin, a natural polymer, a natural copolymer, a synthetic resin, a synthetic polymer, a synthetic copolymer and other film-forming medium. Specific examples thereof include gelatins, rubbers, polyvinyl alcohols, hydroxyethylcelluloses, cellulose acetates, cellulose acetate butyrates, polyvinylpyrrolidones, casein, starch, polyacrylic acids, polymethylmethacrylic acids, polyvinyl chlorides, polymethacrylic acids, styrene-maleic anhydride copolymers, styrene-acrylonitrile copolymers, styrene-butadiene copolymers, polyvinylacetals (e.g., polyvinylformal, or polyvinylbutyral), polyesters, polyurethanes, phenoxy resins, polyvinylidene chlorides, polyepoxides, polycarbonates, polyvinyl acetates, polyolefins, cellulose esters, and polyamides. To prepare a coating liquid of the binder, water or an organic solvent or an emulsion may be used.

In the first aspect of the invention, the glass transition temperature of the binder that can be used in a layer including the organic silver salt is 0° C. to 80° C. (hereinafter sometimes referred to as a high Tg binder). It is more preferably 10° C. to 70° C. and still more preferably 15° C. to 60° C. Further, in the second aspect of the invention, the glass transition temperature of the binder of the layer including the organic silver salt is preferably from 10° C. to 80° C., more preferably from 20° C. to 70° C. and still more preferably from 23° C. to 65° C.

In this specification, Tg is calculated according to the following equation:

$$1/Tg=\Sigma(Xi/Tgi)$$

The polymer whose glass transition point Tg is calculated as in the above equatation is assumed to be formed by copolymerizing n monomers (i indicates the number of the monomers copolymerized, from 1 to n); Xi indicates the weight percentage of the i'th monomer ($\Sigma Xi=1$); Tgi indicates the glass transition temperature (in terms of the absolute temperature) of the homopolymer of the i'th monomer alone; and Σ indicates the sum of (X1/Tg1) to (Xn/Tgn). As for the glass transition temperature (Tgi) of the homopolymer of each monomer alone, the descriptions in *Polymer Handbook* (3rd edition) (written by J. Brandrup, E. H. Immergut (Wiley-Interscience, 1989)) is referred to.

One binder may be used alone, or two or more different types of binders may be used in combination. For example, a binder having a glass transition temperature of 20° C. or higher and a binder having a glass transition temperature of lower than 20° C. may be combined. When at least two polymers having different Tgs are blended for use herein, it is preferable that the weight-average Tg of the resulting blend is within the range described above.

In the invention, it is preferable that the organic silver salt-containing layer is formed by applying a coating liquid, in which at least 30% by mass of the solvent is water, onto a support, and drying the resultant coating.

When the organic silver salt-containing layer in the invention is formed by using such a coating liquid in which at least 30% by mass of the solvent is water and by drying the resultant coating, and when the binder in the organic silver salt-containing layer is soluble or dispersible in an aqueous solvent (watery solvent), especially when the binder in the organic silver salt-containing layer is a polymer latex that has an equilibrium moisture content at 25° C. and 60% RH of at most 2% by mass, the heat-developable photosensitive material having such a layer has improved properties. Most preferably, the binder for use in the invention is so designed that its ionic conductivity is at most 2.5 mS/cm. In order to prepare such a binder, for example, a method of purifying a prepared binder polymer through an advanced separation membrane is employable.

The aqueous solvent in which the polymer binder is soluble or dispersible is water or a mixed solvent of water and at most 70% by mass of a water-miscible organic solvent. Examples of the water-miscible organic solvent include alcohols such as methyl alcohol, ethyl alcohol, or propyl alcohol; cellosolves such as methyl cellosolve, ethyl cellosolve, or butyl cellosolve; ethyl acetate, and dimethylformamide.

The terminology "aqueous solvent" referred to herein can also be used for polymer systems in which the polymer is not thermodynamically dissolved but is dispersed.

The "equilibrium moisture content at 25° C. and 60% RH" referred to herein is represented by the following equation, in which $W_1$ indicates the weight of a polymer in humidity-conditioned equilibrium at 25° C. and 60% RH, and $W_0$ indicates the absolute dry weight of the polymer at 25° C.

$$\text{Equilibrium moisture content at 25° C. and 60\% } RH=[(W_1-W_0)/W_0]\times 100 \text{ (mass \%)}$$

As for the details of the definition of moisture content and the method for measuring it, for example, *Polymer Engineering*, Lecture 14, Test Methods of Polymer Materials (by the Polymer Society of Japan, Chijin Shokan Publishing) is referred to.

Preferably, the equilibrium moisture content at 25° C. and 60% RH of the binder polymer for use in the invention is at most 2% by mass, more preferably from 0.01 to 1.5% by mass, and even more preferably from 0.02 to 1% by mass.

Polymers that serve as the binder in the invention are preferably dispersible in aqueous solvents. Examples of a polymer dispersion include latex in which water-insoluble hydrophobic fine polymer particles are dispersed, and a dispersion in which polymer molecules or micelles of polymer molecules are dispersed. Any of these are usable herein, but the latex is preferable. The particles in the polymer dispersion preferably have a mean particle size of 1 to 50000 nm, more preferably 5 to 1000 nm, even more preferably 10 to 500 nm, and still more preferably 50 to 200 nm. The particle size distribution of the dispersed polymer particles is not specifically limited. For example, the dispersed polymer particles may have a broad particle size distribution, or may have a particle size distribution of monodispersion. If desired, two or more different types of polymer particle monodispersions may be combined for use herein, and it is preferable for controlling the physical properties of coating liquids.

In preferred embodiments of the heat-developable photosensitive material of the invention, hydrophobic polymers that are dispersible in aqueous solvents are preferably used. Examples of the hydrophobic polymer include acrylic polymers, polyesters, rubbers (e.g., SBR resins), polyurethanes, polyvinyl chlorides, polyvinyl acetates, polyvinylidene chlorides, and polyolefins. These polymers may be linear, branched or crosslinked ones. They may be homopolymers from one type of monomer, or copolymers from two or more different types of monomers. The copolymers may be random copolymers or block copolymers. The polymers for use herein preferably have a number-average molecular weight of 5000 to 1000000, and more preferably 10000 to 200000. Polymers whose molecular weight is too small are unfavorable to the invention, since the mechanical strength of the emulsion layer comprising such a polymer is low; but polymers whose molecular weight is too large are also unfavorable since their film forming properties are not good. Crosslinked polymer latex is especially preferred for use herein.

Specific Examples of Polymer Latex

Preferred examples of polymer latex for use herein are shown below. They are expressed by the constituent monomers, and each numeral parenthesized indicates the proportion, in terms of % by mass, of the monomer unit, and the molecular weight is the number-average molecular weight of the polymer. Polyfunctional monomers form a crosslinked structure, to which the concept of molecular weight cannot apply. That type of the polymer latex is referred to as "crosslinked", and the molecular weight is omitted. Tg indicates the glass transition temperature of the polymer latex.

P-1: Latex of -MMA(70)-EA(27)-MAA(3)-(molecular weight: 37000, Tg: 61° C.)

P-2: Latex of -MMA(70)-2EHA(20)-St(5)-AA(5)-(molecular weight: 40000, Tg: 59° C.)

P-3: Latex of -St(50)-Bu(47)-MMA(3)-(crosslinked, Tg: −17° C.)

P-4: Latex of -St(68)-Bu(29)-AA(3)-(crosslinked, Tg: 17° C.)

P-5: Latex of -St(71)-Bu(26)-AA(3)-(crosslinked, Tg: 24° C.)

P-6: Latex of -St(70)-Bu(27)-IA(3)-(crosslinked)

P-7: Latex of -St(75)-Bu(24)-AA(1)-(crosslinked, Tg: 29° C.)

P-8: Latex of -St(60)-Bu(35)-DVB(3)-MAA(2)-(crosslinked)

P-9: Latex of -St(70)-Bu(25)-DVB(2)-AA(3)-(crosslinked)

P-10: Latex of -VC(50)-MMA(20)-EA(20)-AN-(5)-AA(5)-(molecular weight: 80000)

P-11: Latex of -VDC(85)-MMA(5)-EA(5)-MAA(5)-(molecular weight: 67000)

P-12: Latex of -Et(90)-MAA(10)-(molecular weight: 12000)

P-13: Latex of -St(70)-2EHA(27)-AA(3)-(molecular weigh: 130000, Tg: 43° C.)

P-14: Latex of -MMA(63)-EA(35)-AA(2)-(molecular weight: 33000, Tg: 47° C.)

P-15: Latex of -St(70.5)-Bu(26.5)-AA(3)-(crosslinked, Tg: 23° C.)

P-16: Latex of -St(69.5)-Bu(27.5)-AA(3)-(crosslinked, Tg: 20.5° C.)

Abbreviations of the constituent monomers are as follows:

MMA: methyl methacrylate
EA: ethyl acrylate
MAA: methacrylic acid
2EHA: 2-ethylhexyl acrylate
St: styrene
Bu: butadiene
AA: acrylic acid
DVB: divinylbenzene
VC: vinyl chloride
AN: acrylonitrile
VDC: vinylidene chloride
Et: ethylene
IA: itaconic acid The polymer latexes shown above are commercially available. Some commercial products employable herein are mentioned below. Examples of acrylic polymers are CEBIAN A-4635, 4718, and 4601 (all from Daicel Chemical Industries), and Nipol Lx811, 814, 821, 820, and 857 (all from Nippon Zeon); examples of polyesters are FINETEX ES650, 611, 675, 850 (all from Dai-Nippon Ink & Chemicals), and WD-size, and WMS (both from Eastman Chemical); examples of polyurethanes are HYDRAN AP10, 20, 30, and 40 (all from Dai-Nippon Ink & Chemicals); examples of rubbers are LACSTAR 7310K, 3307B, 4700H, and 7132C (all from Dai-Nippon Ink & Chemicals), and Nipol Lx416, 410, 438C, and 2507 (all from Nippon Zeon); examples of polyvinyl chlorides are G351, and G576 (both from Nippon Zeon); examples of polyvinylidene chlorides are L502, and L513 (both from Asahi Kasei); and examples of polyolefins are CHEMIPEARL S120, and SA100 (both from Mitsui Petrochemical).

These polymer latexes may be used either alone or in combination.

Preferred Latex

The polymer latex for use herein is especially preferably styrene-butadiene copolymer latex. In the styrene-butadiene copolymer, the ratio of styrene monomer units to butadiene monomer units is preferably 40/60 to 95/5 by weight. Also preferably, the mass of the styrene monomer units and the butadiene monomer units account for from 60 to 99% of the total mass of the copolymer monomers. Still preferably, the polymer latex contains from 1 to 6% by mass, and more preferably from 2 to 5% by mass of acrylic acid or methacrylic acid relative to the sum of styrene and butadiene. Even more preferably, the polymer latex contains acrylic acid. The preferred range of the molecular weight is the same as that described above.

Preferred examples of the styrene-butadiene copolymer latex for use in the invention are the above-mentioned P-3 to P-8and P-15, and commercial products, LACSTAR-3307B, and 7132C, and Nipol Lx416.

The organic silver salt-containing layer of the heat-developable photosensitive material of the invention may optionally contain a hydrophilic polymer such as gelatin, polyvinyl alcohol, methyl cellulose, hydroxypropyl cellulose or carboxymethyl cellulose. The amount of the hydrophilic polymer that may be included in the layer is preferably at most 30% by mass, and more preferably at most 20% by mass of all the binder in the organic silver salt-containing layer.

Preferably, the organic silver salt-containing layer (that is, the image-forming layer) of the heat-developable photosensitive material of the invention includes the polymer latex as a binder. In the first aspect, the amount of the binder in the organic silver salt-containing layer is such that the weight ratio of total binder/organic silver salt is 1/10 to 10/1, more preferably 1/3 to 5/1, and even more preferably 1/1 to 3/1. In the second aspect, the amount of the binder in the organic silver salt-containing layer is such that the weight ratio of total binder/organic silver salt is 1/10 to 10/1, and more preferably 1/5 to 4/1.

The organic silver salt-containing layer is generally a photosensitive layer (emulsion layer) containing a photosensitive silver salt, that is, a photosensitive silver halide. In the layer, the weight ratio of total binder/silver halide is preferably 5 to 400, and more preferably 10 to 200.

The overall amount of the binder in the image-forming layer of the heat-developable photosensitive material of the invention is preferably 0.2 to 30 g/m$^2$, more preferably 1 to 15 g/m$^2$, and even more preferably 2 to 10 g/m$^2$. The image-forming layer may optionally contain a crosslinking agent, and a surfactant which is used to improve the coating properties of the coating liquid for the layer.

Preferred Solvent of Coating Liquid:

Preferably, the solvent of the coating liquid for the organic silver salt-containing layer of the heat-developable photosensitive material of the invention is an aqueous solvent that contains at least 30% by mass of water. For simple explanation, the solvent referred to herein includes both a solvent and a dispersion medium. The components other than water of the aqueous solvent may be any organic solvent that is miscible with water, including, for example, methyl alcohol, ethyl alcohol, isopropyl alcohol, methyl cellosolve, ethyl cellosolve, dimethylformamide, and ethyl acetate. The water content of the solvent of the coating liquid is preferably at least 50% by mass, and more preferably at least 70% by mass. Preferred examples of the solvent composition are water alone, a mixture of water and methyl alcohol at a mass ratio of 90/10, a mixture of water and methyl alcohol at a mass ratio of 70/30, a mixture of water, methyl alcohol and dimethylformamide at a mass ratio of 80/15/5, a mixture of water, methyl alcohol and ethyl cellosolve at a mass ratio of 85/10/5, and a mixture of water, methyl alcohol and isopropyl alcohol at a mass ratio of 85/10/5.

Description of Antifoggant

An antifoggant, a stabilizer and a stabilizer precursor usable in the invention are described, for example, in JP-A No. 10-62899, paragraph [0070]; EP-A No. 0803764A1, from page 20, line 57 to page 21, line 7; JP-A Nos. 9-281637 and 9-329864; U.S. Pat. No. 6,083,681; and EP No. 1,048,975. The antifoggant preferred for use in the invention is organic halides. These are described, for example, in JP-A No. 11-65021, paragraphs [0111] to [0112]. Organic halides of formula (P) in JP-A No. 2000-284399; organic polyhalogen compounds of formula (II) in JP-A No. 10-339934; and organic polyhalogen compounds in JP-A Nos. 2001-31644 and 2001-33911 are especially preferable.

Description of Polyhalogen Compound

An organic polyhalogen compound preferred for use in the invention is described concretely. Preferably, the polyhalogen compound for use in the invention is represented by the following formula (H).

$$Q\text{-}(Y)n\text{-}C(Z_1)(Z_2)X \qquad \text{Formula (H)}$$

wherein Q represents an alkyl group, an aryl group or a heterocyclic group; Y represents a divalent linking group; n indicates 0 or 1; $Z_1$ and $Z_2$ each represent a halogen atom; and X represents a hydrogen atom or an electron attractive group.

In formula (H), Q is preferably an aryl group or a heterocyclic group.

When Q in formula (H) is a heterocyclic group, it is preferably a nitrogen-containing heterocyclic group that contains one or two nitrogen atoms, and more preferably a 2-pyridyl group or a 2-quinolyl group.

When Q in formula (H) is an aryl group, it is preferably a phenyl group substituted with an electron attractive group having a positive Hammett's substituent constant up. As for the Hammett's substituent constant, for example, Journal of Medicinal Chemistry, 1973, Vol. 16, No. 11, 1207-1216 is referred to. Preferred examples of the electron attractive group are a halogen atom (a fluorine atom with $\sigma_p$ of 0.06, a chlorine atom with $\sigma_p$ of 0.23, a bromine atom with $\sigma_p$ of 0.23, or an iodine atom with $\sigma_p$ of 0.18), a trihalomethyl group (tribromomethyl with $\sigma_p$ of 0.29, trichloromethyl with $\sigma_p$ of 0.33, or trifluoromethyl with $\sigma_p$ of 0.54), a cyano group (with $\sigma_p$ of 0.66), a nitro group (with $\sigma_p$ of 0.78), an aliphatic, aryl or heterocyclic sulfonyl group (e.g., methanesulfonyl with $\sigma_p$ of 0.72), an aliphatic, aryl or heterocyclic acyl group (e.g., acetyl with $\sigma_p$ of 0.50, or benzoyl with $\sigma_p$ of 0.43), an alkynyl group (e.g., C≡CH with $\sigma_p$ of 0.23), an aliphatic, aryl or heterocyclic oxycarbonyl group (e.g., methoxycarbonyl with $\sigma_p$ of 0.45, or phenoxycarbonyl with $\sigma_p$ of 0.44), a carbamoyl group (with $\sigma_p$ of 0.36), a sulfamoyl group (with $\sigma_p$ of 0.57), a sulfoxide group, a heterocyclic group, and a phosphoryl group. The $\sigma_p$ of the electron attractive group is preferably 0.2 to 2.0, and more preferably 0.4 to 1.0. Among the preferred examples of the electron attractive group mentioned above, a carbamoyl group, an alkoxycarbonyl group, an alkylsulfonyl group, an alkylphosphoryl group, a carboxyl group, an aklyl or arylcarbonyl group and an arylsulfonyl group are more preferred, and a carbamoyl group, an alkoxycarbonyl group, an alkylsulfonyl group and an alkylphosphoryl group are still more preferred, a carboxyl group is the most preferred.

X is preferably an electron attractive group, more preferably a halogen atom, an aliphatic, aryl or heterocyclic sulfonyl group, an aliphatic, aryl or heterocyclic acyl group, an aliphatic, aryl or heterocyclic oxycarbonyl group, a carbamoyl group, or a sulfamoyl group, and even more preferably a halogen atom. The halogen atom represented by X is preferably a chlorine atom, a bromine atom or an iodine atom, and more preferably a chlorine atom or a bromine atom, and even more preferably a bromine atom.

Y is preferably —C(=O)—, —SO— or —$SO_2$—, more preferably —C(=O)— or —$SO_2$—, and even more preferably —$SO_2$—.

n is 0 or 1, but preferably 1.

Specific examples of the compounds of formula (H) for use in the invention are shown below.

(H-1)

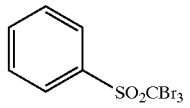

(H-2)

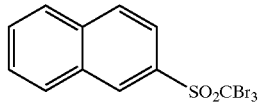

-continued
(H-3)
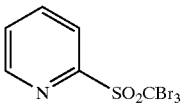
(H-4)
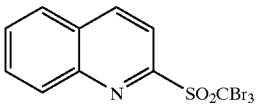
(H-5)
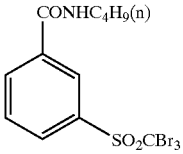
(H-6)
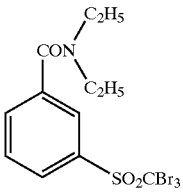
(H-7)
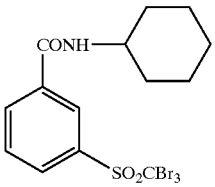
(H-8)
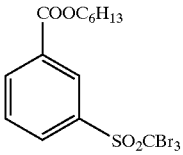
(H-9)
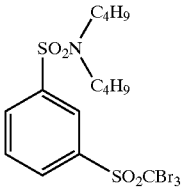
(H-10)
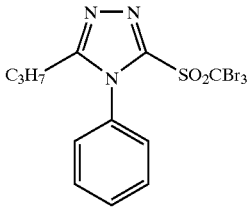
(H-11)
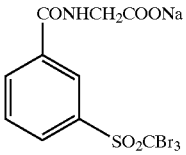
-continued
(H-12)
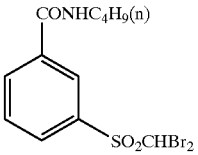
(H-13)
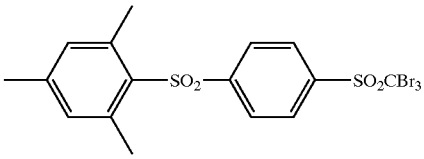
(H-14)
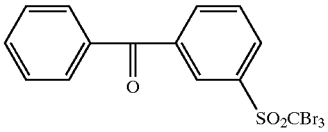
(H-15)
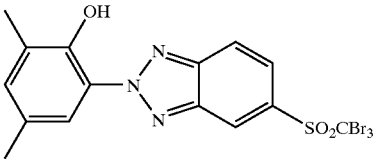
(H-16)
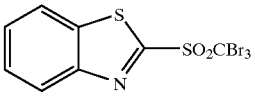
(H-17)
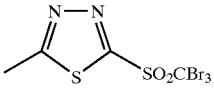
(H-18)
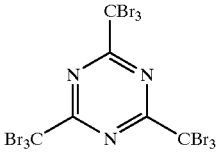
(H-19)
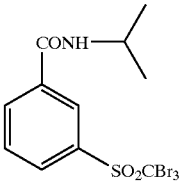
(H-20)
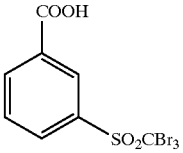
(H-21)
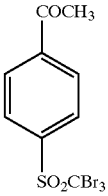

-continued (H-22)

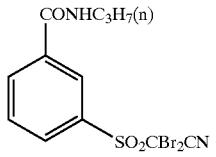

(H-23)

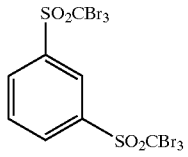

(H-24)

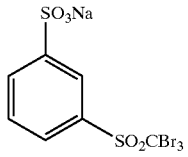

(H-25)

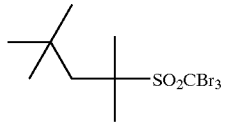

Preferred polyhalogen compounds usable herein other than the above compounds are described in JP-A 2001-31644, 2001-56526 and 2001-209145.

In the first aspect, the amount of the compound of formula (H) to be contained in the heat-developable photosensitive material of the invention is $10^{-4}$ to 1 mol, more preferably $10^{-3}$ to 0.5 mols, and even more preferably $1\times10^{-2}$ to 0.2 mols per mol of the non-photosensitive silver salt in the image-forming layer of the material. In the second aspect, the amount of the compound of formula (H) to be contained in the heat-developable photosensitive material of the invention is $10^{-4}$ to 0.8 mol, more preferably $10^{-3}$ to 0.1 mols, and even more preferably $5\times10^{-3}$ to 0.05 mols per mol of the non-photosensitive silver salt in the image-forming layer of the material.

In particular, when a silver halide of a composition having a high silver iodide content in the invention, the addition amount of the compound of the formula (H) is important in order to obtain a sufficient fogging preventive effect and it is most preferably used in an amount of $5\times10^{-3}$ to 0.03 mol.

The antifoggant may be incorporated into the heat-developable photosensitive material of the invention in the same manner as that mentioned hereinabove for incorporating the reducing agent thereinto. Preferably, the organic polyhalogen compound is in the form of a fine solid particle dispersion when it is incorporated into the material.

It is preferable that the compound represented by the formula (H) has a melting point of 200° C. or lower and preferably 170° C. or lower.

Other Antifoggant

Other antifoggant usable herein is mercury(II) salts in JP-A No. 11-65021, paragraph [0113]; benzoic acids in JP-A No. 11-65021, paragraph [0114]; salicylic acid derivatives in JP-A No. 2000-206642; formalin scavenger compounds of formula (S) in JP-A No. 2000-221634; triazine compounds recited in claim 9 in JP-A No. 11-352624; compounds of formula (III) in JP-A No. 6-11791; and 4-hydroxy-6-methyl-1,3,3a, 7-tetrazaindene.

Examples of the anti-foggant, stabilizer and stabilizer precursor usable in the invention include compounds described in JP-A No. 10-62899, paragraph [0070], EP-A No. 0803764A1, page 20, line 57 to page 21, line 7, and JP-A Nos. 9-281637 and 9-329864.

The heat-developable photosensitive material of the invention may also contain an azolium salt serving as an antifoggant. Examples of the azolium salt include compounds of formula (XI) in JP-A No. 59-193447, compounds in JP-B No. 55-12581, and compounds of formula (II) in JP-A No. 60-153039. The azolium salt may be present in any site of the heat-developable photosensitive material, but is preferably in a layer or layers on the surface of the material on which is present a photosensitive layer. More preferably, it is added to the organic silver salt-containing layer of the material. Regarding the time at which the azolium salt is added to the material, it may be added to the coating liquid at any stage of preparing the liquid. When it is to be present in the organic silver salt-containing layer, the azolium salt may be added to any of systems to prepare the organic silver salt or the system to prepare the coating liquid at any stage of preparing them. Preferably, however, it is added to the system after the stage of preparing the organic silver salt and just before the stage of applying the liquid. The azolium salt to be added may be in any form of a powder, a solution or a fine particle dispersion. It may be added along with other additives such as a sensitizing dye, a reducing agent and a color toning agent, for example, in the form of their solution. The amount of the azolium salt to be added to the heat-developable photosensitive material of the invention is not specifically limited, but is preferably $1\times10^{-6}$ mols to 2 mols, and more preferably $1\times10^{-3}$ mols to 0.5 mols, per mol of silver in the material.

Other Additives

1) Mercapto Compound, Disulfide Compound and Thione Compound

The heat-developable photosensitive material of the invention may optionally contain any of a mercapto compound, a disulfide compound and a thione compound in order to retard, promote or control development, or to enhance the spectral sensitivity efficiency of the material, or to improve the storability thereof before and after development. Examples of these compounds are disclosed in, for example, JP-A No. 10-62899, paragraphs [0067] to [0069]; compounds of formula (I) in JP-A No. 10-186572, and their examples in paragraphs [0033] to [0052]; EP-A No. 0803764A1, page 20, lines 36 to 56; and Japanese Pantent Application No. 11-273670. The mercapto-substituted hetero-aromatic compounds described in JP-A Nos. 9-297367, 9-304875 and 2001-100358, and Japanese Patent Application Nos. 2001-104213 and 2001-104214 are also especially preferable.

2) Color Toning Agent

The heat-developable photosensitive material of the invention preferably contains a color toning agent. Examples of the color toning agent usable herein are described in JP-A No. 10-62899, paragraphs [0054] to [0055], EP-A No. 0803764A1, page 21, lines 23 to 48; and JP-A Nos. 2000-356317 and 2000-187298. Phthalazinones (phthalazinone, phthalazinone derivatives and their metal salts, e.g., 4-(1-naphthyl)phthalazinone, 6-chlorophthalazinone, 5,7-dimethoxyphthalazinone, or 2,3-dihydro-1,4-phthalazinedione); combinations of phthalazinones and phthalic acids (e.g., phthalic acid, 4-methylphthalic acid, 4-nitrophthalic acid, diammonium phthalate, sodium phthalate, potassium phthalate, and tetrachlorophthalic anhydride); phthalazines (phthalazine, phthalazine derivatives and their metal salts, e.g., 4-(1-naphthyl)phthalazine, 6-isopropylphthalazine, 6-tertbutylphthalazine, 6-chlorophthalazine, 5,7-dimethoxyphthalazine, or 2,3-dihydrophthalazine); combinations of phthalazines and phthalic acids are preferred for use herein. When combined with a silver halide of a composition having a high silver iodide content, combinations of phthalazines and phthalic acids are preferable. Among such combinations, a combination of 6-isopropylphthalazine and phthalic acid or 4-methylphthalic acid is more preferable.

The addition amount of phthalazines is preferably from 0.01 to 0.3 mol, more preferably 0.02 to 0.2 mol and particularly preferably 0.02 to 0.1 mol based on 1 mol of the organic silver salt. The addition amount is an important factor for the development promotion which is a subject in the silver halide emulsion of a composition having a high silver iodide content in the invention, and sufficient developability and suppressed fogging are compatible by selection of an appropriate addition amount.

3) Plasticizer and Lubricant

A plasticizer and a lubricant that may be used in the photosensitive layer of the heat-developable photosensitive material of the invention are described in, for example, JP-A No. 11-65021, paragraph [0117]. Super-high contrasting agents for formation of super-high contrast images, methods of adding the same to a photosensitive material, and an amount thereof are described in, for example, JP-A No. 11-65021, paragraph [0118]; JP-A No. 11-223898, paragraphs [0136] to [0193]; compounds of formula (H), those of formulae (1) to (3) and those of formulae (A) and (B) in JP-A No. 2000-284399; and compounds of formulae (III) to (V) in Japanese Patent Application No. 11-91652, especially concrete compounds in [Formula 21] to [Formula 24] therein. Contrasting promoters are disclosed in JP-A No. 11-65021, paragraph [0102]; and JP-A No. 11-223898, paragraphs [0194] to [0195]. Lubricants are disclosed in JP-A No. 11-84573, paragraphs [0061] to [0069]; and Japanese Patent Application No. 11-106881, paragraphs [0049] to [0062].

4) Dye and Pigment

The photosensitive layer of the heat-developable photosensitive material of the invention may contain any dye and/or pigment (e.g., C.I. Pigment Blue 60, C.I. Pigment Blue 64, or C.I. Pigment Blue 15:6) in order to improve the color image tone, prevent interference fringes during laser exposure, and prevent irradiation. The details of such dyes and pigments are described in, for example, WO98/36322, and JP-A Nos. 10-268465 and 11-338098.

5) Super-High Contrasting Agent

In ordr to form super-high contrast images suitable to printing plates, the image-forming layer of the heat-developable photosensitive material of the invention preferably contains a super-high contrasting agent. The super-high contrasting agent, the method of adding the same, and an amount thereof are disclosed in, for example, JP-A No. 11-65021, paragraph [0118]; JP-A No. 11-223898, paragraphs [0136] to [0193]; compounds of formula (H), those of formulae (1) to (3) and those of formulae (A) and (B) in Japanese Patent Application No. 11-87297; and compounds of formulae (III) to (V) in Japanese Patent Application No. 11-91652, especially concrete compounds in [Formula 21] to [Formula 24] therein. Contrasting promoters are disclosed in JP-A No. 11-65021, paragraph [0102]; and JP-A No. 11-223898, paragraphs [0194] to [0195].

When formic acid or its salt is used as a strong foggant in the invention, it may be contained in the side of the heat-developable photosensitive material that has thereon an image-forming layer including photosensitive silver halide, and its amount is preferably at most 5 mmols, and more preferably at most 1 mmol per mol of silver.

When a super-high contrasting agent is used in the heat-developable photosensitive material of the invention, it is preferably combined with an acid formed through hydration of diphosphorus pentoxide or its salt. Examples of the acid formed through hydration of diphosphorus pentoxide and its salts include metaphosphoric acid (and its salts), pyrophosphoric acid (and its salts), orthophosphoric acid (and its salts), triphosphoric acid (and its salts), tetraphosphoric acid (and its salts), and hexametaphosphoric acid (and its salts). The acid formed through hydration of diphosphorus pentoxide and its salts is preferably orthophosphoric acid (and its salts), and/or hexametaphosphoric acid (and its salts). Specific examples thereof include sodium orthophosphate, sodium dihydrogen-orthophosphate, sodium hexametaphosphate, and ammonium hexametaphosphate.

The amount of the acid formed through hydration of diphosphorus pentoxide or its salt to be used herein (that is, the amount thereof per $m^2$ of the heat-developable photosensitive material) depends on the sensitivity, the fogging resistance and other properties of the material. Preferably, however, it is 0.1 to 500 $mg/m^2$, and more preferably 0.5 to 100 $mg/m^2$.

In the invention, the reducing agent, the hydrogen bonding compound, the development promoter and the polyhalogen compounds are preferably used in the form of their solid dispersions, and preferred production methods for these solid dispersions are descried in JP-A No. 2002-55405.

Preparation of Coating Liquid and Application Thereof.

The temperature at which the coating liquid for the image-forming layer is prepared is preferably 30° C. to 65° C., more preferably at least 35° C. but lower than 60° C., and even more preferably 35° C. to 55° C. Also preferably, the temperature of the coating liquid is kept at 30° C. to 65° C. immediately after a polymer latex is added thereto.

Layer Configuration and Constituent Components:

In the heat-developable photosensitive material of the invention, one or more image-forming layers are formed on a support. When the material has one image-forming layer, the layer comprises an organic silver salt, a photosensitive silver halide, a reducing agent and a binder, optionally containing any desired additives such as a color toning agent, a coating aid and other auxiliary agents. When the material has two or more image-forming layers, the first image-forming layer (in general, this is directly adjacent to the support) contains an organic silver salt and a photosensitive silver halide, and the second image-forming layer or the two layers must contain some of the other ingredients. A multi-color heat-developable photosensitive material of the invention may have combinations of these two layers for the respective colors, or may contain all the necessary ingredients in a single layer, as disclosed in U.S. Pat. No. 4,708,928. In the case of a multi-color heat-developable photosensitive material containing a plurality of dyes, a functional or non-functional barrier layer is disposed between adjacent emulsion layers (image-forming layers), as disclosed in U.S. Pat. No. 4,460,681.

The heat-developable photosensitive material of the invention may have at least one non-photosensitive layer in addition to an image-forming layer. Depending on their positions, the non-photosensitive layers are grouped into (a) a surface-protective layer to be disposed on an image-forming layer (a layer farther from the support than the image-forming layer); (b) an intermediate layer to be disposed between adjacent image-forming layers or between an image-forming layer and a protective layer; (c) a subbing layer to be disposed between an image-forming layer and a support; (d) a back layer to be disposed on a support opposite to an image-forming layer.

A layer that serves as an optical filter may be disposed in the material, and it may be the layer (a) or (b). An antihalation layer may be disposed in the material, and it may be the layer (c) or (d).

1) Surface-Protective Layer

The heat-developable photosensitive material of the invention may have a surface-protective layer for preventing adhesion of the image-forming layer thereof. The surface-protective layer may have a single-layered structure or a multi-layered structure. The details of the surface-protective layer are described, for example, in JP-A No. 11-65021, paragraphs [0119] to [0120], and JP-A No. 2000-171936.

Gelatin is preferred as the binder in the surface-protective layer, but polyvinyl alcohol (PVA) is also usable. Combining the two as the binders is also preferred in the invention. Gelatin for use herein may be inert gelatin (e.g., Nitta Gelatin 750), or gelatin phthalide (e.g., Nitta Gelatin 801). PVA usable herein may be those described in JP-A No. 2000-171936, paragraphs [0009] to [0020]. Specifically, PVA for use herein may be completely saponified one, PVA-105; partially saponified one, PVA-205 or PVA-335; or modified polyvinyl alcohol, MP-203 (all can be available from Kuraray). The polyvinyl alcohol content (per $m^2$ of the support) of one surface-protective layer is preferably 0.3 to 4.0 $g/m^2$, and more preferably 0.3 to 2.0 $g/m^2$.

The overall binder content (including water-soluble polymer and latex polymer)(per $m^2$ of the support) of one surface-protective layer is preferably 0.3 to 5.0 $g/m^2$, and more preferably 0.3 to 2.0 $g/m^2$.

2) Antihalation Layer

In the heat-developable photosensitive material of the invention, an antihalation layer may be disposed farther from the light source than the photosensitive layer.

The antihalation layer is described in, for example, JP-A No. 11-65021, paragraphs [0123] to [0124]; JP-A Nos. 11-223898, 9-230531, 10-36695, 10-104779, 11-231457, 11-352625 and 11-352626.

The antihalation layer contains an antihalation dye capable of absorbing the light to which the heat-developable photosensitive material is exposed. When the heat-developable photosensitive material is exposed to IR rays, an IR-absorbing dye may be used for antihalation. In that case, it is preferable that the dye does not absorb visible light.

On the other hand, when visible light-absorbing dye is used for antihalation, it is preferable that the dye used is substantially decolored after image formation on the material. For this, a decoloring means that decolors the dye when heated in the step of heat development can be used. Preferably, a thermal decoloring dye and a base precursor are contained in anon-photosensitive layer to function as an antihalation layer. The details of this technique are described in, for example, JP-A No. 11-231457.

The amount of the decoloring dye depends on the use of the dye. In general, its amount is so determined that the dye added can ensure an optical density (absorbance), measured at an intended wavelength, of larger than 0.1. In the first aspect, the optical density preferably is 0.15 to 2, and more preferably 0.2 to 1. In the second aspect, the optical density preferably is 0.2 to 2. The amount of the dye capable of ensuring the optical density within the range may be generally from 0.001 to 1 $g/m^2$.

Decoloring the dye in the heat-developable photosensitive material in that manner can lower the optical density of the material to 0.1 or less after heat development. Two or more different types of decoloring dyes may be contained in the thermodecoloring recording material or the heat-developable photosensitive material. Similarly, two or more different types of base precursors may be contained in the material.

In the thermodecoloring material that contains such a decoloring dye and a base precursor, it is preferable, in view of the thermodecoloring ability of the material, that the base precursor therein is combined with a substance which, when mixed with the base precursor, can lower the melting point of the mixture by at least 3° C. (e.g., diphenyl sulfone, 4-chlorophenyl(phenyl) sulfone, 2-naphthyl benzoate), as shown in JP-A No. 11-352626.

3) Back Layer

A back layer applicable to the invention is described in JP-A No. 11-65021, paragraphs [0128] to [0130].

In the invention, the heat-developable photosensitive material can include a coloring agent having an absorption maximum in the range of 300 and 450 nm in order to improve the silver tone and reduce change of image over time of the material. The coloring agent is described in, for example, JP-A Nos. 62-210458, 63-104046, 63-103235, 63-208846, 63-306436, 63-314535, 01-61745, and 2001-100363.

In general, the amount of the coloring agent to be contained in the material is 0.1 $mg/m^2$ to 1 $g/m^2$. Preferably, it is contained in the back layer that is opposite to the photosensitive layer of the material.

Also preferably, the heat-developable photosensitive material of the invention contains a dye that has an absorption maximum within a range of from 580 to 680 nm in order to control the base color tone of the material. The dye for that purpose is preferably those having a low absorption intensity in the short wavelength side, and more specifically oil-soluble azomethine dyes in JP-A Nos. 4-359967 and 4-359968 and water-soluble phthalocyanine dyes in Japanese Patent Application No. 2002-96797. The dye may be included in any layer of the material, but preferably in the non-photosensitive layer on the side coated with an emulsion layer or in a back face side.

Preferably, the heat-developable photosensitive material of the invention has, on one surface of its support, at least one photosensitive layer that contains a photosensitive silver halide emulsion, and has a back layer on the other surface thereof. This is referred to as a single-sided heat-developable photosensitive material.

4) Matting Agent

Preferably, the heat-developable photosensitive material of the invention contains a matting agent in a surface-protective layer and a back layer in order to improve the transporting properties of the material. The matting agent is described in JP-A No. 11-65021, paragraphs [0126] to [0127]. The amount of the matting agent to be contained in the heat-developable photosensitive material of the invention is preferably 1 to 400 $mg/m^2$, and more preferably 5 to 300 $mg/m^2$ of the material.

Regarding its shape, the matting agent for use in the invention may have any form including regular or irregular form, but regular particles are preferable, and spherical particles are more preferable. The mean particle size of the particles is preferably 0.5 to 10 $\mu$m, more preferably 1.0 to 8.0 $\mu$m, and still more preferably 2.0 to 6.0 $\mu$m. The fluctuation coefficient of the particle size distribution of the particles is preferably at most 50%, more preferably at most 40%, and even more preferably at most 30%. The particle size fluctuation coefficient is represented by (standard deviation of particle size)/(mean value of particle size)×100. Two different types of matting agents are also preferably combined for use herein, both having a small fluctuation coefficient but differing from each other in that the ratio of the mean particle size of the two is more than 3.

The matting degree at the surface of the emulsion layer is not specifically limited, so far as the matted layer surface is free from star dust defects, which are small missing portions of image portions and from which light leaks. However, the Beck's smoothness of the matted surface is preferably 30 seconds to 2000 seconds, and more preferably 40 seconds to 1500 seconds. The Beck's smoothness is readily obtained according to JIS P8119 (method of testing surface smoothness of paper and paperboard with Beck tester), and TAPPI Standard T479, which are incorporated by referene herein.

Regarding the matting degree of the back layer of the heat-developable photosensitive material of the invention, the Beck's smoothness of the matted back layer is preferably 10 seconds to 1200 seconds, more preferably 20 seconds to 800 seconds, and even more preferably 40 seconds to 500 seconds.

Preferably, the heat-developable photosensitive material of the invention contains the matting agent in the outermost surface layer, or in a layer functioning as an outermost surface layer, or in a layer near the outermost surface of the material. It may also preferably contain the matting agent in a layer of the material that functions as a protective layer.

5) Polymer Latex

When the heat-developable photosensitive material of the invention is used in the field of printing that requires high-level dimensional stability, it is preferable to use a polymer latex in the surface-protective layer or the back layer of the material. The polymer latex for that purpose is described in, for example, *Synthetic Resin Emulsions* (edited by Taira Okuda & Hiroshi Inagaki, the Polymer Publishing Association of Japan, 1978); *Applications of Synthetic Latexes* (by Takaaki Sugimura, Yasuo Kataoka, Sohichi Suzuki & Keiji Kasahara, the Polymer Publishing Association of Japan, 1993); and *Chemistry of Synthetic Latexes* (by Sohichi Muroi, the Polymer Publishing Association of Japan, 1970). Specific examples thereof include a methyl methacrylate (33.5 mass %)/ethyl acrylate (50 mass %)/methacrylic acid (16.5 mass %) copolymer latex; a methyl methacrylate (47.5 mass %)/butadiene (47.5 mass %)/itaconic acid (5 mass %) copolymer latex; an ethyl acrylate/methacrylic acid copolymer latex; a methyl methacrylate (58.9 mass %)/2-ethylhexyl acrylate (25.4 mass %)/styrene (8.6 mass %)/2-hydroxyethyl methacrylate (5.1 mass %)/acrylic acid (2.0 mass %) copolymer latex; and a methyl methacrylate (64.0 mass %)/styrene (9.0 mass %)/butyl acrylate (20.0 mass. %)/2-hydroxyethyl methacrylate (5.0 mass %)/acrylic acid (2.0 mass %) copolymer latex. As the binder for the surface-protective layer in the invention, the polymer latex combinations in Japanese Patent Application No. 11-6872; the techniques in JP-A No. 2000-267226, paragraphs [0021] to [0025]; the techniques in Japanese Patent Application No. 11-6872, paragraphs [0027] to [0028]; and the techniques in JP-A No. 2000-19678, paragraphs [0023] to [0041] can be used. The proportion of the polymer latex in the surface-protective layer or the back layer is preferably 10% by mass to 90% by mass, and more preferably 20% by mass to 80% by mass of all the binder (including a water soluble polymer and a latex polymer) in the layer.

6) Film Surface pH

Preferably, the heat-developable photosensitive material of the invention has a film surface pH of at most 7.0, and more preferably at most 6.6 before heat development. The lowermost limit of the pH is not specifically limited, but may be about 3. Most preferably, the pH is within a range of 4 to 6.2. In order to control the film surface pH of the heat-developable photosensitive material, nonvolatile acids, for example, organic acids such as phthalic acid derivatives or sulfuric acid, or volatile bases such as ammonia can be used. These are preferred since they are effective for reducing the film surface pH of the material. In particular, ammonia is preferable to attain a low film surface pH, since it is highly volatile, and therefore can be readily removed during coating or before heat development.

Combining ammonia with a nonvolatile base such as sodium hydroxide, potassium hydroxide or lithium hydroxide is also preferable. A method for measuring the film surface pH of the heat-developable photosensitive material is described in JP-A No. 2000-284399, paragraph [0123].

7) Film Hardener

A hardener may be contained in the photosensitive layer, the protective layer, the back layer and other layers of the heat-developable photosensitive material of the invention. The details of the hardener applicable to the invention are described in T. H. James' *The Theory of the Photographic Process,* 4th Edition (Macmillan Publishing Co., Inc., 1977), pp. 77–87. Examples thereof include chromium alum, 2,4-dichloro-6-hydroxy-s-triazine sodium salt, N,N-ethylenebis (vinylsulfonacetamide), N,N-propylenebis (vinylsulfonacetamide); polyvalent metal ions described on page 78 of that reference; polyisocyanates described in U.S. Pat. No. 4,281,060 and JP-A No. 6-208193; epoxy compounds described in U.S. Pat. No. 4,791,042; and vinylsulfone compounds described in JP-A No. 62-89048.

The hardener is added to the coating liquids in the form of its solution. The time at which the solution is added to the coating liquid for the protective layer may be from 180 minutes before coating the liquid to a time just before the coating, and preferably from 60 minutes before the coating to 10 seconds before it. There is no specific limitation on a method and conditions of adding the hardener to the coating liquid so long as they ensure the effect of the invention. Examples of an adding method include a method of mixing a hardener with a coating liquid in a tank in such a controlled manner that the mean residence time of the agent as calculated from the amount of the agent added and the flow rate of the coating liquid to a coater can be a predetermined period of time; and a method of mixing them with a static mixer, as disclosed in N. Harnby, M. F. Edwards & A. W. Nienow's *Liquid Mixing Technology*, Chapter 8 (translated by Koji Takahasi, published by Nikkan Kogyo Shinbun, 1989).

8) Surfactant

Surfactants applicable to the heat-developable photosensitive material of the invention are described in JP-A No. 11-65021, paragraph [0132]; solvents applicable thereto are in the same but in paragraph [0133]; supports applicable thereto are in the same but in paragraph [0134]; antistatic and electrically conductive layers applicable thereto are in the same but in paragraph [0135]; methods of forming color images applicable thereto are in the same but in paragraph [0136]; lubricants applicable thereto are in JP-A No. 11-84573, paragraphs [0061] to [0064] and Japanese Patent Application No. 11-106881, paragraphs [0049] to [0062].

The heat-developable photosensitive material of the invention preferably contains a fluorine-containing surfactant. Examples of the fluorine-containing surfactants that are preferred for use herein are disclosed, for example, in JP-A Nos. 10-197985, 2000-19680 and 2000-214554. Fluorine-containing polymer surfactants such as those in JP-A No. 9-281636 are also preferable for use herein. In the invention, the fluorine-containing surfactants described in JP-A No. 2002-82411, and Japanese Patent Application Nos. 2000-206560, 2001-242357 and 2001-264110 are especially preferred. In particular, the fluorine-containing surfactants described in Japanese Patent Application Nos. 2001-242357 and 2001-264110 are especially preferred in preparing aqueous coating liquids and in coating with them, since their ability to control the charging level, to stabilize the coated surface and to improve the slipping properties of the coated surface is good. The fluorine-containing surfactants described in Japanese Patent Application No. 2001-264110 are most preferable, since their ability to control the charging level is excellent and their amount to be used may be small.

The fluorine-containing surfactant may be used in any of the emulsion-coated surface and the back surface of the heat-developable photosensitive material of the invention, but is preferably used in both these surfaces of the material. More preferably, the surfactant is combined with the above-mentioned conductive layer containing a metal oxide. In this case, even when the amount of the fluorine-containing layer in the conductive layer side is reduced or removed, the heat-developable photosensitive material of the invention still has good properties.

Preferably, the amount of the fluorine-containing surfactant is from 0.1 mg/m$^2$ to 100 mg/m$^2$, more preferably from 0.3 mg/m$^2$ to 30 mg/m$^2$, and even more preferably from 1 mg/m$^2$ to 10 mg/m$^2$ in each of the emulsion-coated face and the back face of the material. In particular, the fluorine-containing surfactants described in Japanese Patent Application No. 2001-264110 are significantly effective, and the amount of the surfactant is preferably from 0.01 mg/m$^2$ to 10 mg/m$^2$, and more preferably from 0.1 mg/m$^2$ to 5 mg/m$^2$.

9) Antistatic Agent

The heat-developable photosensitive material of the invention preferably has as an antistatic layer an electrically conductive layer that contains a metal oxide or an electrically conductive polymer. The antistatic layer may also serve as a subbing layer or a back surface-protective layer, but may be provided separately from them. The electrically conductive material of the antistatic layer is preferably a metal oxide having increased electroconductivity by introducing an oxygen defect or a different metal atom into the metal oxide. Preferred examples of the metal oxide include ZnO, $TiO_2$ and $SnO_2$. It is preferable to add Al or In to ZnO, add Sb, Nb, P or a halogen element to $SnO_2$, and add Nb or Ta to $TiO_2$. In particular, $SnO_2$ with Sb added thereto is preferred. The amount of the different metal atom added is preferably from 0.01 to 30 mol %, and more preferably from 0.1 to 10 mol %. The shape of the metal oxide may be any one of spherical form, needle-like form and plate-like form but, in view of its electroconductivity, a needle-like particle having a long axis/short axis ratio of 2.0 or more, preferably from 3.0 to 50 is preferable. The amount of the metal oxide used is preferably from 1 to 1000 mg/m$^2$, more preferably from 10 to 500 mg/m$^2$, and even more preferably from 20 to 200 mg/m$^2$. In the heat-developable photosensitive material of the invention, the antistatic layer may be disposed either on the emulsion surface side or on the back surface side but is preferably between the support and the back layer. Specific examples of the antistatic layer that may be used in the heat-developable photosensitive material of the invention are described in JP-A No. 11-65021, paragraph [0135]; JP-A Nos. 56-143430, 56-143431, 58-62646 and 56-120519; JP-A No. 11-84573, paragraphs [0040] to [0051]; U.S. Pat. No. 5,575,957; and JP-A No. 11-223898, paragraphs [0078] to [0084].

10) Support

The support of the heat-developable photosensitive material of the invention may be a transparent support. Biaxially-oriented polyester films (especially polyethylene terephthalate) which have been heated at a temperature of 130 to 185° C. are preferable as the transparent support. The heat treatment is conducteed to remove the internal strain that may remain in the biaxially-oriented films and to prevent the film supports from thermally shrinking during heat development of the material. When the heat-developable photosensitive material is one for medical treatment, the transparent support thereof may be colored with a blue dye (for example, with Dye-1 used in the examples in JP-A No. 8-240877), or may not be colored. Specific examples of the support are described in Japanese Patent Application No. 11-65021, paragraph [0134]. Preferably, the support of the heat-developable photosensitive material of the invention is undercoated, for example, with a water-soluble polyester of JP-A No. 11-84574; a styrene-butadiene copolymer of JP-A No. 10-186565; or a vinylidene chloride copolymer of JP-A No. 2000-39684 or Japanese Patent Application No. 11-106881, paragraphs [0063] to [0080]. When the support is coated with an emulsion layer or a back layer, the water content of the support is preferably at most 0.5% by weight.

11) Other Additives

The heat-developable photosensitive material of the invention may optionally contain an antioxidant, a stabilizer, a plasticizer, a UV absorbent and/or a coating aid. A solvent described in JP-A No. 11-65021, paragraph [0133] may be used. Such additives may be contained in any of the photosensitive layers or the non-photosensitive layers of the material. The additives are described in WO 98/36322, EP-A No. 803764A1, and JP-A Nos. 10-186567 and 10-18568.

12) Coating Method

To fabricate the heat-developable photosensitive material of the invention, the coating liquids may be applied onto the support in any desired manner. Concretely, various types of coating techniques are employable herein, including, for example, extrusion coating, slide coating, curtain coating, dipping, knife coating, and flow coating. Various types of hoppers for extrusion coating employable herein are described in U.S. Pat. No. 2,681,294. Extrusion coating or slide coating described in Stephen F. Kistler & Petert M. Schweizer's *Liquid Film Coating* (Chapman & Hall, 1997), pp. 399–536 is preferable for the formation of the heat-developable photosensitive material of the invention. Slide coating is more preferable. One example of the shape of a slide coater for slide coating is shown in FIG. **11*b*-1**, on page 427 of that reference. If desired, two or more layers may be formed at the same time, for example, according to the methods described from page 399 to page 536 of that reference, or to the methods described in U.S. Pat. No. 2,761,791 and British Patent No. 837,095. Coating methods preferred for the invention are described in, for example, JP-A Nos. 2001-194748, 2002-153808, 2002-153803 and 2002-182333.

Preferably, the coating liquid for the organic silver salt-containing layer of the heat-developable photosensitive material of the invention is a thixotropic fluid. As for such fluid, the technique described in JP-A No. 11-52509 is referred to. Preferably, the coating liquid for the organic silver salt-containing layer in the invention has a viscosity of 400 mPa·s to 100,000 mPa·s, more preferably of 500 mPa·s to 20,000 mPa·s, at a shear rate of 0.1 sec$^{-1}$. The viscosity is preferably 1 mPa·s to 200 mPa·s, and more preferably 5 mPa·s to 80 mPa·s, at a shear rate of 1000 sec$^{-1}$.

When two liquids are mixed to prepare the coating liquid of the invention, a known in-line mixer or an in-plant mixer is preferably used. In-line mixer preferred for the invention is described in JP-A No. 2002-85948; and in-plant mixer preferred for the invention is in JP-A 2002-90940.

The coating liquid is preferably defoamed to improve the state of the surface coated with it. For example, the defoaming method described in JP-A 2002-66431 is preferred for the invention.

It is also preferable that the charge of the support is, before the support is coated with coating liquids, eliminated to prevent the support from attracting dust and others. For example, the charge elimination method preferred for the invention is described in JP-A No. 2002-143747.

In the invention, it is important to accurately control the drying air and the drying temperature in drying the coating liquid for a non-setting image-forming layer. The drying method preferred for the invention is described in detail in JP-A Nos. 2001-194749 and 2002-139814.

In fabricating the heat-developable photosensitive material of the invention, it is preferable that, after the coating liquids have been applied to the support to form the layers thereon and dried, the thus-fabricated material is heated to improve the film-forming properties of the coating liquids. The heating temperature measured on the film surface is preferably from 60° C. to 100° C., and the heating time is preferably from 1 second to 60 seconds. More preferably, the heating temperature is from 70 to 90° C. and the heating time is from 2 to 10 seconds. The heating method preferred for the invention is described in JP-A No. 2002-107872.

For stable and continuous fabrication of the heat-developable photosensitive material of the invention, the fabrication methods described in JP-A Nos. 2002-156728 and 2002-182333 are preferable.

Preferably, the heat-developable photosensitive material of the invention is monosheet type one. The monosheet type material does not require any additional sheet such as an image-receiving material, and may directly form images on itself.

13) Packaging Material

Preferably, the photographic material of the invention is packaged with a material having a low oxygen and/or moisture permeability to prevent its photographic properties from varying and to prevent it from curling or from having a curling habit while stored as unprocessed stocks. The oxygen permeability at 25° C. of the packaging material for use herein is preferably at most 50 ml/atm·m$^2$·day, more preferably at most 10 ml/atm·m$^2$·day, and even more preferably at most 1.0 ml/atm·m$^2$·day. Also, the moisture permeability thereof is preferably at most 10 g/atm·m$^2$·day, more preferably at most 5 g/atm·m$^2$·day, and even more preferably at most 1 g/atm·m$^2$·day.

Preferred examples of the packaging material having a low oxygen and/or moisture permeability for use herein are described, for example, in JP-A Nos. 8-254793 and 2000-206653.

14) Other Employable Techniques

Other techniques applicable to the heat-developable photosensitive material of the invention are described, for example, in EP-A Nos. 803764A1 and 883022A1, WO98/36322; JP-A Nos. 56-62648, 58-62644, 9-43766, 9-281637, 9-297367, 9-304869, 9-311405, 9-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2000-187298, 2000-10229, 2000-47345, 2000-206642, 2000-98530, 2000-98531, 2000-112059, 2000-112060, 2000-112104, 2000-112064 and 2000-171936.

When the heat-developable photosensitive material of the invention is a multi-color heat-developable photosensitive material, a functional or non-functional barrier layer is disposed between adjacent emulsion layers (photosensitive layers), as disclosed in U.S. Pat. No. 4,460,681.

Regarding its configuration, the multi-color heat-developable photosensitive material may have combinations of the two layers for each color, or may contain all the necessary ingredients in a single layer, as disclosed in U.S. Pat. No. 4,708,928.

Image-Forming Method

1) Exposure

The photographic material of the invention may be exposed in any manner, but is preferably exposed to scanning laser rays. A silver halide emulsion having a high silver iodide content as in the invention has low sensitivity, which has been problematic. However, it has been found that the problem of the low sensitivity can be overcome by writing images at high illumination such as writing with laser light and that images can be recorded with a smaller amount of energy. A desired sensitivity can be attained by writing in a short time by strong light.

Particularly, in order to obtain a maximum density (Dmax), the amount of light on the surface of the photosensitive material is preferably from 0.1 W/mm$^2$ to 100 W/mm$^2$, more preferably 0.5 W/mm$^2$ to 50 W/mm$^2$ and, and most preferably 1 W/mm$^2$ to 50 W/mm$^2$.

The laser which can be used in the invention is preferably a gas laser ($Ar^+$, He—Ne, He—Cd), a YAG laser, a dye laser, and a semiconductor laser. Further, a semiconductor laser and a second harmonic wave generation device may also be used. A laser used preferably is determined so that it can correspond to the light absorption peak wavelength of the spectral sensitizing dye in the heat-developable photosensitive material. The preferred laser is a red light-infrared light emitting He—Ne laser, a red light-emitting semiconductor laser, a blue light-green light emitting $Ar^+$, He—Ne, or He—Cd laser or a blue light-emitting semiconductor laser. In particular, a module in which an SHG (Second Harmonic Generator) device and a semiconductor laser are integrated and a blue light-emitting semiconductor laser has been developed in recent years, and a laser output device of a short wavelength region has been highlighted. Since the blue light-emitting semiconductor laser can record images highly precisely and can increase the recording density and has a long life and can obtain stable output, it is expected that the demand therefor will increase in the feature.

In the first aspect, the emission peak wavelength of the laser light used particularly preferably in the invention is from 300 nm to 500 nm, preferably, from 350 nm to 450 nm for blue light, and 600 nm to 900 nm, preferably, 620 nm to 870 nm for red to near infrared. Further, in the second aspect, it is from 300 nm to 500 nm, preferably 400 nm to 500 nm for blue light and 600 nm to 900 nm, preferably 620 nm to 850 nm for red to near infrared.

In addition, laser rays that oscillate in a longitudinal multi mode through high-frequency superimposition are also preferred for use in the invention.

2) Heat Development

The heat-developable photosensitive material of the invention may be developed in any manner. In general, after imagewise exposure, it is developed with heat. The temperature of the heat development is preferably 80 to 250° C., more preferably 100 to 140° C., and even more preferably 110 to 130° C. The development time is preferably 1 to 60 seconds, more preferably 3 to 30 seconds, even more preferably 5 to 30 seconds, and still more preferably 5 to 20 seconds.

Any of a drum heater system and a plate heater system can be used for heat development of the heat-developable photosensitive material but a plate heater system is preferable. A heat development method with the plate heater system is preferably a method described in JP-A No. 11-133572. In the plate heater system described therein, a heat-developable photosensitive material which has been exposed to form a latent image thereon is brought into contact with a heating unit in a heat development zone to thereby convert the latent image into a visible image. In this system, the heating unit comprises a plate heater, and multiple press rolls are disposed facing one surface of the plate heater. The exposed heat-developable photosensitive material is heated and developed while it is passing between the multiple press rolls and the plate heater. The plate heater is sectioned into 2 to 6 stages. It is preferable that the temperature of the top stage is kept lower by 1 to 10° C. than that of the others. For example, four plate heaters whose temperatures are independently controllable may be used, and the temperatures thereof are set at 112° C., 119° C., 121° C. and 120° C. Such a system is described in JP-A No. 54-30032. In the plate heater system, water and the organic solvent that remain in the heat-developable photosensitive material can be removed out of the material. In addition, deformation of the support caused by rapid heating thereof can be prevented.

For the miniaturization of a heat-developing device and for shortening of heat development time, it is preferable that the heaters used can be controlled more stably. In addition, it is also preferable that heat development of the exposed front portion of a sheet type material is started before exposure of the rear portion of the material has been finished. Imagers that enable rapid processing favorably for the invention are described in, for example, Japanese Patent Application Nos. 2001-088832 and 2001-091114.

3) System

Examples of laser imagers for medical treatment equipped with an exposure unit and a heat development unit include Fuji Medical Dry Laser Imager FM-DP L and Dry PIX 7000. The system FM-DP L is described in Fuji Medical Review No. 8, pp. 39–55. The technique disclosed therein is applicable to laser imagers for the heat-developable photosensitive material of the invention. In addition, the heat-developable photosensitive material of the invention can be processed with the laser imager in the AD Network which Fuji Film Medical has proposed as a network system adapted to DICOM Standards.

Applications of the Invention

The photosensitive silver halide emulsion and the heat-developable photosensitive material of the invention form a monochromatic image based on a silver image, and are favorable for use in medical diagnosis, industrial photography, printing, and COM.

EXAMPLES

The present invention is descried specifically by way of examples but the invention is not restricted to them.

Example 1

1) Preparation of Silver Halide Emulsion

Emulsion A 724 ml of an aqueous solution containing 74 g of silver nitrate and 800 ml of an aqueous solution containing 113 g of potassium iodide were simultaneously added to a reaction vessel containing 1400 ml of water at 55° C. containing 36 g of gelatin over 200 minutes by a controlled double jet method, while the content in the vessel was stirred. In the addition, the silver potential was kept at +60 mV until the addition amount of silver nitrate reached 22 g and thereafter the silver potential was kept at +220 mV. Then, desalting and washing with water were conducted and additional gelatin was added to the resultant. Thereafter, pH of the resultant mixture was adjusted to 5.0 and pAg to 5.2. Thus, a silver iodide particle emulsion was obtained. Silver iodide particles in the emulsion had an average grain size of 0.09 μm and a fluctuation coefficient of the grain size of 18%.

Emulsion B

After preparing silver iodide emulsion particles and desalting and washing with water in the same manner as those in Emulsion A, 64 μmol, per mol of the silver halide, of dimethylamine borane was added to the resultant emulsion and the resultant was aged at 55° C. for 150 min.

Emulsion C

After preparing silver iodide emulsion particles and desalting and washing with water in the same manner as those in Emulsion B, 64 μmol, per mol of the silver halide, of dimethylamine borane and 200 μmol, per mol of the silver halide, of a tellurium sensitizer (bis(N-phenyl-N-methylcarbamoyl telluride) were added to the resultant emulsion and the resultant was aged at 55° C. for 150 min.

Emulsion D

Emulsion D was prepared in the same manner as the preparation of Emulsion A except that 64 μmol, per mol of the silver halide, of dimethylamine borane was added to the system when the addition amount of silver nitrate reached 22 g.

Emulsion E

Emulsion E was prepared in the same manner as the preparation of Emulsion A except that 64 μmol, per mol of the silver halide, of dimethylamine borane and 200 μmol, per mol of the silver halide, of a tellurium sensitizer (bis (N-phenyl-N-methylcarbamoyl telluride) were added to the system when the addition amount of silver nitrate reached 22 g.

Emulsion B to Emulsion E had the same grain size as that of Emulsion A.

After adjusting pAg of each of the emulsions to 5.0, 4-hydroxy-6-methyl-1,3,3a,7-tetrazaindene, 1-phenyl-5-mercaptotetrazole (stabilizer and anti-foggant), sodium dodecylbenzenesulfonate (coating aid), 1,2-bis (vinylsulfonylacetylamino)ethane (film hardener) and phenoxy ethanol (preservative) were added to each of the emulsions. Each of the mixtures thus obtained and a gelatin protection layer coating liquid were applied onto a triacetyl cellulose film support by a simultaneous extruding method to obtain specimens 1 to 5 (shown in Table 1)

2) Evaluation of Performance

The specimens were exposed to light with a xenon light source through an optical wedge for 1/1000 second just after the application, developed with the following liquid developer at 38° C. for 20 min and subjected to ordinary stopping and fixing treatment. The densities of the treated specimens were measured. The sensitivity of each specimen was indicated by the inverse of the amount of exposure necessary to obtain an optical density when a fogging degree was +1.0 and the relative sensitivity of a specimen was obtained by multiplying together 100 and a quotient obtained by dividing the sensitivity of the specimen by that of specimen 1.

| Preparation for development solution | |
|---|---|
| Sodium hydrogen sulfite | 5 g |
| Pyrogalol | 10 g |
| Sodium sulfite | 25 g |
| Sodium carbonate mono-hydrate | 50 g |
| KI | 0.1 g |
| 10% aqueous formalin | 25 cc |

Water was added to the mixture containing the above components so that the total amount of the resultant mixuture was 1 liter.

TABLE 1

| Specimen | Emulsion | Fogging degree | Relative sensitivity | Remarks |
|---|---|---|---|---|
| 1 | A | 0.04 | 100 | Comp. Example |
| 2 | B | 0.07 | 252 | Comp. Example |
| 3 | C | 0.07 | 263 | Comp. Example |
| 4 | D | 0.04 | 308 | Example of invention |
| 5 | E | 0.05 | 344 | Example of invention |

As is apparent from Table 1, the emulsions of the present invention, which had been subjected to reduction sensitization during the formation of silver iodide particles, had a higher sensitivity and a lower fogging degree than comparative examples, which had been subjected to reduction sensitization after the completion of the formation.

Moreover, the sensitivity of specimen 5 which had been further sensitized with the tellurium compound was higher than that of specimen 4. The effect due to the combined use of tellurium sensitization and reduction sensitization was low in specimen 3 of the comparative example, meaning that the effect of the present invention is unexpectedly high.

Example 2

1) Preparation of Silver Halide Emulsion

Emulsion F

Emulsion F was prepared in the same manner as the preparation of Emulsion A except that, after keeping the silver potential at +220 mV, an aqueous solution of potassium bromide was simultaneously added to the system so that the amount of the aqueous solution corresponded to 5 mol % with respect to the silver nitrate. The resultant silver bromoiodide particles before desalting had a particle silver size of 0.11 μm and a fluctuation coefficient of the size of 24%.

Emulsion G

After preparing silver bromoiodide particles and desalting and washing with water in the same manner as those in Emulsion F, 64 μmol, per mol of the silver halide, of dimethylamine borane and 200 μmol, per mol of the silver halide, of a tellurium sensitizer (bis(N-phenyl-N-methylcarbamoyl telluride) were added to the resultant emulsion and the resultant was aged at 55° C. for 150 min.

Emulsion H

Emulsion H was prepared in the same manner as the preparation of Emulsion F except that 64 μmol, per mol of the silver halide, of dimethylamine borane and 200 μmol, per mol of the silver halide, of a tellurium sensitizer (bis (N-phenyl-N-methylcarbamoyl telluride) were added to the system when the addition amount of silver nitrate reached 22 g.

2) Evaluation of Performance

Coated specimens were prepared, exposed, developed and tested in the same manner as in Example 1 except that the relative sensitivity of a specimen was obtained by multiplying together 100 and a quotient obtained by dividing the sensitivity of the specimen by that of specimen 6. The results are shown in Table 2.

TABLE 2

| Specimen | Emulsion | Fogging Degree | Relative sensitivity | Remarks |
|---|---|---|---|---|
| 6 | F | 0.05 | 100 | Comp. Example |
| 7 | G | 0.09 | 270 | Comp. Example |
| 8 | H | 0.06 | 391 | Example of invention |

As is apparent from Table 2, the sample which had been subjected to reduction sensitization and tellurium sensitization during particle formation had a higher sensitivity, and a lower fogging level, than the sample which had been subjected to reduction sensitization and tellurium sensitization after completion of particle formation. Further, both when reduction sensitization alone was conducted as sensitization and when reduction sensitization and tellurium sensitization were both conducted, the sample, including the silver bromoiodide particle emulsion showed a more remarkable sensitizing effect than the samples which included the pure silver iodide particle emulsion. This was an unexpected effect, though the particle sizes of these samples did differ slightly.

Example 3

1. Preparation of PET Support

1) Film Preparation

PET was made of terephthalic acid and ethylene glycol in an ordinary manner, having an intrinsic viscosity, IV, of 0.66 (measured in a mixture of phenol and tetrachloroethane at an weight ratio of 6/4 at 25° C.). This was pelletized, and the resultant was dried at 130° C. for 4 hours, and melted at 300° C. The PET melt was extruded out from a T-die, and rapidly cooled. Thus, a non-oriented film whose thickness was so controlled that the thickness after thermal fixation was 175 μm was prepared.

The film was longitudinally oriented by rolls rotating at different circumferencial speeds at 110° C. so that the longitudinal length thereof after the orientation was 3.3 times as long as the original longitudinal length thereof. Next, the film was laterally oriented by a tenter at 130° C. so that the lateral length thereof after the orientation was 4.5 times as long as the original lateral length thereof. Next, the oriented film was thermally fixed at 240° C. for 20 seconds, and then laterally relaxed by 4% at the same temperature. Next, the chuck of the tenter was slitted, the both edges of the film were knurled, and the film was rolled up at 4 kg/cm$^2$. The rolled film had a thickness of 175 μm.

2) Surface Corona Discharging Treatment

Both surfaces of the support were subjected to corona treatment at room temperature at a speed of 20 m/min. with a Pillar's solid-state corona processor, Model 6 KVA. From the data of the current and the voltage read, it was seen that the support had been processed at 0.375 kV·A·min/$m^2$. The treatment frequency was 9.6 kHz, and the gap clearance between the electrode and the dielectric roll was 1.6 mm.

3) Subbing Treatment

Preparation of Coating Liquid for Subbing Layer

Formulation <1> (For Subbing Layer Below Image-forming Layer)

Takamatsu Yushi's PESURESIN A-520 (30 mass % solution) 59 g

Polyethylene glycol monononylphenyl ether (mean number of ethylene oxides: 8.5, 10 mass % solution) 5.4 g Soken Chemical's MP-1000 (polymer particles having a mean particle size of 0.4 μm) 0.91 g Distilled water 935 ml Formulation <2> (For First Layer on Back Surface)

Styrene-butadiene copolymer latex (solid content: 40 mass %, weight ratio of styrene and butadiene: 68/32) 158 g 2,4-Dichloro-6-hydroxy-S-triazine sodium salt (8 mass % aqueous solution) 20 g Sodium laurylbenzenesulfonate (1 mass % aqueous solution) 10 ml Distilled water 854 ml Formulation <3> (For Second Layer on Back Surface)

$SnO_2$/SbO (mass ratio: 9/1, mean particle size: 0.038 μm, 17 mass % dispersion) 84 g Gelatin (10 mass % aqueous solution)89.2 g Shin-etsu Chemical's METOLOSE TC-5 (2 mass % aqueous solution) 8.6 g Soken Chemical's MP-1000 0.01 g Sodium dodecylbenzenesulfonate (1 mass % aqueous solution) 10 ml NaOH (1 mass %) 6 ml PROXEL (from ICI) 1 ml Distilled water 805 ml Both surfaces of the biaxially oriented polyethylene terephthalate support (thickness: 175 μm) were subjected to corona discharge treatment in the above manner. One surface (to have a photosensitive layer thereon) of the support was coated with the coating liquid of subbing layer formulation <1> by the use of a wire bar so that the wet application amount of the coating liquid was 6.6 ml/$m^2$ (one surface), and then dried at 180° C. for 5 minutes. Next, the other surface (back surface) of the support was coated with the coating liquid of subbing layer formulation <2> by the use of a wire bar so that the wet application amount of the coating liquid was 5.7 ml/$m^2$, and then dried at 180° C. for 5 minutes. The back surface thus coated was further coated with the coating liquid of subbing layer formulation <3> by the use of a wire bar so that the wet application amount of the coating liquid was 7.7 ml/$m^2$, and then dried at 180° C. for 6 minutes. In that manner, the support was undercoated.

2. Back Layer

1) Preparation of Coating Liquid for Back Surface

Preparation of Coating Liquid for Antihalation Layer 60 g of gelatin, 24.5 g of polyacrylamide, 2.2 g of sodium hydroxide (1 mol/liter), 2.4 g of monodispersed polymethyl methacrylate particles (mean particle size: 8 μm, standard deviation of particle size: 0.4), 0.08 g of benzoisothiazolinone, 0.3 g of sodium polystyrenesulfonate, 0.21 g of blue dye compound-1, 0.15 g of yellow dye compound-1, and 8.3 g of acrylic acid/ethyl acrylate copolymer latex (copolymerization ratio of 5/95) were mixed. Water was added to the resulting mixture so that the total amount of the resultant was 818 ml. Thus, a coating liquid for antihalation layer was prepared.

Preparation of Coating Liquid for Back Surface-protective Layer

In a reactor kept at 40° C., 40 g of gelatin, 1.5 g of liquid paraffin in the form of a liquid paraffin emulsion, 35 mg of benzoisothiazolinone, 6.8 g of a caustic compound (1 mol/liter), 0.5 g of sodium t-octylphenoxyethoxyethanesulfonate, 0.27 g of sodium polystyrenesulfonate, 5.4 m of aqueous 2% solution of a fluorine-containing surfactant (F-1), 6.0 g of an acrylic acid/ethyl acrylate copolymer (copolymerization weight ratio: 5/95), and 2.0 g of N,N-ethylenebis (vinylsulfonacetamide) were mixed. Water was added to the resultant mixture so that the total amount of the mixutre became 1000 ml. Thus, a coating liquid for back surface-protective layer was prepared.

2) Formation of Back Layer

The coating liquid for antihalation layer was applied to the back face of the undercoated substrate. The amount thereof was such that the amount of gelatin of the antihalation layer was 0.88 g/$m^2$. At the same time, the coating liquid for back surface-protective layer was applied thereto and dried to form a back layer on the antihalation layer. The amount thereof was such that the amount of gelatin of the surface-protective layer was 1.2 g/$m^2$.

3. Image Forming Layer, Intermediate Layer and Surface Production Layer 3-1. Preparation of Coating Material Preparation of Silver Halide Emulsion Preparation of Silver Halide Emulsion I A solution obtained by adding 36.7 g of gelatin phthalide to 1420 ml of distilled water was kept at 42° C. in a stainless steel reactor while it was stirred. 195.6 ml of a solution A containing 22.22 g of silver nitrate diluted with distilled water, and 218 ml of a solution B containing 21.8 g of potassium iodide diluted with distilled water were added to the above solution at constant flow rates over 9 minutes.

Next, 317.5 ml of a solution C containing 51.86 g of silver nitrate diluted with distilled water, 600 ml of a solution D containing 57 g of potassium iodide diluted with distilled water, and 200 ml of a solution E containing 2.2 g of potassium bromide diluted with distilled water were added to the resultant by a controlled double jet method. At this time, the solutions C and E were added thereto over 120 minutes at a constant flow rate. Meanwhile, the solution D was added thereto so that the silver potential of the system was kept at +200 mV. When 10 minutes lapsed from the start of the addition of the solutions C and D to the system, $1\times10^{-4}$ mols, per mol of silver in the system, of potassium hexachloroiridate(III) was added to the system. When five seconds lapsed from the end of the addition of the solution C, $3\times10^{-4}$ mols, per mol of silver in the system, of aqueous iron (II) potassium hexacyanide solution was added to the system. Sulfuric acid (0.5 mol/liter) was added to the system to adjust the pH of the system at 3.8. Then, stirring the system was stopped, and steps of precipitating, desalting and washing with water were conducted. Sodium hydroxide (1 mol/liter) was added to the system to adjust the pH of the system at 5.9. A silver halide dispersion having pAg of 6 was thus prepared.

The silver halide particles thus prepared were silver bromoiodide particles and the mean diameter and fluctuation coefficient of spheres having the same volumes as those of the particles were 0.038 μm and 24%, respectively.

Preparation of Silver Halide Emulsion J

Silver halide emulsion J was prepared in the same manner as the preparation of the silver halide emulsion I except that 24 μmol of dimethylamine borane and 400 μmol of a tellurium sensitizer (bis(N-phenyl-N-methylcarbamoyl telluride) per 1 mol of the silver halide were added to the system after one minute lapsed from starting of the addition of the solutions C, E and D.

Preparation of Silver Halide Emulsion K

Emulsion K was prepared in the same manner as the preparation of the silver halide emulsion I except that 64 μmol dimethyl amine borane and 200 μmol of a tellurium sensitizer (bis(N-phenyl-N-methylcarbamoyl telluride) per 1 mol of the silver halide were added to the system after completing the formation of particles, and that the resultant was aged at 45° C. for 90 minutes.

The emulsions J and K had the same grain size as that of the emulsion I.

Preparation of Coating Liquid Emulsion

Each of the silver halide emulsions was dissolved, and $7\times10^{-3}$ mol of an aqueous 1 mass % solution of benzothiazolium iodide per mol of silver and 0.34 g of 1-(3-metylureidophenyl)-5-mercaptotetrazole per 1 kg of the emulsion were added to each emulsion.

$8\times10^{-3}$ mol of a compound (19) having an adsorptive group and a reducing group was added to each of the resultant emulsions per 1 mol of the silver halide.

2) Preparation of Dispersion of Silver Salt of Fatty Acid

Preparation of Recrystallized Behenic Acid 100 kg of behenic acid manufactured by Henkel Co. (trade name of product: Eden or C22-85R) was dissolved in 1200 kg of isopropyl alcohol at 50° C., and the resultant solution was filtered through a filter having a pore size of 10 μm and then cooled to 30° C. to recrystallize behenic acid. The cooling rate in the recrystallization was controlled to 3° C./hr. The solution was centrifugally filtered to collect recrystallized crystals, and the crystals were washed with 100 kg of isopropyl alcohol and then dried. The obtained crystals were esterified and the resultant was measured by GC-FID. The resultant had a behenic acid content of 96% and, in addition, included 2% of lignoceric acid, 2% of archidic acid and 0.001% of erucic acid.

Preparation of Dispersion of Silver Salt of Fatty Acid 88 kg of recrystallized behenic acid, 422 L of distilled water, 49.2 L of an aqueous NOH solution having a concentration of 5 mol/L and 120 L of t-butyl alcohol were mixed and reacted at 75° C. for one hour while the resultant system was stirred. Thus, a sodium behenate solution B was obtained. Separately, 206.2 L of an aqueous solution (pH 4.0) containing 40.4 kg of silver nitrate was prepared and kept at 10° C. A reaction vessel containing 635 L of distilled water and 30 L of t-butyl alcohol was kept at 30° C. The entire amount of the sodium behenate solution and the entire amount of the aqueous solution of silver nitrate were added to the content of the vessel at constant flow rates over 93 min. and 15 sec., and 90 min., respectively while the content in the vessel was sufficiently stirred. At this time, only the aqueous solution of silver nitrate was added for 11 min. after starting the addition of the aqueous solution of silver nitrate, addition of sodium behenate solution was started subsequently, and only the sodium behenate solution was added for 14 min. and 15 sec. after the completion of the addition of the aqueous solution of silver nitrate. At this time, the internal temperature of the reaction vessel was kept at 30° C. and the external temperature was controlled such that the liquid temperature was constant. The pipe line for the sodium behenate solution was a double-walled pipe and thermally insulated by circulating hot water through the interspace of the double-walled pipe, and the temperature of the solution at the outlet of the nozzle tip was adjusted at 75° C. The pipe line for the aqueous silver nitrate solution was also a double-walled pipe and thermally insulated by circulating cold water through the interspace of the double-walled pipe. Regarding the position at which the sodium behenate solution A was added to the reaction system and that at which the aqueous silver nitrate solution was added thereto, the two were disposed symmetrically to each other relative to the shaft of the stirrer disposed in the reactor, and the nozzle tips of the pipes were spaced apart from the reaction solution level in the reactor.

After adding the sodium behenate solution was finished, the reaction system was stirred for 20 minutes at that temperature, and then heated to 35° C. over 30 minutes. Thereafter, the system was aged for 210 minutes. Immediately after the completion of the ageing, the system was centrifugally filtered to take out a solid component, which was washed with water until the conductivity of the washing waste reached 30 μS/cm. The solid thus obtained was the silver salt of the fatty acid and was stored as wet cake without drying it.

The shapes of the silver behenate particle as obtained herein were analyzed on the basis of their images taken through electron microscopic photography. Average values of a, b, and c were 0.21 μm, 0.4 μm and 0.4 μm, respectively (a, b and c are defined hereinabove). The mean aspect ratio was 2.1. The fluctuation coefficient of spheres having the same volumes as those of the particles was 11%.

19.3 kg of polyvinyl alcohol (trade name, PVA-217) and water were added to the wet cake whose amount corresponded to 260 kg of the dry weight thereof so that the total amount of the resultant became 1000 kg. The resultant was formed into slurry with a dissolver wing, and then pre-dispersed with a pipe-line mixer (Model PM-10 available from Mizuho Industry Co.).

Next, the pre-dispersed stock slurry was processed three times in a disperser (MICROFLUIDIZER M-610 obtained from Microfluidex International Corporation, and equipped with a Z-type interaction chamber) at a controlled pressure of 1150 kg/cm$^2$. A silver behenate dispersion was thus prepared. To cool it, corrugated tube type heat exchangers were disposed before and after the interaction chamber. The temperature of the coolant in these heat exchangers was so controlled that the system could be processed at a dispersion temperature of 18° C.

3) Preparation of Reducing Agent Dispersion

Preparation of Reducing Agent-1 Dispersion 10 kg of a reducing agent-1 (2,2'-methylenebis-(4-ethyl-6-tert-butylphenol)), 16 kg of aqueous 10 mass % solution of modified polyvinyl alcohol (Kuraray's POVAL MP203) and 10 kg of water were sufficiently mixed to form slurry. The slurry was fed by a diaphragm pump into a horizontal sand mill (Imex's UVM-2) including zirconia beads having a mean diameter of 0.5 mm, and dispersed therewith for 3 hours. Then, 0.2 g of benzoisothiazolinone sodium salt and water were added thereto to adjust the reducing agent concentration of the resultant at 25% by mass. The dispersion was heated at 60° C. for 5 hours. A reducing agent-1 dispersion was thus prepared. The reducing agent particles in the dispersion had a median diameter of 0.40 μm, and a maximum particles size of at most 1.4 μm. The reducing agent dispersion was filtered through a polypropylene filter having a pore size of 3.0 μm to remove foreign objects such as dirt from it, and then stored.

Preparation of Reducing Agent-2 Dispersion 10 kg of a reducing agent-2 (6,6'-di-t-butyl-4,4'-dimethyl-2,2'-butylidenediphenol), 16 kg of aqueous 10 mass % solution of modified polyvinyl alcohol (Kuraray's POVAL MP203) and 10 kg of water were sufficiently mixed to form slurry. The slurry was fed by a diaphragm pump into a horizontal sand mill (Imex's UVM-2) including zirconia beads having a mean diameter of 0.5 mm, and dispersed therewith for 3 hours and 30 minutes. Then, 0.2 g of benzoisothiazolinone sodium salt and water were added thereto to adjust the reducing agent concentration of the resultant at 25% by mass. The dispersion was then heated at 40° C. for 1 hour, and then at 80° C. for 1 hour. A reducing agent-2 dispersion was thus prepared. The reducing agent particles in the dispersion had a median diameter of 0.50 μm, and a maximum particle size of at most 1.6 μm. The reducing agent dispersion was filtered through a polypropylene filter having a pore size of 3.0 μm to remove foreign objects such as dirt from it, and then stored.

4) Preparation of Hydrogen Bonding Compound-1 Dispersion 10 kg of a hydrogen bonding compound-1 (tri(4-t-butylphenyl)phosphine oxide), 16 kg of aqueous 10 mass % solution of modified polyvinyl alcohol (Kuraray's POVALMP203) and 10 kg of water were sufficiently mixed to form slurry. The slurry was fed by a diaphragm pump into a horizontal sand mill (Imex's UVM-2) containing zirconia beads having a mean diameter of 0.5 mm, and dispersed therewith for 4 hours. Then, 0.2 g of benzoisothiazolinone sodium salt and water were added thereto to adjust the hydrogen bonding compound concentration of the resultant at 25% by mass. The dispersion was heated at 40° C. for 1 hour and then at 80° C. for 1 hour. A hydrogen bonding compound-1 dispersion was thus prepared. The hydrogen bonding compound particles in the dispersion had a median diameter of 0.45 μm, and a maximum particle size of at most 1.3 μm. The hydrogen bonding compound dispersion was filtered through a polypropylene filter having a pore size of 3.0 μm to remove foreign objects such as dirt from it, and then stored.

5) Preparation of Development Promoter-1 Dispersion and Color Toning Agent Dispersion Preparation of Development Promoter-1 Dispersion 10 kg of a development promoter-1, 20 kg of aqueous 10 mass % solution of modified polyvinyl alcohol (Kuraray's POVAL MP203) and 10 kg of water were sufficiently mixed to form slurry. The slurry was fed by a diaphragm pump into a horizontal sand mill (Imex's UVM-2) containing zirconia beads having a mean diameter of 0.5 mm, and dispersed therewith for 3 hours and 30 minutes. Then, 0.2 g of benzoisothiazolinone sodium salt and water were added thereto to prepare a development promoter-1 dispersion having a development promoter concentration of 20% by mass. The development promoter particles in the dispersion had a median diameter of 0.48 μm, and a maximum particle size of at most 1.4 μm. The development promoter dispersion was filtered through a polypropylene filter having a pore size of 3.0 μm to remove foreign objects such as dirt from it, and then stored.

Preparation of Development Promoter-2 and Color Toning Agent-1 Solid Dispersions Development promoter-2 and color toning agent-1 solid dispersions having the respective concentrations of 20% by mass and 15% by mass were prepared in the same manner as the preparation of the development promoter-1 dispersion.

6) Preparation of Polyhalogen Compound Dispersion

Preparation of Organic Polyhalogen Compound-1 Dispersion 10 kg of an organic polyhalogen compound-1 (tribromomethanesulfonylbenzene), 10 kg of aqueous 20 mass % solution of modified polyvinyl alcohol (Kuraray's POVALMP203), 0.4 kg of aqueous 20 mass % solution of sodium triisopropylnaphthalenesulfonate, and 14 kg of water were sufficiently mixed to prepare slurry. The slurry was fed by a diaphragm pump into a horizontal sand mill (Imex's UVM-2) including zirconia beads having a mean diameter of 0.5 mm, and dispersed therewith for 5 hours. Then, 0.2 g of benzoisothiazolinone sodium salt and water were added thereto to prepare an organic polyhalogen compound-1 dispersion having an ogranic polyhalogen compound content of 30 mass %. The organic polyhalogen compound particles in the dispersion had a median diameter of 0.41 μm, and a maximum particle size of at most 2.0 μm. The organic polyhalogen compound dispersion was filtered through a polypropylene filter having a pore size of 10.0 μm to remove foreign objects such as dirt from it, and then stored.

Preparation of Organic Polyhalogen Compound-2 Dispersion 10 kg of an organic polyhalogen compound-2 (N-butyl-3-tribromomethanesulfonylbenzamide), 20 kg of aqueous 10 mass % solution of modified polyvinyl alcohol (Kuraray's POVAL MP203), and 0.4 kg of aqueous 20 mass % solution of sodium triisopropylnaphthalenesulfonate were sufficiently mixed to prepare slurry. The slurry was fed by a diaphragm pump into a horizontal sand mill (Imex's UVM-2) including zirconia beads having a mean diameter of 0.5 mm, and dispersed therewith for 5 hours. Then, 0.2 g of benzoisothiazolinone sodium salt and water were added thereto to adjust the organic polyhalogen compound content of the resultant at 30 mass %. The dispersion was heated at 40° C. for 5 hours. An organic polyhalogen compound-2 dispersion was thus obtained. The organic polyhalogen compound particles in the dispersion had a median diameter of 0.40 μm, and a maximum particle size of at most 1.3 μm. The organic polyhalogen compound dispersion was filtered through a polypropylene filter having a pore size of 3.0 μm to remove foreign objects such as dirt from it, and then stored.

7) Preparation of Phthalazine Compound-1 Solution 8 kg of modified polyvinyl alcohol MP 203 manufactured by Kuraray Co. was dissolved in 174.57 kg of water and then 3.15 kg of an aqueous 20 mass % solution of sodium triisopropylnaphthalenesulfonate and 14.28 kg of an aqueous 70 mass % solution of phthalazine compound-1 (6-isopropylphthalazine) were added to the resultant solution to prepare a 5 mass % solution of phthalazine compound-1.

8) Preparation of Mercapto Compound

Preparation of Mercapto Compound-1 Aqueous Solution 7 g of mercapto compound-1 (1-(3-sulfophenyl)-5-mercaptotetrazole sodium salt) was dissolved in 993 g of water to form an aqueous 0.7 mass % solution.

Preparation of Mercapto Compound-2 Aqueous Solution 20 g of mercapto compound-2 (1-(3-methylureidophenyl)-5-mercaptotetrazole) was dissolved in 980 g of water to form an aqueous 2.0 mass % solution.

9) Preparation of Pigment-1 Dispersion 64 g of C.I. Pigment Blue 60, 6.4 g of Kao's DEMOLE N and 250 g of water were sufficiently mixed to prepare slurry. 800 g of zirconia beads having a mean diameter of 0.5 mm were prepared and put into a vessel along with the slurry. The slurry in the vessel was dispersed by the use of a disperser (Imex's 1/4G Sand Grinder Mill) for 25 hours, and water was added to the slurry to prepare a pigment-1 dispersion having a pigment concentration of 5% by mass. The pigment particles in the dispersion thus prepared had a mean grain size of 0.21 μm.

11) Preparation of SBR Latex 287 g of distilled water, 7.73 g of a surfactant (Takemoto Yushi's PIONINA-43-S, having a solid content of 48.5%), 14.06 ml of 1 mol/liter NaOH, 0.15 g of tetrasodium ethylene diamine tetraacetate, 255 g of styrene, 11.25 g of acrylic acid, and 3.0 g of tert-dodecylmercaptan were put into the polymerization reactor of a gas monomer reaction apparatus (Taiatsu Glass Industry's TAS-2J Model). The reactor was sealed, and the content therein was stirred at 200 rpm. The internal air was exhausted via a vacuum pump, and purged a few times repeatedly with nitrogen. Then, 108.75 g of 1,3-butadiene was introduced into the reactor under pressure, and the internal temperature of the reactor was raised to 60° C. A solution in which 1.875 g of ammonium persulfate was dissolved in 50 ml of water was added to the system, and the system was stirred for 5 hour. It was further heated to 90° C. and stirred for 3 hours. After the reaction was completed, the internal temperature was lowered to room temperature. Then, NaOH and $NH_4OH$ (both 1 mol/liter) were added to the system at a molar ratio of $Na^+$ and $NH_4^+$ of 1/5.3 so as to adjust the pH of the system at 8.4. Next, the system was filtered through a polypropylene filter having a pore size of 1.0 μm to remove foreign objects such as dirt from it, and then stored. 774.7 g of SBR latex was thus obtained. Its halide ion content was measured through ion chromatography, and the chloride ion concentration of the latex was 3 ppm. The chelating agent concentration thereof was measured through high-performance liquid chromatography, and was 145 ppm.

The mean particle size of the latex was 90 nm, Tg thereof was 17° C., the solid content thereof was 44% by mass, the equilibrium moisture content thereof at 25° C. and 60% RH was 0.6% by mass, and the ion conductivity thereof was 4.80 mS/cm. To measure the ion conductivity, a To a Denpa Kogyo's conductivity meter CM-30 S was used. In the device, the 44 mass % latex was measured at 25° C. Its pH was 8.4.

3-2. Preparation of Coating Liquid

1) Preparation of Image Forming Layer Coating Liquid-1

The Pigment-1 dispersion, the organic polyhalogen compound-1 dispersion, the organic polyhalogen compound-2 dispersion, the phthalazine compound-1 solution, the SBR latex (Tg: 17° C.) liquid, the reducing agent-1 dispersion, the reducing agent-2 dispersion, the hydrogen bonding compound-1 dispersion, the development promotor-1 dispersion, the development promotor-2 dispersion, the color toning agent-1 dispersion, the aqueous solution of mercapto compound-1, and the aqueous solution of mercapto compound-2 were added successively to 1,000 g of the dispersion of the silver salt of the fatty acid obtained as described above and 276 ml of water. The silver halide emulsion mixture A was added to and throughly mixed with the resultant mixture just before application to form an image forming layer coating liquid, which was fed as it was to a coating die and applied to the support.

The viscosity of the image-forming coating liquid was 25 [mPa·S] when measured by a B-type viscometer at 40° C. (No. 1 rotor, 60 rpm).

The viscosities of the coating liquid at 25° C. when measured by using RFS Fluid Spectrometer manufactured by Rheometrics Far East Co. were 242, 65, 48, 26, and 20 [mPa·s], respectively, at shearing rates of 0.1, 1, 10, 100, and 1000 [1/sec].

The amount of zirconium in the coating liquid was 0.52 mg per 1 g of silver.

2) Preparation of Intermediate Layer Coating Liquid 27 ml of aqueous 5 mass % solution of AEROSOL OT (from American Cyanamid), 135 ml of aqueous 20 mass % solution of diammonium phthalate and water were added to 1000 g of a polyvinyl alcohol, Kuraray's PVA-205, 272 g of the pigment-1 dispersion, and 4200 ml of 19 mass % latex of a methyl methacrylate/styrene/butyl acrylate/hydroxyethyl methacrylate/acrylic acid copolymer (copolymerization ratio: 64/9/20/5/2 by weight) so that the total amount of the resultant mixture became 10000 g. The pH of the mixture was adjusted at 7.5 with the addition of NaOH. An intermediate layer coating liquid was thus obtained. This was fed into a coating die, with its flow rate so controlled that its coating amount was 9.1 ml/$m^2$.

The viscosity of the coating liquid at 40° C. was 58 [mPa·S] when measured by a B-type viscometer (No. 1 rotor, 60 rpm).

3) Preparation of a First Surface-Protective Layer Coating Liquid 64 g of inert gelatin was dissolved in water, and 112 g of 19.0 mass % latex of a methyl methacrylate/styrene/butyl acrylate/hydroxyethyl methacrylate/acrylic acid copolymer (copolymerization ratio: 64/9/20/5/2 by weight), 30 ml of 15 mass % methanol solution of phthalic acid, 23 ml of aqueous 10 mass % solution of 4-methylphthalic acid, 28 ml of sulfuric acid (0.5 mol/liter), 5 ml of aqueous 5 mass % solution of AEROSOL OT (from American Cyanamid), 0.5 g of phenoxyethanol, 0.1 g of benzoisothiazolinone, and water were added to the resultant solution so that the total amount of the resultant mixture became 750 g. Just before application thereof, 26 ml of 4 mass % chromium alum was added to the mixture, and the resultant was stirred with a static mixer. The resultant coating liquid was fed into a coating die so that the amount of the resultant coating was 18.6 ml/$m^2$.

The viscosity of the coating liquid at 40° C. was 20 [mPa·S] when measured by a B-type viscometer (No. 1 rotor, 60 rpm).

4) Preparation of a Second Surface-Protective Layer Coating Liquid 80 g of inert gelatin was dissolved in water, and 102 g of 27.5 mass % latex of a methyl methacrylate/styrene/butyl acrylate/hydroxyethyl methacrylate/acrylic acid copolymer (copolymerization ratio: 64/9/20/5/2 by weight), 5.4 ml of a 2 mass % solution of a fluorine-containing surfactant (F-1), 5.4 ml of an aqueous 2 mass % solution of a fluorine-containing surfactant (F-2), 23 ml of a 5 mass % solution of AEROSOL OT (from American Cyanamid), 4 g of fine polymethyl methacrylate particles (mean particle size: 0.7 μm), 21 g of fine polymethyl methacrylate particles (mean particle size: 4.5 μm), 1.6 g of 4-methylphthalic acid, 4.8 g of phthalic acid, 44 ml of sulfuric acid (0.5 mol/liter), 10 mg of benzoisothiazolinone, and water were added to the resultant solution so that the total amount of the resultant mixture became 650 g. Just before application thereof, 445 ml of aqueous solution containing 4 mass % of chromium alum and 0.67 mass % of phthalic acid was added to the mixture, and the resultant was stirred with a static mixer. A second surface protection layer coating liquid was thus obtained. The coating liquid was fed into a coating die, with its flow rate so controlled that its coating amount was 8.3 ml/$m^2$.

The viscosity of the coating liquid at 40° C. was 19 [mPa·S] when measured by a B-type viscometer (No. 1 rotor, 60 rpm).

3-3. Preparation of Heat-Developable Photosensitive Materials

An image forming layer, an intermediate layer, a first surface-protective layer, and a second surface-protective layer were coated simultaneously by a slide bead coating method on the surface opposite to the back surface in this order from an undercoat layer to prepare specimens of heat-developable photosensitive materials. The temperature was controlled at 31° C. for the image forming layer and the intermediate layer, at 36° C. for the first surface-protective layer, and at 37° C. for the second surface-protective layer.

The coating amount ($g/m^2$) of each of the compounds in the image forming layer is as described below.

| | |
|---|---|
| Silver behenate | 5.27 |
| Pigment (C. I. Pigment Blue 60) | 0.036 |
| Polyhalogen compound - 1 | 0.09 |
| Polyhalogen compound - 2 | 0.14 |
| Phthalazine compound -1 | 0.18 |
| SBR latex | 9.43 |
| Reducing agent - 1 | 0.55 |
| Reducing agent - 2 | 0.22 |
| Hydrogen bonding compound - 1 | 0.28 |
| Development promotor - 1 | 0.025 |
| Development promotor - 2 | 0.020 |
| Color toning agent - 1 | 0.008 |
| Mercapto compound - 1 | 0.002 |
| Mercapto compound - 2 | 0.006 |
| Silver halide (as Ag) | 0.046 |

Coating and drying conditions are shown below.

Before coating, the static electricity of the support was eliminated by blowing an ion blow to the support. The coating speed was 160 m/min. The coating and drying conditions for each sample were controlled within the range mentioned below so that the coated surface was stabilized to the best.

The distance between the coating die tip and the support was between 0.10 and 0.30 mm. The pressure in the decompression chamber was lower by 196 to 882 Pa than the atmospheric pressure. In the subsequent chilling zone, the coated support was chilled with an air blow (its dry-bulb temperature was 10 to 20° C.). In the next helix type contactless drying zone, the support was dried with a dry air blow (its dry-bulb temperature was 23 to 45° C., and its wet-bulb temperature was 15 to 21° C.). In this zone, the coated support to be dried was kept not in contact with the drier. After the drying, the support was conditioned at 25° C. and 40 to 60% RH, and then heated so that the surface temperature was between 70 and 90° C. After thr heating, the support was cooled to have a surface temperature of 25° C.

The degree of matting, in terms of the Beck's smoothness, of the heat-developable photosensitive material thus prepared was 550 seconds on the photosensitive layer-coated surface thereof and 130 seconds on the back surface thereof. The pH of the photosensitive layer-coated surface of the sample was measured and was 6.0.

Chemical structures of the compounds used in this Example are shown below.

Compound (19) having adsorptive group and reducing group

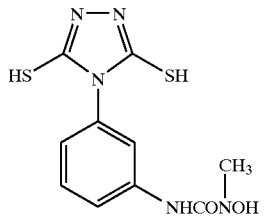

-continued

Blue dye compound-1

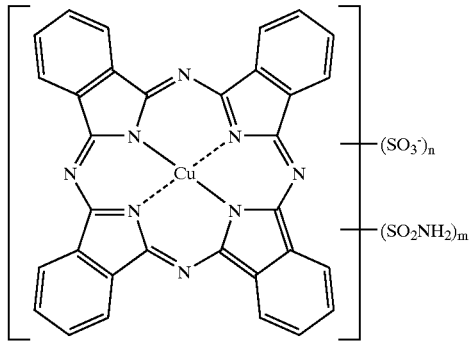

n = 1~3
m = 1~3

Yellow dye compound-1

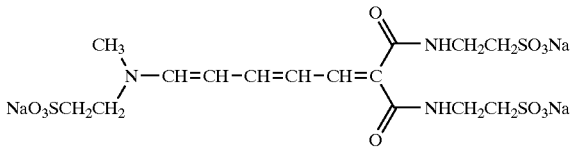

Reducing agent-1

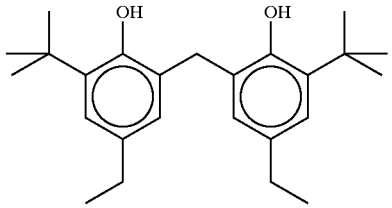

Reducing agent-2

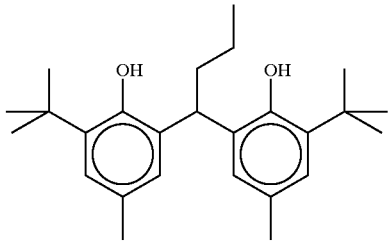

Hydrogen bonding compound-1

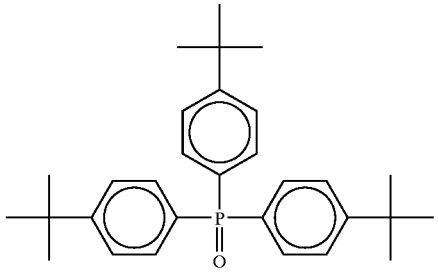

Polyhalogen compound-1

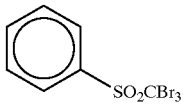

-continued

Polyhalogen compound-2

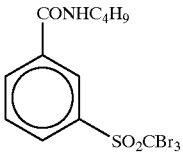

Mercapto compound-1

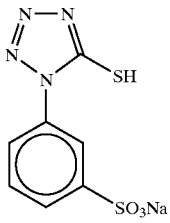

Mercapto compound-2

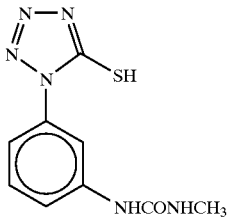

Phthalazine compound-1

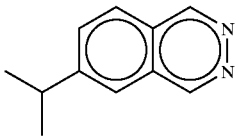

Development promoter-1

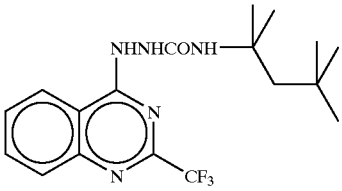

Development promoter-2

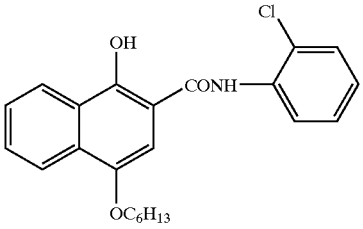

Color toning agent-1

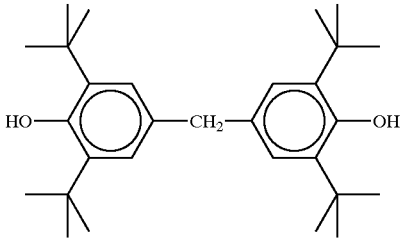

Compound F-1

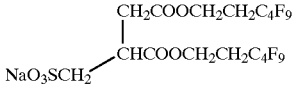

-continued

Compound F-2

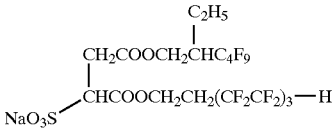

Evaluation of Photographic Performance

Each specimen thus prepared was cut into pieces of a half-size, packaged with a packaging material mentioned below at 25° C. and 50% RH, and tested according to the test method mentioned below.

Packaging Material

The packaging material used herein was a film comprising a PET film having a thickness of 10 $\mu$m, a PE film having a thickness of 12 $\mu$m, an aluminium foil having a thickness of 9 $\mu$m, a nylone film having a thickness of 15 $\mu$m, and a 3% carbon-containing polyethylene having a thickness of 50 $\mu$m, and having an oxygen permeability of 0.02 ml/atm·m$^2$·25° C.·day and a moisture permeability of 0.10 g/atm·m$^2$·25° C.·day.

A laser source, Nichia Chemical Industry's semiconductor laser NLHV3000E was set in the exposure zone of Fuji Medical Dry Laser Imager FM-DPL, and its beam diameter was narrowed down to 100 $\mu$m. With the intensity of laser light on the surface of the heat-developable photosensitive material specimen controlled to be 0 or within a range of from 1 mW/mm$^2$ to 1000 mW/mm$^2$, the specimen was exposed to the laser light for $10^{-6}$ seconds. The laser light oscillation wavelength was 405 nm. In the heat development, the temperatures of four panel heaters were set at 112° C., 118° C., 120° C. and 120° C., respectively and the total development time was set at 14 seconds by accelerating the conveying speed. The density of the image formed was measured with a densitometer.

From the density measured, characteristic curves of the density relative to the amount of exposure was depicted. The sensitivity was indicated by the inverse of the amount of exposure providing a fogging level of +3.5 and the relative sensitivity of a specimen was obtained by multiplying together 100 and a quotient obtained by dividing the sensitivity of the specimen by that of specimen 9 and was shown below.

TABLE 3

| Specimen | Emulsion | Dmin | Dmax | Relative sensitivity | Remarks |
|---|---|---|---|---|---|
| 9 | I | 0.16 | 4.1 | 100 | Comp. Example |
| 10 | J | 0.16 | 4.3 | 209 | Example of invention |
| 11 | K | 0.21 | 4.3 | 178 | Comp. Example |

As is seen from the result of Table 3, when reduction sensitization and tellurium sensitization were applied after the completion of the particle formation, fogging also tended to increase along with sensitivity. However, when they were applied during the particle formation, high sensitizing effect and less fogging could be obtained.

Example 4

Specimens were prepared and tested in the same manner as in Example 3 except that $8\times10^{-3}$ mol, per mol of silver halide, of Compound (20) whose one electron oxidant formed through one electron oxidation can release at least one electron was used instead of the compound (19) having the absorptive group and the reducing group. Results similar to those shown in Table 3 were obtained.

Compound (20) whose one electron oxidant formed through one electron oxidation can release at least one electron.

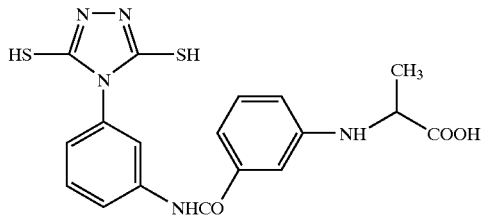

Example 5

1. Silver Halide Emulsion 1-1 Preparation of Silver Halide Emulsion

Preparation of Emulsion A

This is a comparative emulsion.

A solution obtained by adding 36.7 g of gelatin phthalide to 1420 ml of distilled water was stirred in a stainless steel reactor at a liquid temperature of 50° C. 195.6 ml of a solution A in which 22.22 g of silver nitrate was diluted with distilled water and 218 ml of a solution B in which 21.8 g of potassium iodide was diluted with distilled water were added to the above solution at constant flow rates over 10 minutes.

Further, 317.5 ml of a solution C in which 51.86 g of silver nitrate was diluted with distilled water and 600 ml of a solution D in which 60 g of potassium iodide was diluted with distilled water were added to the resultant solution by a controlled double jet method. At this time, the whole amount of the solution C was added at a constant flow rate over 120 minutes. Moreover, the solution D was added while the silver potential was kept at +220 mV. When 10 minutes lapsed from the start of the addition of the solutions C and D to the system, $1\times10^{-4}$ mols, per mol of silver in the system, of potassium hexachloroiridate(III) was added to the system. When five seconds lapsed from the end of the addition of the solution C, $3\times10^{-4}$ mols, per mol of silver in the system, of aqueous iron (II) potassium hexacyanide solution was added to the system. Sulfuric acid (0.5 mol/liter) was added to the system to adjust the pH of the system at 3.8. Then stirring the system was stopped, and steps of precipitating, desalting and washing with water were conducted. Sodium hydroxide (1 mol/liter) was added to the system to adjust the pH of the system at 5.9. A silver halide dispersion having pAg of 5 was thus prepared. The silver halide particles of the thus prepared Emulsion A were silver iodide particles particles and the mean diameter and fluctuation coefficient of spheres having the same volumes as those of the particles were 0.041 $\mu$m and 22%, respectively.

Preparation of Emulsions B-1, C-1, D-1, and E-1

They are also comparative emulsions.

An emulsion was prepared in the same manner as the preparation of the Emulsion A. After completing the particle formation, they were divided into portions and 1 mmol of sodium thiosulfate as a sulfur sensitizer (Emulsion B-1), 0.5 mmol of diphenyl-pentafluorphenylphosphine selenide as a selenium sensitizer (Emulsion C-1), 0.5 mmol of bis(N-phenyl-N-methylcarbamoyl telluride) as a tellurium sensitizer (Emulsion D-1), and 1 mmol of sodium thiosulfate as a sulfur sensitizer and 0.26 mmol of chloroauric acid (Emulsion E-1) was added to the portions, respectively, per mol of silver at 40° C., and the resultant mixtures were aged at 55° C. for 90 minutes to obtain silver halide emulsions from B-1 to E-1.

Preparation of Emulsion B-2

This is an emulsion of the invention.

Emulsion B-2 was obtained in the same manner as preparation of emulsion A except that 1 mmol, per mol of silver, of sodium thiosulfate was added as a sulfur sensitizer one minute before addition of the solution C and the solution D.

Preparation of Emulsion C-2

This is an emulsion of the invention.

Emulsion C-2 was obtained in the same manner as preparation of emulsion A except that 0.5 mmol, per mol of silver, of diphenyl-pentafluorophenylphosphine selenide was added as a selenium sensitizer one minute before addition of the solution C and the solution D.

Preparation of Emulsion D-2

This is an emulsion of the invention.

Emulsion D-2 was obtained in the same manner as preparation of emulsion A except that 0.5 mmol, per mol of silver, of bis(N-phenyl-N-methylcarbamoyl telluride) was added as a tellurium sensitizer one minute before addition of the solution C and the solution D.

Preparation of Emulsion E-2

This is an emulsion of the invention.

Emulsion E-2 was obtained in the same manner as preparation of emulsion A except that 1 mmol, per mol of silver, of sodium thiosulfate serving as a sulfur sensitizer and 0.26 mmol, per mol of silver, of chloroauric acid were added one mintue before addition of the solution C and the solution D.

Emulsion B-2 to Emulsion E-2 had the same grain size as that of Emulsion A.

1-2. Preparation of Coating Specimen

After adjusting pAg and pH of each of the above-described emulsions to 5.0 and 5.9, respectively, 4-hydroxy-6-methyl-1,3,3a,7-tetrazaindene and 1-phenyl-5-mercaptotetrazole (stabilizer and anti-foggant), sodium dodecylbenzenesulfonate (coating aid), 1,2-bis(vinylsulfonyl acetylamino)ethane (film hardener), and phenoxy ethanol (antiseptic) were added to each emulsion and the resultant was applied to a triacetylcellulose film support together with a gelatin protection layer by a simultaneous extrusion method to obtain specimens 1 to 9.

1-3. Exposure and Development

The specimens were exposed to light from a xenon light source through an optical wedge for 1/1000 second just after the coating, developed with the following liquid developer at 38° C. for 20 min and subjected to ordinary stopping and fixing treatment. The densities of the treated specimens were measured, and the sensitivity was indicated by the inverse of the exposure amount necessary for obtaining an optical density when fogging level was +1.0. The relative sensitivity of a specimen was obtained by multiplying together 100 and a quotient obtained by dividing the sensitivity of the specimen by that of specimen 1 and shown in Table 4.

| Formulation of liquid developer | |
|---|---|
| Sodium bisulfite | 5 g |
| Pyrogalol | 10 g |
| Sodium sulfite | 25 g |
| Sodium carbonate mono-hydrate | 50 g |

-continued

| Formulation of liquid developer | |
|---|---|
| KI | 0.1 g |
| 10% aqueous formalin | 25 cc |

Water was added to the resultant mixture so that the total amount of the mixture was 1 liter.

TABLE 4

| Specimen No. | Emulsion No. | Fogging level | Relative sensitivity | Remarks |
|---|---|---|---|---|
| 1 | A | 0.03 | 100 | Comp. Example |
| 2 | B-1 | 0.03 | 329 | Comp. Example |
| 3 | B-2 | 0.03 | 309 | Example of invention |
| 4 | C-1 | 0.12 | 402 | Comp. Example |
| 5 | C-2 | 0.05 | 364 | Example of invention |
| 6 | D-1 | 0.03 | 516 | Comp. Example |
| 7 | D-2 | 0.03 | 480 | Example of invention |
| 8 | E-1 | 0.03 | 382 | Comp. Example |
| 9 | E-2 | 0.03 | 368 | Example of invention |

It is known that when a silver halide is immersed in a diluted aqueous KCN solution, most of gold ions at the gold sensitization centers formed on the surface of particles escape, whereas gold ions taken into the insides of the silver halide particles do not escape. Then, after immersing coating specimens 8 and 9 in an aqueous solution containing 400 mg/L of KCN at 20° C. for 10 minutes, the amount of gold was measured by an atomic absorption method. Of the total coated amount of gold, only 6% remained and most of gold escaped from the specimen 8. On the other hand, 82% of gold remained and a considerable amount of the gold sensitizer was indeed incorporated in the insides of the particles in the specimen 9. Further, it is known that since the liquid developer described above does not dissolve the particles so much, the sensitivity substantially on the surface of the particles is observed.

As is apparent from Table 4, although the specimen which had been subjected to chalcogen sensitization such as sulfur, selenium or tellurium sensitization and/or gold sensitization in the course of the formation of silver iodide particles had slightly lower sensitivity than the specimen which had been subjected to chalcogen sensitization and/or gold sensitization after completing the formation of silver iodide particles, the former specimen had an expectedly high surface sensitivity. Moreover, the former specimen had low fogging level. Since it has been well-known that silver bromide emulsion particles which have been subjected to chalcogen sensitization or gold sensitization in the course of the particle formation have remarkably low surface sensitivity, the foregoing effect cannot be anticipated at all therefrom.

2. Heat-developable Photosensitive Material 2-1 Preparation of Heat-Developable Photosensitive Material Using the silver halide emulsion prepared in Example 5, heat-developable photosensitive materials were prepared by the following procedures.

1. Preparation of PET Support

PET was made of terephthalic acid and ethylene glycol in an ordinary manner, having an intrinsic viscosity, IV, of 0.66 (measured in a mixture of phenol and tetrachloroethane at an weight ratio of 6/4 at 25° C.). This was pelletized, and the resultant was dried at 130° C. for 4 hours, and melted at 300° C. The PET melt was extruded out from a T-die, and rapidly cooled. Thus, a non-oriented film whose thickness was so controlled that the thickness after thermal fixation was 175 μm was prepared.

The film was longitudinally oriented by rolls rotating at different circumferencial speeds at 110° C. so that the longitudinal length thereof after the orientation was 3.3 times as long as the original longitudinal length thereof. Next, the film was laterally oriented by a tenter at 130° C. so that the lateral length thereof after the orientation was 4.5 times as long as the original lateral length thereof. Next, the oriented film was thermally fixed at 240° C. for 20 seconds, and then laterally relaxed by 4% at the same temperature. Next, the chuck of the tenter was slitted, the both edges of the film were knurled, and the film was rolled up at 4 kg/cm$^2$. The rolled film had a thickness of 175 μm.

Surface Corona Discharging Treatment

Both surfaces of the support were subjected to corona treatment at room temperature at a speed of 20 m/min. with a Pillar's solid-state corona processor, Model 6 KVA. From the data of the current and the voltage read, it was seen that the support had been processed at 0.375 kV·A·min/m$^2$. The treatment frequency was 9.6 kHz, and the gap clearance between the electrode and the dielectric roll was 1.6 mm.

Subbing Treatment

1) Preparation of Coating Liquid for Subbing Layer

Formulation <1> (For Subbing Layer Below Image-Forming Layer)

Takamatsu Yushi's PESURESIN A-520 (30 mass % solution) 59 g

Polyethylene glycol mononononylphenyl ether (mean number of ethylene oxides: 8.5, 10 mass % solution) 5.4 g Soken Chemical's MP-1000 (polymer particles having a mean particle size of 0.4 μm) 0.91 g Distilled water 935 ml Formulation <2> (For First Layer on Back Surface)

Styrene-butadiene copolymer latex (solid content: 40 mass %, weight ratio of styrene and butadiene: 68/32) 158 g 2,4-Dichloro-6-hydroxy-S-triazine sodium salt (8 mass % aqueous solution) 20 g Sodium laurylbenzenesulfonate (1 mass % aqueous solution) 10 ml Distilled water 854 ml Formulation <3> (For Second Layer on Back Surface)

$SnO_2$/SbO (mass ratio: 9/1, mean particle size: 0.038 μm, 17 mass % dispersion) 84 g Gelatin (10 mass % aqueous solution)89.2 g Shin-etsu Chemical's METOLOSE TC-5 (2 mass % aqueous solution) 8.6 g Soken Chemical's MP-1000 0.01 g Sodium dodecylbenzenesulfonate (1 mass % aqueous solution) 10 ml NaOH (1 mass %) 6 ml PROXEL (from ICI) 1 ml Distilled water 805 ml Both surfaces of the biaxially oriented polyethylene terephthalate support (thickness: 175 μm) were subjected to corona discharge treatment in the above manner. One surface (to have a photosensitive layer thereon) of the support was coated with the coating liquid of subbing layer formulation <1> by the use of a wire bar so that the wet application amount of the coating liquid was 6.6 ml/m$^2$ (one surface), and then dried at 180° C. for 5 minutes. Next, the other surface (back surface) of the support was coated with the coating liquid of subbing layer formulation <2> by the use of a wire bar so that the wet application amount of the coating liquid was 5.7 ml/m$^2$, and then dried at 180° C. for 5 minutes. The back surface thus coated was further coated with the coating liquid of subbing layer formulation <3> by the use of a wire bar so that the wet application amount of the coating liquid was 7.7 ml/m$^2$, and then dried at 180° C. for 6 minutes. In that manner, the support was undercoated.

2. Back Layer

Preparation of Coating Liquid for Back Surface

1) Preparation of Coating Liquid for Antihalation Layer 60 g of gelatin, 24.5 g of polyacrylamide, 2.2 g of sodium hydroxide (1 mol/liter), 2.4 g of monodispersed polymethyl methacrylate particles (mean particle size: 8 μm, standard deviation of particle size: 0.4), 0.08 g of benzoisothiazolinone, 0.3 g of sodium polystyrenesulfonate, 0.21 g of blue dye compound-1, 0.15 g of yellow dye compound-1, and 8.3 g of acrylic acid/ethyl acrylate copolymer latex (copolymerization ratio of 5/95) were mixed. Water was added to the resulting mixture so that the total amount of the resultant was 818 ml. Thus, a coating liquid for antihalation layer was prepared.

2) Preparation of Coating Liquid for Back Surface-protective Layer

In a reactor kept at 40° C., 40 g of gelatin, 1.5 g of liquid paraffin in the form of a liquid paraffin emulsion, 35 mg of benzoisothiazolinone, 6.8 g of a caustic compound (1 mol/liter), 0.5 g of sodium t-octylphenoxyethoxyethanesulfonate, 0.27 g of sodium polystyrenesulfonate, 5.4 m of aqueous 2% solution of a fluorine-containing surfactant (F-1), 6.0 g of an acrylic acid/ethyl acrylate copolymer (copolymerization weight ratio: 5/95), and 2.0 g of N,N-ethylenebis (vinylsulfonacetamide) were mixed. Water was added to the resultant mixture so that the total amount of the mixutre became 1000 ml. Thus, a coating liquid for back surface-protective layer was prepared.

Formation of Back Layer

The coating liquid for antihalation layer was applied to the back face of the undercoated substrate. The amount thereof was such that the amount of gelatin of the antihalation layer was 0.88 g/m$^2$. At the same time, the coating liquid for back surface-protective layer was applied thereto and dried to form a back layer on the antihalation layer. The amount thereof was such that the amount of gelatin of the surface-protective layer was 1.2 g/m$^2$.

[3] Image Forming Layer, Intermediate Layer and Surface Production Layer

[3-1] Provision of Coating Material

1) Preparation of Silver Halide Emulsion for Coating Liquid

Each of the silver halide emulsions was dissolved, and $7\times10^{-3}$ mol of an aqueous 1 mass % solution of benzothiazolium iodide per mol of silver and 0.34 g of 1-(3-metylureidophenyl)-5-mercaptotetrazole per 1 kg of the emulsion were added to each emulsion.

$1.5\times10^{-3}$ mol of a compound (19) having an adsorptive group and a reducing group was added to each of the resultant emulsions per 1 mol of the silver halide.

2) Preparation of the Fatty Acid Silver Salt Dispersion

Preparation of Recrystallized Behenic Acid 100 kg of behenic acid manufactured by Henkel Co. (trade name of product: Edenor C22-85R) was dissolved in 1200 kg of isopropyl alcohol at 50° C., and the resultant solution was filtered through a filter having a pore size of 10 μm and then cooled to 30° C. to recrystallize behenic acid. The cooling rate in the recrystallization was controlled to 3° C./hr. The solution was centrifugally filtered to collect recrystallized crystals, and the crystals were washed with 100 kg of isopropyl alcohol and then dried. The obtained crystals were esterified and the resultant was measured by GC-FID. The resultant had a behenic acid content of 96% and, in addition, included 2% of lignoceric acid, 2% of archidic acid and 0.001% of erucic acid.

Preparation of Dispersion of Silver Salt of Fatty Acid 88 kg of recrystallized behenic acid, 422 L of distilled water, 49.2 L of an aqueous NOH solution having a concentration of 5 mol/L and 120 L of t-butyl alcohol were mixed and reacted at 75° C. for one hour while the resultant system was stirred. Thus, a sodium behenate solution B was obtained. Separately, 206.2 L of an aqueous solution (pH 4.0) containing 40.4 kg of silver nitrate was prepared and kept at 10° C. A reaction vessel containing 635 L of distilled water and 30 L of t-butyl alcohol was kept at 30° C. The entire amount of the sodium behenate solution and the entire amount of the aqueous solution of silver nitrate were added to the content of the vessel at constant flow rates over 93 min. and 15 sec., and 90 min., respectively while the content in the vessel was sufficiently stirred. At this time, only the aqueous solution of silver nitrate was added for 11 min. after starting the addition of the aqueous solution of silver nitrate, addition of sodium behenate solution was started subsequently, and only the sodium behenate solution was added for 14 min. and 15 sec. after the completion of the addition of the aqueous solution of silver nitrate. At this time, the internal temperature of the reaction vessel was kept at 30° C. and the external temperature was controlled such that the liquid temperature was constant. The pipe line for the sodium behenate solution was a double-walled pipe and thermally insulated by circulating hot water through the interspace of the double-walled pipe, and the temperature of the solution at the outlet of the nozzle tip was adjusted at 75° C. The pipe line for the aqueous silver nitrate solution was also a double-walled pipe and thermally insulated by circulating cold water through the interspace of the double-walled pipe. Regarding the position at which the sodium behenate solution A was added to the reaction system and that at which the aqueous silver nitrate solution was added thereto, the two were disposed symmetrically to each other relative to the shaft of the stirrer disposed in the reactor, and the nozzle tips of the pipes were spaced apart from the reaction solution level in the reactor.

After adding the sodium behenate solution was finished, the reaction system was stirred for 20 minutes at that temperature, and then heated to 35° C. over 30 minutes. Thereafter, the system was aged for 210 minutes. Immediately after the completion of the ageing, the system was centrifugally filtered to take out a solid component, which was washed with water until the conductivity of the washing waste reached 30 pS/cm. The solid thus obtained was the silver salt of the fatty acid and was stored as wet cake without drying it.

The shapes of the silver behenate particle as obtained herein were analyzed on the basis of their images taken through electron microscopic photography. Average values of a, b, and c were 0.21 μm, 0.4 μm and 0.4 μm, respectively (a, b and c are defined hereinabove). The mean aspect ratio was 2.1. The fluctuation coefficient of spheres having the same volumes as those of the particles was 11%.

19.3 kg of polyvinyl alcohol (trade name, PVA-217) and water were added to the wet cake whose amount corresponded to 260 kg of the dry weight thereof so that the total amount of the resultant became 1000 kg. The resultant was formed into slurry with a dissolver wing, and then pre-dispersed with a pipe-line mixer (Model PM-10 available from Mizuho Industry Co.).

Next, the pre-dispersed stock slurry was processed three times in a disperser (MICROFLUIDIZER M-610 obtained from Microfluidex International Corporation, and equipped with a Z-type interaction chamber) at a controlled pressure of 1150 kg/cm$^2$. A silver behenate dispersion was thus prepared. To cool it, corrugated tube type heat exchangers were disposed before and after the interaction chamber. The temperature of the coolant in these heat exchangers was so controlled that the system could be processed at a dispersion temperature of 18° C.

3) Preparation of Reducing Agent Dispersion

Preparation of Reducing Agent-1 Dispersion 10 kg of a reducing agent-1 (2,2'-methylenebis-(4-ethyl-6-tert-butylphenol)), 16 kg of aqueous 10 mass % solution of modified polyvinyl alcohol (Kuraray's POVAL MP203) and 10 kg of water were sufficiently mixed to form slurry. The slurry was fed by a diaphragm pump into a horizontal sand mill (Imex's UVM-2) including zirconia beads having a mean diameter of 0.5 mm, and dispersed therewith for 3 hours. Then, 0.2 g of benzoisothiazolinone sodium salt and water were added thereto to adjust the reducing agent concentration of the resultant at 25% by mass. The dispersion was heated at 60° C. for 5 hours. A reducing agent-1 dispersion was thus prepared. The reducing agent particles in the dispersion had a median diameter of 0.40 μm, and a maximum particles size of at most 1.4 μm. The reducing agent dispersion was filtered through a polypropylene filter having a pore size of 3.0 μm to remove foreign objects such as dirt from it, and then stored.

Preparation of Reducing Agent-2 Dispersion 10 kg of a reducing agent-2 (6,6'-di-t-butyl-4,4'-dimethyl-2,2'-butylidenediphenol), 16 kg of aqueous 10 mass % solution of modified polyvinyl alcohol (Kuraray's POVAL MP203) and 10 kg of water were sufficiently mixed to form slurry. The slurry was fed by a diaphragm pump into a horizontal sand mill (Imex's UVM-2) including zirconia beads having a mean diameter of 0.5 mm, and dispersed therewith for 3 hours and 30 minutes. Then, 0.2 g of benzoisothiazolinone sodium salt and water were added thereto to adjust the reducing agent concentration of the resultant at 25% by mass. The dispersion was then heated at 40° C. for 1 hour, and then at 80° C. for 1 hour. A reducing agent-2 dispersion was thus prepared. The reducing agent particles in the dispersion had a median diameter of 0.50 μm, and a maximum particle size of at most 1.6 μm. The reducing agent dispersion was filtered through a polypropylene filter having a pore size of 3.0 μm to remove foreign objects such as dirt from it, and then stored.

4) Preparation of Hydrogen Bonding Compound-1 Dispersion 10 kg of a hydrogen bonding compound-1 (tri(4-t-butylphenyl)phosphine oxide), 16 kg of aqueous 10 mass % solution of modified polyvinyl alcohol (Kuraray's POVALMP203) and 10 kg of water were sufficiently mixed to form slurry. The slurry was fed by a diaphragm pump into a horizontal sand mill (Imex's UVM-2) containing zirconia beads having a mean diameter of 0.5 mm, and dispersed therewith for 4 hours. Then, 0.2 g of benzoisothiazolinone sodium salt and water were added thereto to adjust the hydrogen bonding compound concentration of the resultant at 25% by mass. The dispersion was heated at 40° C. for 1 hour and then at 80° C. for 1 hour. A hydrogen bonding compound-1 dispersion was thus prepared. The hydrogen bonding compound particles in the dispersion had a median diameter of 0.45 μm, and a maximum particle size of at most 1.3 μm. The hydrogen bonding compound dispersion was filtered through a polypropylene filter having a pore size of 3.0 μm to remove foreign objects such as dirt from it; and then stored.

5) Preparation of Development Promoter-1 Dispersion and Color Toning Agent Dispersion Preparation of Development Promoter-1 Dispersion 10 kg of a development promoter-1, 20 kg of aqueous 10 mass % solution of modified polyvinyl alcohol (Kuraray's POVAL MP203) and 10 kg of water were sufficiently mixed to form slurry. The slurry was fed by a diaphragm pump into a horizontal sand mill (Imex's UVM-2) containing zirconia beads having a mean diameter of 0.5 mm, and dispersed therewith for 3 hours and 30 minutes. Then, 0.2 g of benzoisothiazolinone sodium salt and water were added thereto to prepare a development promoter-1 dispersion having a development promoter concentration of 20% by mass. The development promoter particles in the dispersion had a median diameter of 0.48 μm, and a maximum particle size of at most 1.4 μm. The development promoter dispersion was filtered through a polypropylene filter having a pore size of 3.0 μm to remove foreign objects such as dirt from it, and then stored.

Preparation of Development Promoter-2 and Color Toning Agent-1 Solid Dispersions Development promoter-2 and color toning agent-1 solid dispersions having the respective concentrations of 20% by mass and 15% by mass were prepared in the same manner as the preparation of the development promoter-1 dispersion.

6) Preparation of Polyhalogen Compound Dispersion

Preparation of Organic Polyhalogen Compound-1 Dispersion 10 kg of an organic polyhalogen compound-1 (tribromomethanesulfonylbenzene), 10 kg of aqueous 20 mass % solution of modified polyvinyl alcohol (Kuraray's POVALMP203), 0.4 kg of aqueous 20 mass % solution of sodium triisopropylnaphthalenesulfonate, and 14 kg of water were sufficiently mixed to prepare slurry. The slurry was fed by a diaphragm pump into a horizontal sand mill (Imex's UVM-2) including zirconia beads having a mean diameter of 0.5 mm, and dispersed therewith for 5 hours. Then, 0.2 g of benzoisothiazolinone sodium salt and water were added thereto to prepare an organic polyhalogen compound-1 dispersion having an ogranic polyhalogen compound content of 30 mass %. The organic polyhalogen compound particles in the dispersion had a median diameter of 0.41 μm, and a maximum particle size of at most 2.0 μm. The organic polyhalogen compound dispersion was filtered through a polypropylene filter having a pore size of 10.0 μm to remove foreign objects such as dirt from it, and then stored.

Preparation of Organic Polyhalogen Compound-2 Dispersion 10 kg of an organic polyhalogen compound-2 (N-butyl-3-tribromomethanesulfonylbenzamide), 20 kg of aqueous 10 mass % solution of modified polyvinyl alcohol (Kuraray's POVAL MP203), and 0.4 kg of aqueous 20 mass % solution of sodium triisopropylnaphthalenesulfonate were sufficiently mixed to prepare slurry. The slurry was fed by a diaphragm pump into a horizontal sand mill (Imex's UVM-2) including zirconia beads having a mean diameter of 0.5 mm, and dispersed therewith for 5 hours. Then, 0.2 g of benzoisothiazolinone sodium salt and water were added thereto to adjust the organic polyhalogen compound content of the resultant at 30 mass %. The dispersion was heated at 40° C. for 5 hours. An organic polyhalogen compound-2 dispersion was thus obtained. The organic polyhalogen compound particles in the dispersion had a median diameter of 0.40 μm, and a maximum particle size of at most 1.3 μm. The organic polyhalogen compound dispersion was filtered through a polypropylene filter having a pore size of 3.0 μm to remove foreign objects such as dirt from it, and then stored.

7) Preparation of Phthalazine Compound-1 Solution 8 kg of modified polyvinyl alcohol MP 203 manufactured by Kuraray Co. was dissolved in 174.57 kg of water and then 3.15 kg of an aqueous 20 mass % solution of sodium triisopropylnaphthalenesulfonate and 14.28 kg of an aqueous 70 mass % solution of phthalazine compound-1 (6-isopropylphthalazine) were added to the resultant solution to prepare a 5 mass % solution of phthalazine compound-1.

8) Preparation of Mercapto Compound

Preparation of Mercapto Compound-1 Aqueous Solution 20 g of mercapto compound-1 (1-(3-methylureidophenyl)-5-mercaptotetrazole) was dissolved in 980 g of water to form an aqueous 2.0 mass % solution.

9) Preparation of Pigment-1 Dispersion 64 g of C.I. Pigment Blue 60, 6.4 g of Kao's DEMOLE N and 250 g of water were sufficiently mixed to prepare slurry. 800 g of zirconia beads having a mean diameter of 0.5 mm were prepared and put into a vessel along with the slurry. The slurry in the vessel was dispersed by the use of a disperser (Imex's 1/4G Sand Grinder Mill) for 25 hours, and water was added to the slurry to prepare a pigment-1 dispersion having a pigment concentration of 5% by mass. The pigment particles in the dispersion thus prepared had a mean grain size of 0.21 μm.

11) Preparation of SBR Latex

SBR latex was prepared as follows.

287 g of distilled water, 7.73 g of a surfactant (Takemoto Yushi's PIONIN A-43-S, having a solid content of 48.5%), 14.06 ml of 1 mol/liter NaOH, 0.15 g of tetrasodium ethylene diamine tetra acetate, 255 g of styrene, 11.25 g of acrylic acid, and 3.0 g of tert-dodecylmercaptan were put into the polymerization reactor of a gas monomer reaction apparatus (Taiatsu Glass Industry's TAS-2J Model). The reactor was sealed, and the content therein was stirred at 200 rpm. The internal air was exhausted via a vacuum pump, and purged a few times repeatedly with nitrogen. Then, 108.75 g of 1,3-butadiene was introduced into the reactor under pressure, and the internal temperature of the reactor was raised to 60° C. A solution in which 1.875 g of ammonium persulfate was dissolved in 50 ml of water was added to the system, and the system was stirred for 5 hour. It was further heated to 90° C. and stirred for 3 hours. After the reaction was completed, the internal temperature was lowered to room temperature. Then, NaOH and $NH_4OH$ (both 1 mol/liter) were added to the system at a molar ratio of $Na^+$ and $NH_4^+$ of 1/5.3 so as to adjust the pH of the system at 8.4. Next, the system was filtered through a polypropylene filter having a pore size of 1.0 μm to remove foreign objects such as dirt from it, and then stored. 774.7 g of SBR latex was thus obtained. Its halide ion content was measured through ion chromatography, and the chloride ion concentration of the latex was 3 ppm. The chelating agent concentration thereof was measured through high-performance liquid chromatography, and was 145 ppm.

The mean particle size of the latex was 90 nm, Tg thereof was 17° C., the solid content thereof was 44% by mass, the equilibrium moisture content thereof at 25° C. and 60% RH was 0.6% by mass, and the ion conductivity thereof was 4.80 mS/cm. To measure the ion conductivity, a Toa Denpa Kogyo's conductivity meter CM-30 S was used. In the device, the 44 mass % latex was measured at 25° C. Its pH was 8.4.

3-2. Preparation of Coating Liquid

1) Preparation of Image Forming Layer Coating Liquid-1

The Pigment-1 dispersion, the organic polyhalogen compound-1 dispersion, the organic polyhalogen compound-2 dispersion, the phthalazine compound-1 solution, the SBR latex (Tg: 17° C.) liquid, the reducing agent-1 dispersion, the reducing agent-2 dispersion, the hydrogen bonding compound-1 dispersion, the development promotor-1 dispersion, the development promotor-2 dispersion, the color toning agent-1 dispersion, and the aqueous solution of mercapto compound-1 were added successively to 1,000 g of the dispersion of the silver salt of the fatty acid obtained as described above and 276 ml of water. The silver halide emulsion mixture was added to and throughly mixed with the resultant mixture just before application to form an image forming layer coating liquid, which was fed as it was to a coating die and applied to the support.

The mixing ratio was adjusted so as to provide the coating amount of each component as will be described later.

2) Preparation of Intermediate Layer Coating Liquid 27 ml of aqueous 5 mass % solution of AEROSOL OT (from American Cyanamid), 135 ml of aqueous 20 mass % solution of diammonium phthalate and water were added to 1000 g of a polyvinyl alcohol, Kuraray's PVA-205, 272 g of the pigment-1 dispersion, and 4200 ml of 19 mass % latex of a methyl methacrylate/styrene/butyl acrylate/hydroxyethyl methacrylate/acrylic acid copolymer (copolymerization ratio: 64/9/20/5/2 by weight) so that the total amount of the resultant mixture became 10000 g. The pH of the mixture was adjusted at 7.5 with the addition of NaOH. An intermediate layer coating liquid was thus obtained. This was fed into a coating die, with its flow rate so controlled that its coating amount was 9.1 ml/$m^2$.

The viscosity of the coating liquid at 40° C. was 58 [mPa·S] when measured by a B-type viscometer (No. 1 rotor, 60 rpm).

3) Preparation of a First Surface-Protective Layer Coating Liquid 64 g of inert gelatin was dissolved in water, and 112 g of 19.0 mass % latex of a methyl methacrylate/styrene/butyl acrylate/hydroxyethyl methacrylate/acrylic acid copolymer (copolymerization ratio: 64/9/20/5/2 by weight), 30 ml of 15 mass % methanol solution of phthalic acid, 23 ml of aqueous 10 mass % solution of 4-methylphthalic acid, 28 ml of sulfuric acid (0.5 mol/liter), 5 ml of aqueous 5 mass % solution of AEROSOL OT (from American Cyanamid), 0.5 g of phenoxyethanol, 0.1 g of benzoisothiazolinone, and water were added to the resultant solution so that the total amount of the resultant mixture became 750 g. Just before application thereof, 26 ml of 4 mass % chromium alum was added to the mixture, and the resultant was stirred with a static mixer. The resultant coating liquid was fed into a coating die so that the amount of the resultant coating was 18.6 ml/$m^2$.

The viscosity of the coating liquid at 40° C. was 20 [mPa·s] when measured by a B-type viscometer (No. 1 rotor, 60 rpm).

4) Preparation of a Second Surface-Protective Layer Coating Liquid 80 g of inert gelatin was dissolved in water, and 102 g of 27.5 mass % latex of a methyl methacrylate/styrene/butyl acrylate/hydroxyethyl methacrylate/acrylic acid copolymer (copolymerization ratio: 64/9/20/5/2 by weight), 5.4 ml of a 2 mass % solution of a fluorine-containing surfactant (F-1), 5.4 ml of an aqueous 2 mass % solution of a fluorine-containing surfactant (F-2), 23 ml of a 5 mass % solution of AEROSOL OT (from American Cyanamid), 4 g of fine polymethyl methacrylate particles (mean particle size: 0.7 μm), 21 g of fine polymethyl methacrylate particles (mean particle size: 4.5 μm), 1.6 g of 4-methylphthalic acid, 4.8 g of phthalic acid, 44 ml of sulfuric acid (0.5 mol/liter), 10 mg of benzoisothiazolinone, and water were added to the resultant solution so that the total amount of the resultant mixture became 650 g. Just before application thereof, 445 ml of aqueous solution containing 4 mass % of chromium alum and 0.67 mass % of phthalic acid was added to the mixture, and the resultant was stirred with a static mixer. A second surface protection layer coating liquid was thus obtained. The coating liquid was fed into a coating die, with its flow rate so controlled that its coating amount was 8.3 ml/m$^2$.

The viscosity of the coating liquid at 40° C. was 19 [mPa·S] when measured by a B-type viscometer (No. 1 rotor, 60 rpm).

3-3. Preparation of Heat-developable Photosensitive Materials

An image forming layer, an intermediate layer, a first surface-protective layer, and a second surface-protective layer were coated simultaneously by a slide bead coating method on the surface opposite to the back surface in this order from an undercoat layer to prepare specimens of heat-developable photosensitive materials. The temperature was controlled at 311° C. for the image forming layer and the intermediate layer, at 36° C. for the first surface-protective layer, and at 37° C. for the second surface-protective layer.

The coating amount (g/m$^2$) of each of the compounds in the image forming layer is as described below.

| | |
|---|---|
| Silver behenate | 5.27 |
| Pigment (C. I. Pigment Blue 60) | 0.036 |
| Polyhalogen compound - 1 | 0.09 |
| Polyhalogen compound - 2 | 0.14 |
| Phthalazine compound - 1 | 0.18 |
| SBR latex | 9.43 |
| Reducing agent - 1 | 0.55 |
| Reducing agent - 2 | 0.22 |
| Hydrogen bonding compound - 1 | 0.28 |
| Development promotor - 1 | 0.025 |
| Development promotor - 2 | 0.020 |
| Color toning agent - 1 | 0.008 |
| Mercapto compound - 1 | 0.006 |
| Silver halide (as Ag) | 0.046 |

Coating and drying conditions are shown below.

Before coating, the static electricity of the support was eliminated by blowing an ion blow to the support. The coating speed was 160 m/min. The coating and drying conditions for each sample were controlled within the range mentioned below so that the coated surface was stabilized to the best.

The distance between the coating die tip and the support was between 0.10 and 0.30 mm. The pressure in the decompression chamber was lower by 196 to 882 Pa than the atmospheric pressure. In the subsequent chilling zone, the coated support was chilled with an air blow (its dry-bulb temperature was 10 to 20° C.). In the next helix type contactless drying zone, the support was dried with a dry air blow (its dry-bulb temperature was 23 to 45° C., and its wet-bulb temperature was 15 to 21° C.). In this zone, the coated support to be dried was kept not in contact with the drier. After the drying, the support was conditioned at 25° C. and 40 to 60% RH, and then heated so that the surface temperature was between 70 and 90° C. After thr heating, the support was cooled to have a surface temperature of 25° C.

The degree of matting, in terms of the Beck's smoothness, of the heat-developable photosensitive material thus prepared was 550 seconds on the photosensitive layer-coated surface thereof and 130 seconds on the back surface thereof. The pH of the photosensitive layer-coated surface of the sample was measured and was 6.0.

Chemical structures of the compounds used in this Example are shown below.

Compound (19) having adsorptive group and reducing group

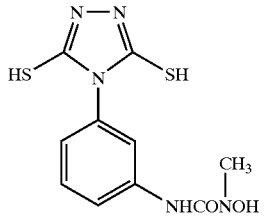

Blue dye compound-1

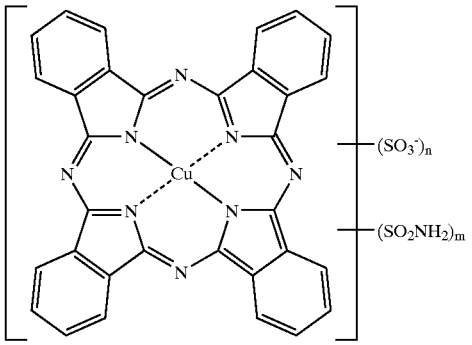

n = 1~3
m = 1~3

Yellow dye compound-1

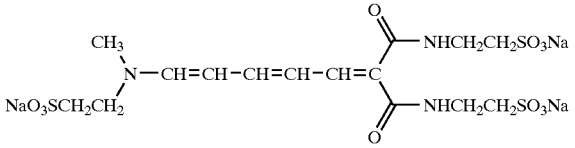

Reducing agent-1

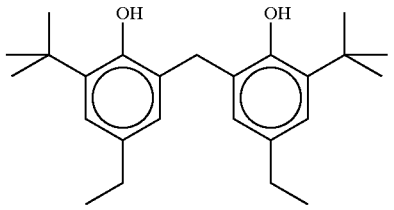

-continued

Reducing agent-2

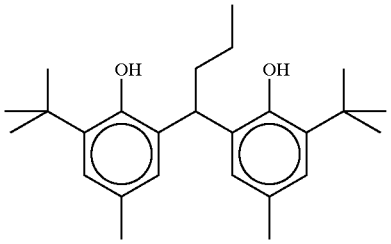

Hydrogen bonding compound-1

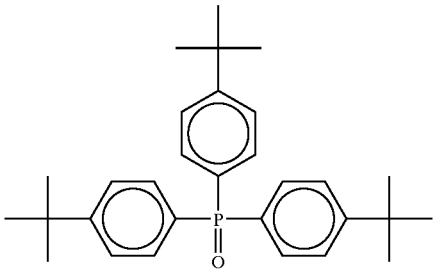

Polyhalogen compound-1

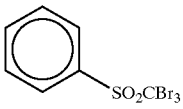

Polyhalogen compound-2

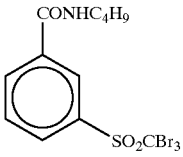

Mercapto compound-1

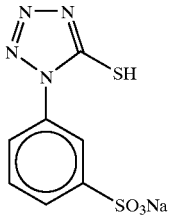

Mercapto compound-2

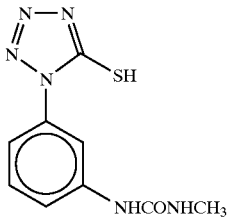

Phthalazine compound-1

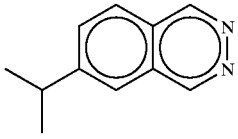

-continued

Development promoter-1

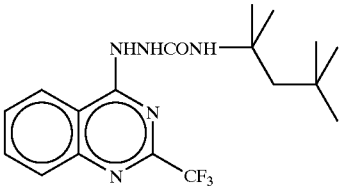

Development promoter-2

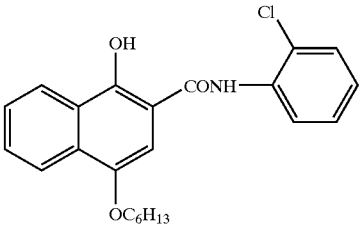

Color toning agent-1

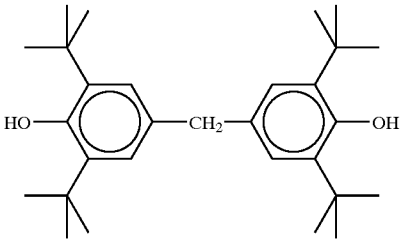

Compound F-1

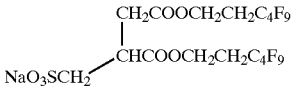

Compound F-2

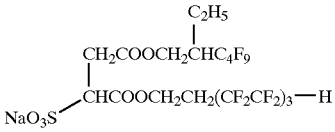

Evaluation of Photographic Performance

Each specimen thus prepared was cut into pieces of a half-size, packaged with a packaging material mentioned below at 25° C. and 50% RH, and tested according to the test method mentioned below.

Packaging Material

The packaging material used herein was a film comprising a PET film having a thickness of 10 $\mu$m, a PE film having a thickness of 12 $\mu$m, an aluminium foil having a thickness of 9 $\mu$m, a nylone film having a thickness of 15 $\mu$m, and a 3% carbon-containing polyethylene having a thickness of 50 $\mu$m, and having an oxygen permeability of 0.02 ml/atm·m$^2$·25° C.·day and a moisture permeability of 0.10 g/atm·m$^2$·25° C.·day.

A laser source, Nichia Chemical Industry's semiconductor laser NLHV3000E was set in the exposure zone of Fuji Medical Dry Laser Imager FM-DPL, and its beam diameter was narrowed down to 100 $\mu$m. With the intensity of laser light on the surface of the heat-developable photosensitive material specimen controlled to be 0 or within a range of from 1 mW/mm$^2$ to 1000 mW/mm$^2$, the specimen was exposed to the laser light for $10^{-6}$ seconds. The laser light oscillation wavelength was 405 nm. In the heat development, the temperatures of four panel heaters were set at 112° C., 118° C., 120° C. and 120° C., respectively and the total development time was set at 14 seconds by accelerating the conveying speed. The density of the image formed was measured with a densitometer.

From the density measured, characteristic curves of the density relative to the amount of exposure was depicted. The sensitivity was indicated by the inverse of the amount of exposure providing a fogging level of +2.0 and the relative sensitivity of a specimen was obtained by multiplying together 100 and a quotient obtained by dividing the sensitivity of the specimen by that of specimen 10 and was shown in Table 5.

TABLE 5

| Specimen No. | Emulsion No. | Fogging level | Relative sensitivity | Remarks |
|---|---|---|---|---|
| 10 | A | 0.05 | 100 | Comp. Example |
| 11 | B-1 | 0.05 | 112 | Comp. Example |
| 12 | B-2 | 0.05 | 126 | Example of invention |
| 13 | C-1 | 0.09 | 120 | Comp. Example |
| 14 | C-2 | 0.06 | 141 | Example of invention |
| 15 | D-1 | 0.05 | 142 | Comp. Example |
| 16 | D-2 | 0.05 | 162 | Example of invention |
| 17 | E-1 | 0.48 | 118 | Comp. Example |
| 18 | E-2 | 0.12 | 142 | Example of invention |

It has been found from the result of Table 5 that the specimens which had been subjected to chalcogen sensitization and gold sensitization during the particle formation had higher sensitizing effect and lower fogging level than the specimens which had been subjected to chalcogen sensitization and gold sensitization after the completion of particle formation. This is an unexpected effect in view of Table 4 which shows the result of Example 5 and it has been found that conducting chalcogen sensitization and gold sensitization during particle formation is particularly preferred for the heat-developable photosensitive material.

Example 6

Emulsions F-1 and F-2 were prepared in the same manner as the preparation methods of the emulsions E-1 and E-2 in Example 5 except that the amounts of potassium iodide and potassium bromide were changed to 54 g and 2.3 g, respectively, in the solution D. The grain size of the obtained silver bromoiodide emulsion was 0.043 $\mu$m. Heat-developable photosensitive materials were prepared and tested in the same manner as in Example 5 except that $1.5\times10^{-3}$ mol, per mol of silver halide, a compound (20) whose one-electron oxidant formed through one-electron oxidation can release at least one electron was added to each of the emulsions instead of the compounds (19) having the adsorptive group and the reducing group and that the relative sensitivity of a specimen was obtained by multiplying together 100 and a quotient obtained by dividing the sensitivity of the specimen by that of specimen 19. The results are shown in Table 6.

Compound (20) whose one electron oxidant formed through one electron oxidation can release at least one electron

TABLE 6

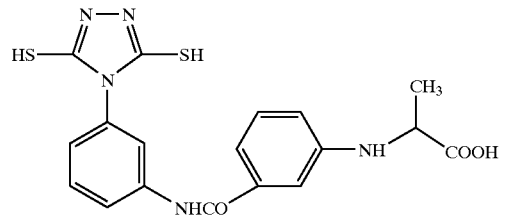

| Specimen No. | Emulsion No. | Fogging level | Relative sensitivity | Remarks |
|---|---|---|---|---|
| 19 | F-1 | 0.56 | 100 | Comp. Example |
| 20 | F-2 | 0.14 | 126 | Example of invention |

As is apparent from Table 6, the specimen 20 which had been subjected to gold sulfur sensitization in the course of the formation of the silver bromoiodide emulsion particles had higher sensitivity and lower fogging than the specimen 19.

What is claimed is:

1. A photosensitive silver halide photographic emulsion comprising a photosensitive silver halide wherein the silver halide includes silver iodide and the silver iodide content is from 41 mol % to 100 mol % wherein the silver halide is exposed to reduction sensitization during the course of silver halide particle formation.

2. A heat-developable photosensitive material comprising a support, and an image forming layer including a photosensitive silver halide, a non-photosensitive organic silver salt, a reducing agent and a binder, wherein the photosensitive silver halide is the silver halide according to claim 1.

3. A photosensitive silver halide photographic emulsion according to claim 1, to which chalcogen sensitization or gold-chalcogen sensitization is applied.

4. A photosensitive silver halide photographic emulsion according to claim 3, wherein the chalcogen sensitization is selected from tellurium sensitization, selenium sensitization and sulfur sensitization.

5. A photosensitive silver halide photographic emulsion according to claim 1, wherein the photosensitive silver halide contains 80 mol % to 100 mol % of silver iodide.

6. A photosensitive silver halide photographic emulsion according to claim 1, wherein the grain size of the photosensitive silver halide is from 10 nm to 45 nm.

7. A photosensitive silver halide photographic emulsion according to claim 1, wherein the photosensitive silver halide is tabular particles with an aspect ratio of 2 or more.

8. A photosensitive silver halide photographic emulsion according to claim 1, comprising a compound which generates two electrons with one photon.

9. A photosensitive silver halide photographic emulsion according to claim 1, comprising a compound which has an adsorptive group and a reducing group.

10. A heat-developable photosensitive material according to claim 2, wherein the heat developable photosensitive material is exposed to laser light.

11. A silver halide photographic emulsion comprising a photosensitive silver halide wherein the silver halide includes 41 mol % to 100 mol % of silver iodide and wherein the silver halide comprises silver halide particles and at least a portion of the silver halide particles is subjected to at least one of chalcogen sensitization and gold sensitization during particle formation such that interior portions of the particles are sensitized.

12. A silver halide photographic emulsion according to claim 11, wherein the silver halide particles are subjected to both chalcogen sensitization and gold sensitization.

13. A heat-developable photosensitive material comprising at least a photosensitive silver halide, a non-photosensitive organic silver salt, a reducing agent and a binder on one surface of a support, wherein the silver halide is the silver halide according to claim 11.

14. A photosensitive silver halide photographic emulsion according to claim 11, wherein the chalcogen sensitization is selected from sulfur sensitization, selenium sensitization and tellurium sensitization.

15. A photosensitive silver halide photographic emulsion according to claim 11, wherein both the chalcogen sensitization and the gold sensitization are applied in the course of particle formation.

16. A photosensitive silver halide photographic emulsion according to claim 11, wherein reduction sensitization is further applied.

17. A photosensitive silver halide photographic emulsion according to claim 11, wherein the photosensitive silver halide contains 80 mol % to 100 mol % of silver iodide.

18. A photosensitive silver halide photographic emulsion according to claim 11, wherein the photosensitive silver halide contains 1 mol % to 10 mol % of silver bromide or silver chloride.

19. A photosensitive silver halide photographic emulsion according to claim 11, wherein the grain size of the photosensitive silver halide is from 10 nm to 45 nm.

20. A photosensitive silver halide photographic emulsion according to claim 11, wherein the photosensitive silver halide is tabular particles with an aspect ratio of 2 or more.

21. A photosensitive silver halide photographic emulsion according to claim 11, comprising at least one of a compound having an adsorptive group and a reducing group and a compound in which a one electron oxidant generated by means of one electron oxidation can release at least one electron.

22. A photosensitive silver halide photographic emulsion according to claim 11, wherein the photosensitive silver halide is exposed to laser light.

23. A heat-developable photosensitive material according to claim 13, further comprising at least one of a compound having an adsorptive group and a reducing group and a compound in which a one electron oxidant generated by means of one electron oxidation can release at least one electron.

24. A heat-developable photosensitive material according to claim 13, wherein the heat developable photosensitive material is exposed to laser light.

25. A silver halide photographic emulsion comprising a photosensitive silver halide that includes 41 mol % to 100 mol % of silver iodide, wherein at least a part of the silver halide comprises silver halide particles sensitized by at least one of chalcogen sensitization and gold sensitization during formation of the particles.

* * * * *